US011049367B2

(12) United States Patent
Hamman et al.

(10) Patent No.: US 11,049,367 B2
(45) **Date of Patent: *Jun. 29, 2021**

(54) SYSTEM AND METHOD FOR INSTANT WIN SCRATCH OFF TICKET GAME WITH TICKET SALES MAXIMIZATION USING SECONDARY GAME

(71) Applicant: SCA Promotions, Dallas, TX (US)

(72) Inventors: Robert D. Hamman, Dallas, TX (US); Kenneth E. Irwin, Jr., Dawsonville, GA (US); Jay B. Ross, Delran, NJ (US)

(73) Assignee: SCA PROMOTIONS, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/822,595

(22) Filed: Mar. 18, 2020

(65) Prior Publication Data

US 2020/0294362 A1 Sep. 17, 2020

Related U.S. Application Data

(63) Continuation-in-part of application No. 16/558,898, filed on Sep. 3, 2019, now Pat. No. 10,636,254.

(60) Provisional application No. 62/919,389, filed on Mar. 11, 2019.

(51) Int. Cl.

| | |
|---|---|
| ***G07F 17/00*** | (2006.01) |
| ***G07F 19/00*** | (2006.01) |
| ***G07F 17/32*** | (2006.01) |

(52) U.S. Cl.

CPC ..... *G07F 17/3267* (2013.01); *G07F 17/329* (2013.01)

(58) Field of Classification Search

CPC ..... G07F 17/329; A63F 3/06; A63F 3/0645; A63F 3/065

See application file for complete search history.

(56) References Cited

U.S. PATENT DOCUMENTS

| | | | | |
|---|---|---|---|---|
| 4,174,857 | A | 11/1979 | Koza | |
| 4,191,376 | A | 3/1980 | Goldman et al. | |
| 4,299,637 | A | 11/1981 | Oberdeck et al. | |
| 4,643,454 | A | 2/1987 | Ondis | |
| 8,579,693 | B2 | 11/2013 | Bennett et al. | |
| 10,636,254 | B1 * | 4/2020 | Hamman | A63F 3/06 |

(Continued)

*Primary Examiner* — Milap Shah

(74) *Attorney, Agent, or Firm* — Meagher Emanuel Laks Goldberg & Liao, LLP

(57) ABSTRACT

According to various embodiments, a system, method, and non-transitory computer-readable medium for increasing the operational lifetime of a scratch-off ticket lottery game where all maximum award amount tickets have been identified by establishing a secondary game with qualified entry is disclosed. The system, method, and non-transitory computer-readable medium include a computer system configured with a game specification file and at least one random number generator based on a publicly verifiable entropy source. The computer system is programmed to randomly generate sequences of characters for the scratch-off lottery game. The computer system is further programmed to establish a winning award amount threshold to qualify for entry into a secondary game. The computer system is additionally programmed to randomly distribute the sequences of characters among a plurality of tickets for purchase.

21 Claims, 68 Drawing Sheets

(56) References Cited

U.S. PATENT DOCUMENTS

| | | | |
|---|---|---|---|
| 2001/0044336 | A1 | 11/2001 | Reiss |
| 2003/0116916 | A1 | 6/2003 | Cherry |
| 2004/0056416 | A1 | 3/2004 | Bennet |
| 2007/0057461 | A1 | 3/2007 | Meyer |
| 2008/0045299 | A1 | 2/2008 | Bennet |
| 2009/0061992 | A1 | 3/2009 | Boykin |
| 2009/0186680 | A1 | 7/2009 | Napolitano |
| 2012/0136465 | A1 | 5/2012 | Guinn |
| 2015/0310696 | A1 | 10/2015 | Mound |
| 2017/0024954 | A1 | 1/2017 | Chhabbra |
| 2018/0012453 | A1 | 1/2018 | Anderson |
| 2018/0068529 | A1 | 3/2018 | Delekta |

* cited by examiner

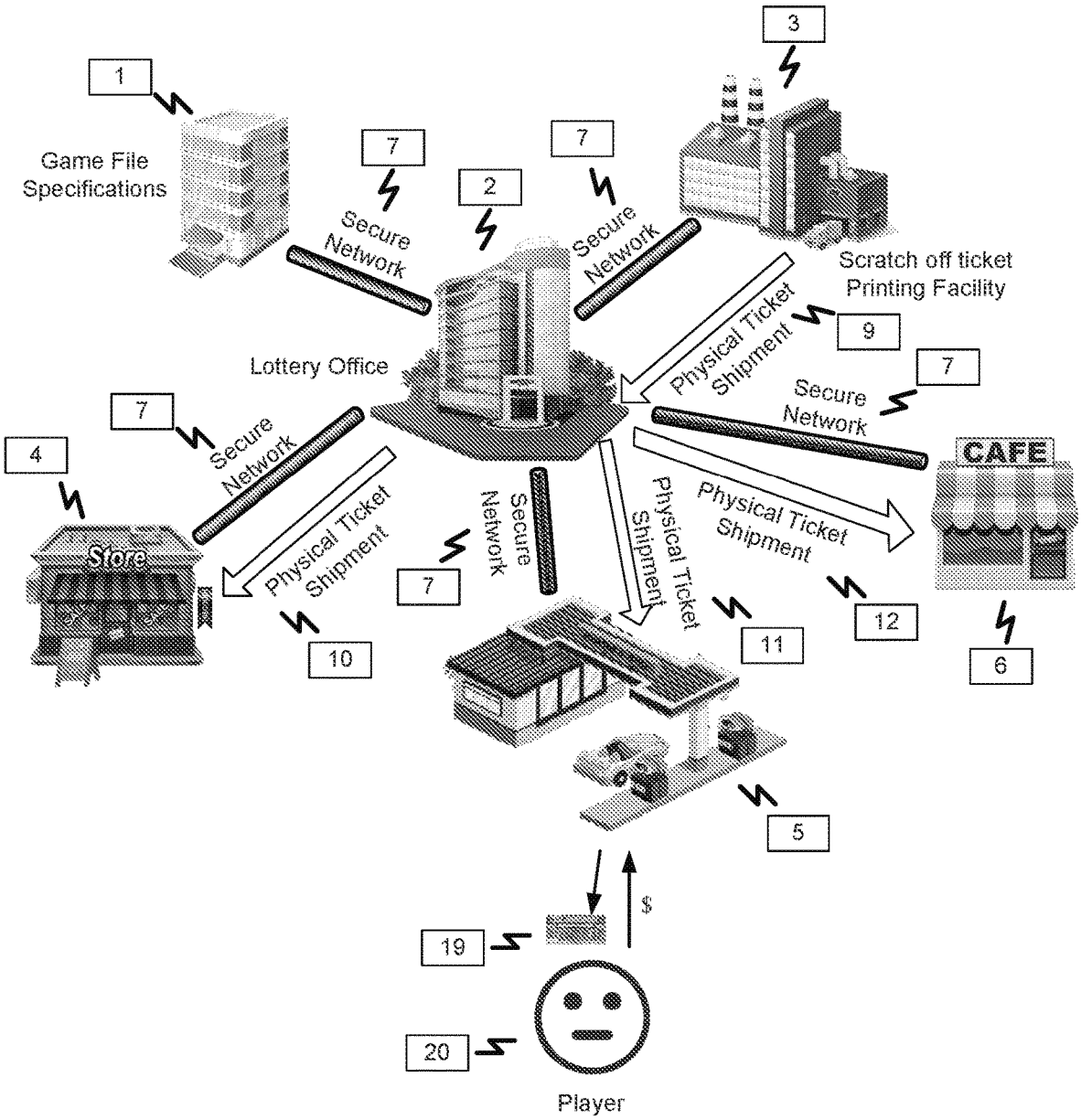
Figure #1

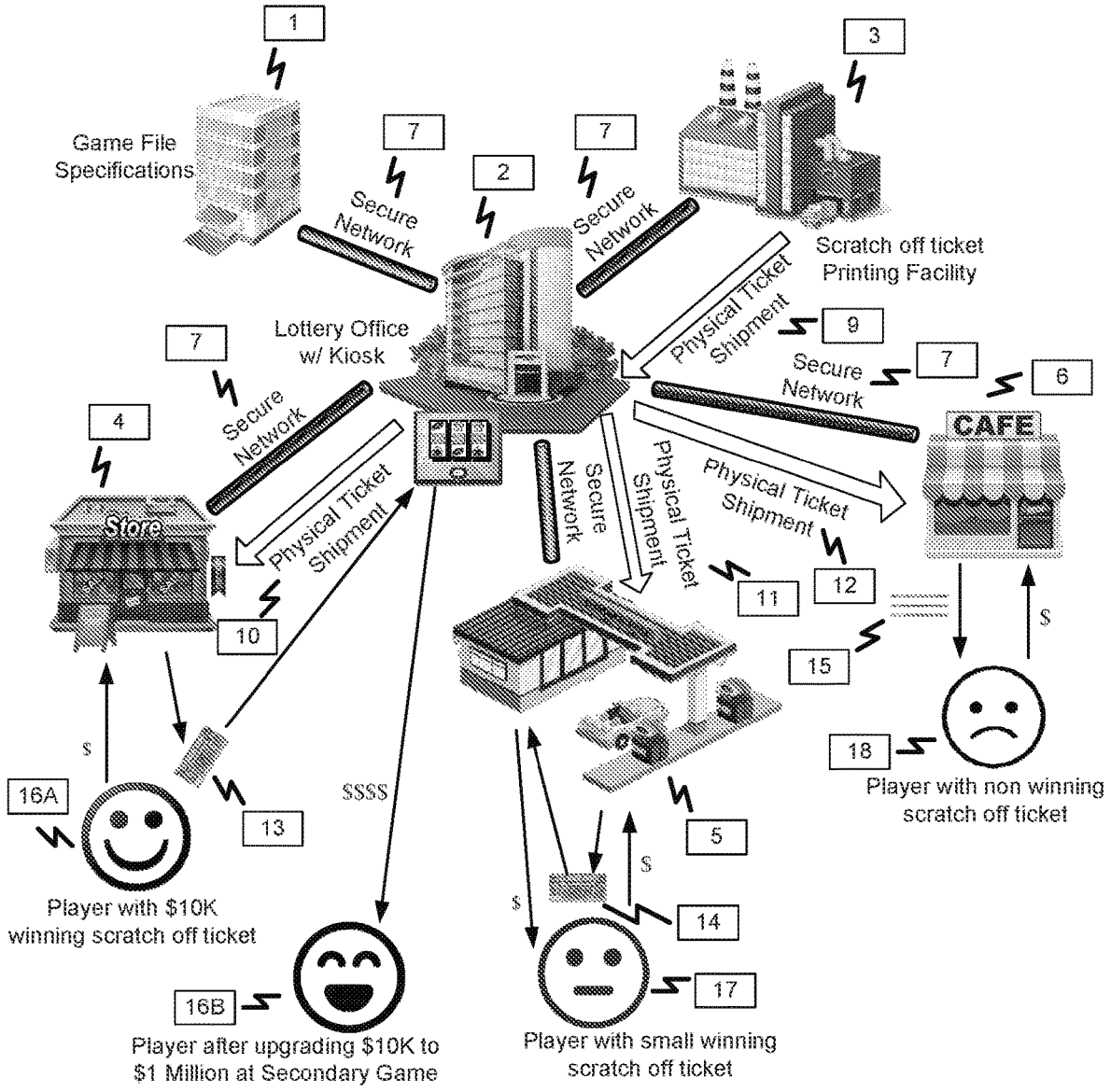
Figure #2

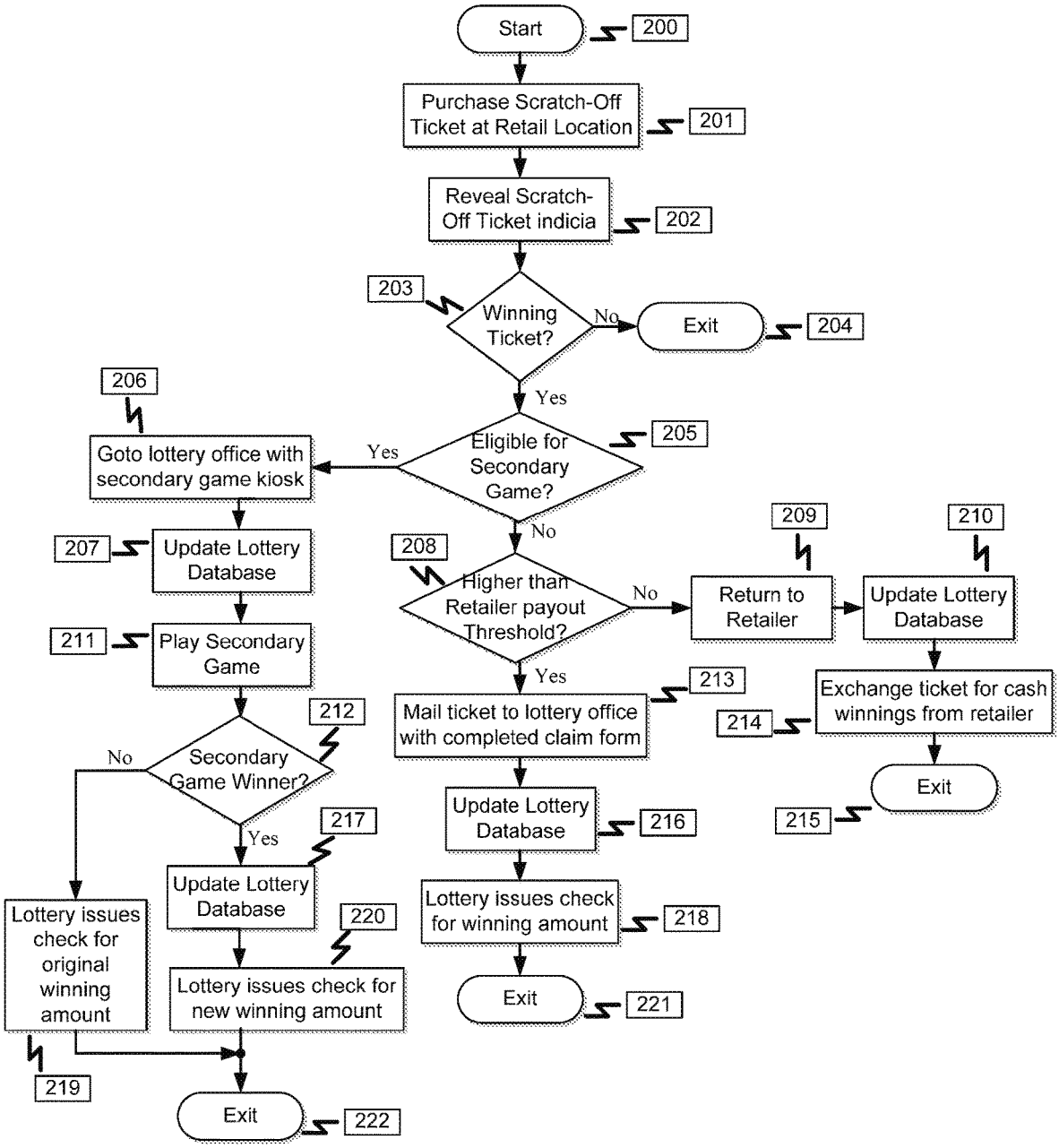
Figure #3

| | |
|---|---|
| Size of Print Run | 5,400,000 |
| Pools | 50 |
| Pool Size | 108,000 |
| Cost per ticket | $20.00 |
| Tickets per roll | 15 |
| Total rolls | 360,000 |
| Rolls per pool | 7,200 |
| Maximum # of Second Chance Upgrades Permitted | 10 |

| | Prize | Total Available | Prize per Pool | Token # |
|---|---|---|---|---|
| Prize Schedule | 1,000,000 | 5 | - | 10 |
| | 100,000 | 5 | - | 9 |
| | 10,000 | 50 | 1 | 8 |
| | 1,000 | 4,300 | 86 | 7 |
| | 500 | 8,100 | 162 | 6 |
| | 200 | 27,450 | 549 | 5 |
| | 100 | 216,000 | 4,320 | 4 |
| | 50 | 360,000 | 7,200 | 3 |
| | 40 | 180,000 | 3,600 | 2 |
| | 20 | 720,000 | 14,400 | 1 |
| | 0 | 3,884,100 | 77,682 | 0 |

Figure #4

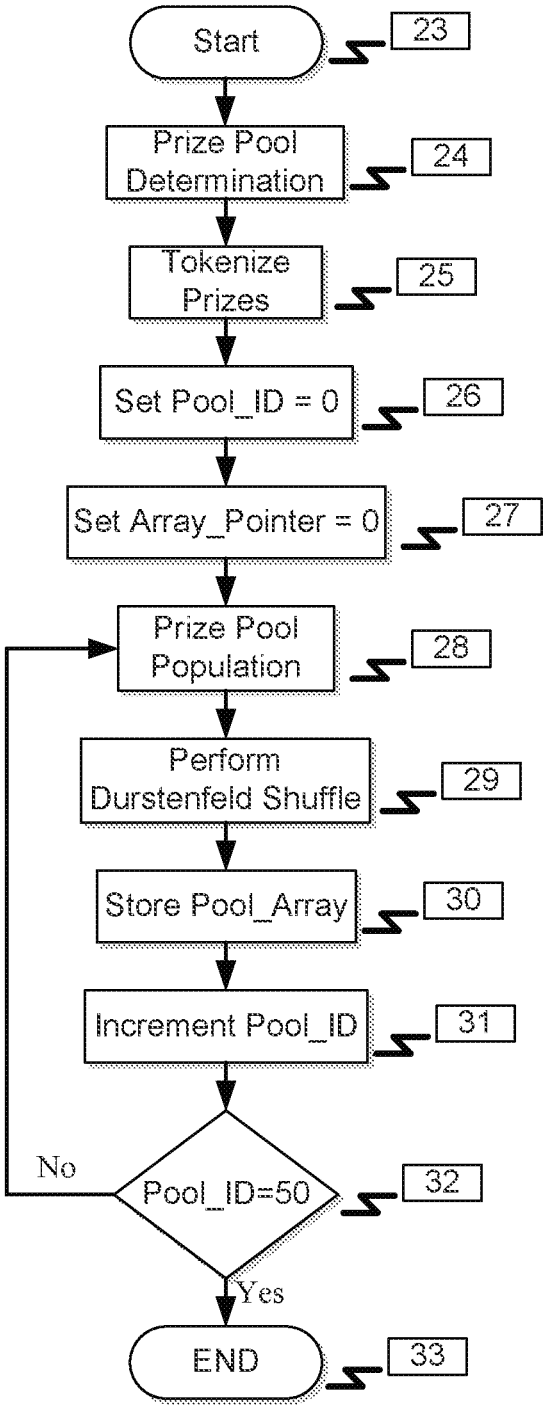
Figure #5

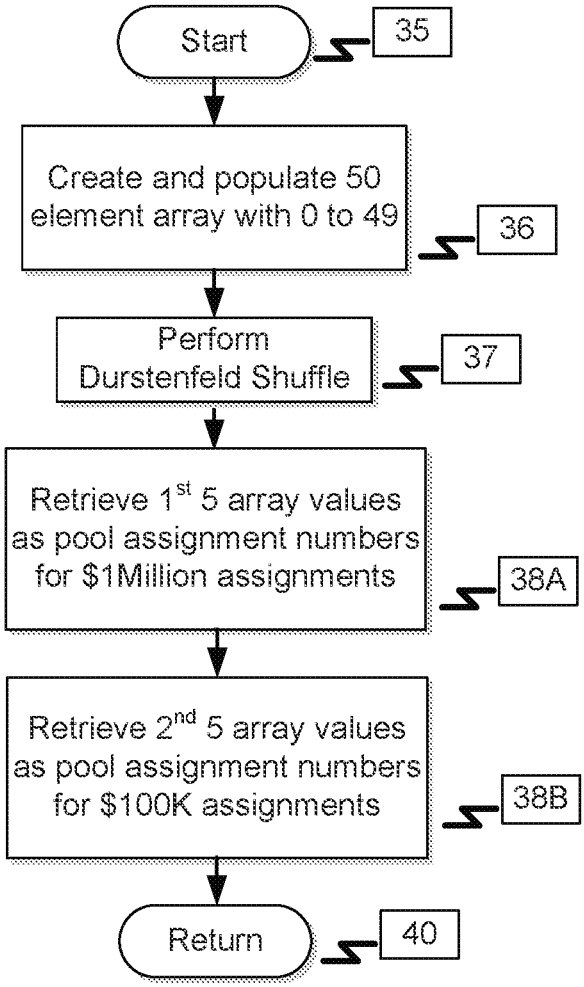
Figure #6

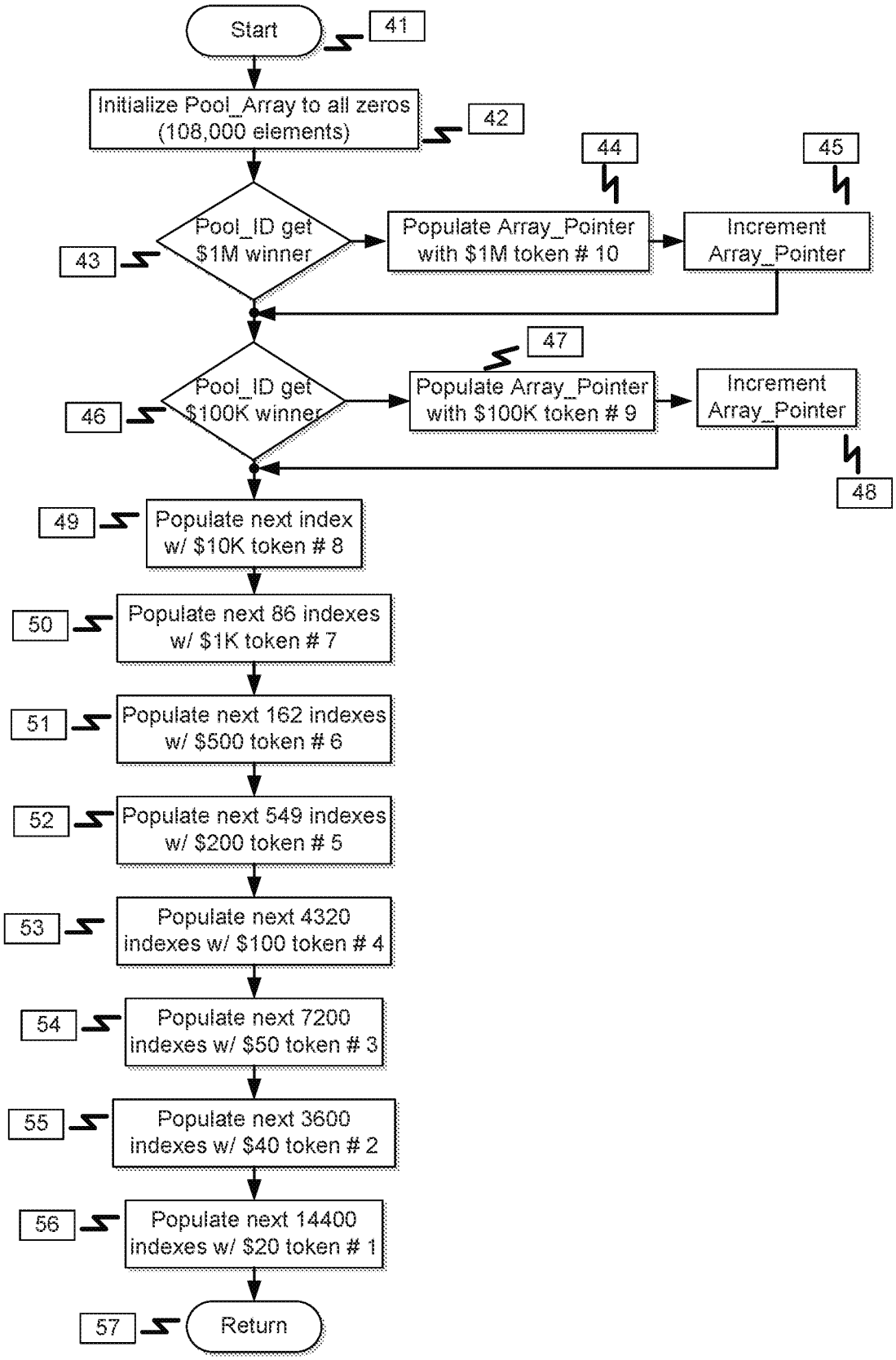
Figure #7

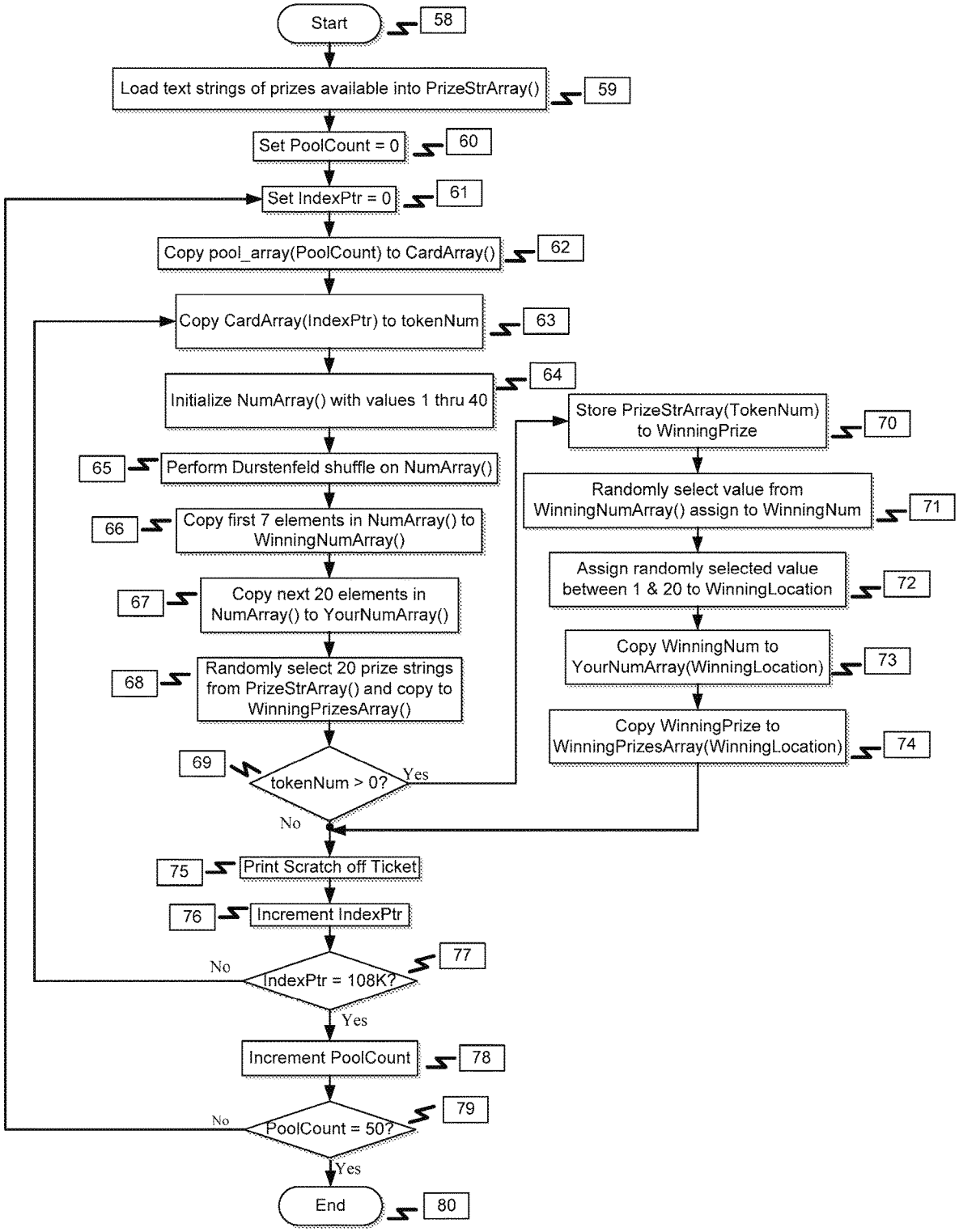
Figure #8

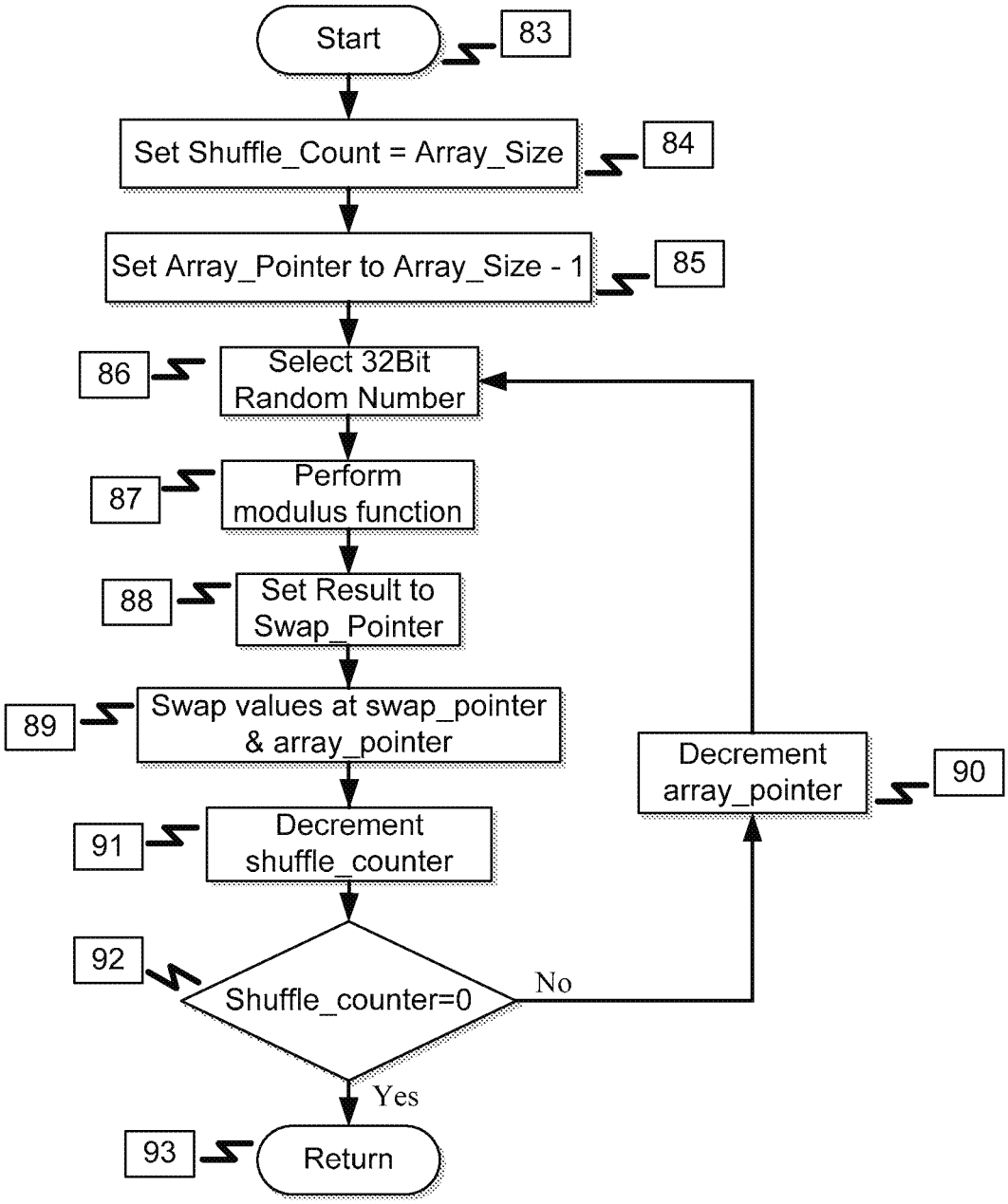
Figure #9

94 Initial Population:

| 0 | 1 | 2 | 3 | 4 | 5 |
|---|---|---|---|---|---|

95 Swap 1: Pointer = 5, R mod Pointer = 2

| 0 | 1 | 2 | 3 | 4 | 5 |
|---|---|---|---|---|---|

96 Swap 2: Pointer = 4, R mod Pointer = 0

| 0 | 1 | 5 | 3 | 4 | 2 |
|---|---|---|---|---|---|

97 Swap 3: Pointer = 3, R mod Pointer = 1

| 4 | 1 | 5 | 3 | 0 | 2 |
|---|---|---|---|---|---|

98 Swap 4: Pointer = 2, R mod Pointer = 1

| 4 | 3 | 5 | 1 | 0 | 2 |
|---|---|---|---|---|---|

99 Swap 5: Pointer = 1, R mod Pointer = 0

| 4 | 5 | 3 | 1 | 0 | 2 |
|---|---|---|---|---|---|

100 Final Population

| 5 | 4 | 3 | 1 | 0 | 2 |
|---|---|---|---|---|---|

Figure #10

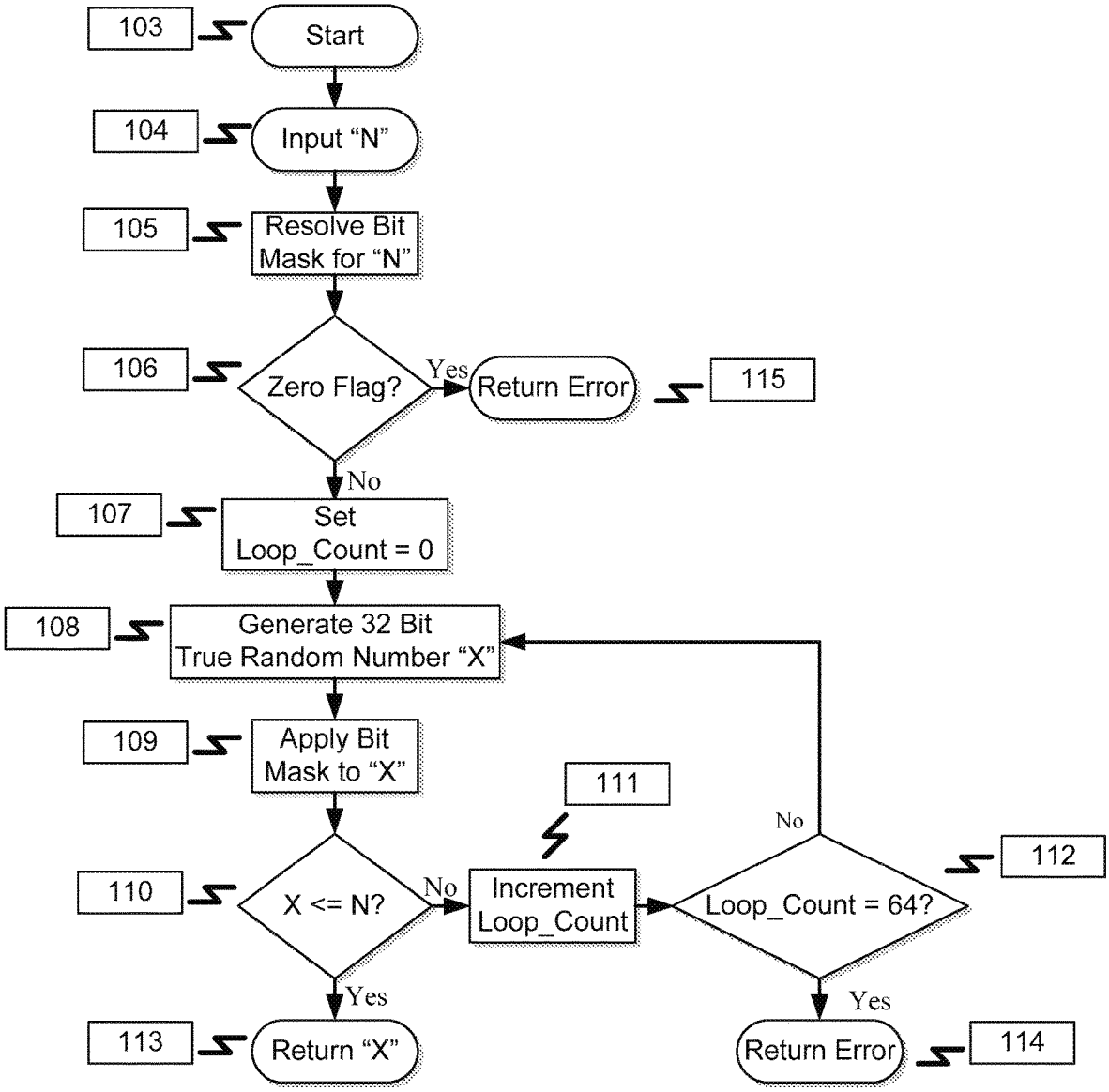
Figure #11

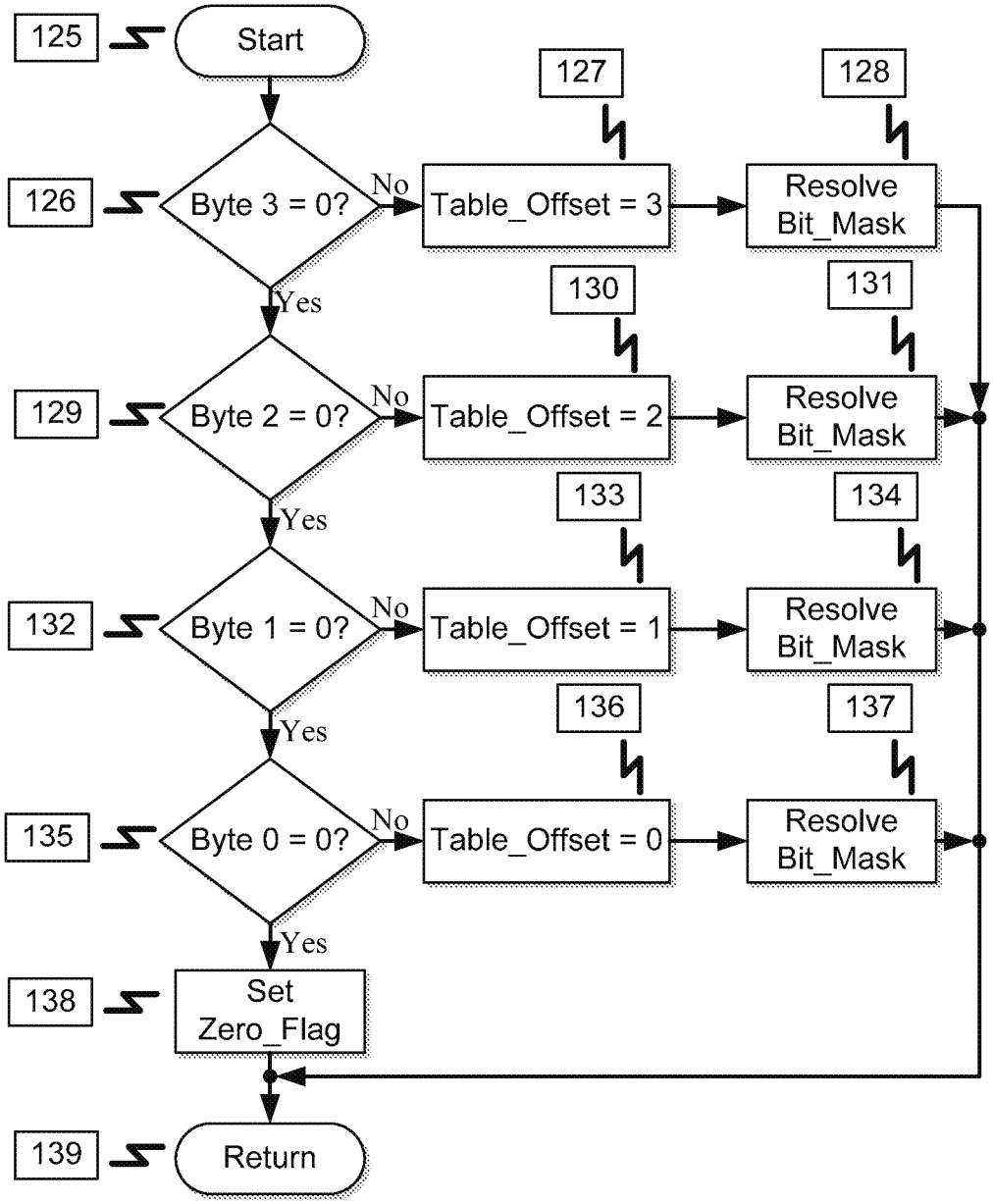
Figure #12

Lottery Department
Dog Days of Summer Scratch off Lottery Game 2136

1. Name of the game:
   The name of the game is Dog Days of Summer. The game number is DS-2136.

2. Price of the ticket:
   The price of a Dog Days of Summer instant lottery game ticket is $20.00.

3. Play symbols:
   Each Dog Days of Summer instant lottery game ticket will contain one play area featuring a "WINNING NUMBERS" area and a "YOUR NUMBERS" area. The play symbols and their captions located in the "WINNING NUMBERS" area are: 1 (ONE), 2 (TWO), 3 (THREE), 4 (FOUR), 5 (FIVE), 6 (SIX), 7 (SEVEN), 8 (EIGHT), 9 (NINE), 11 (ELEVN), 12 (TWLV), 13 (THRTN), 14 (FORTN), 15 (FIFTN), 16 (SIXTN), 17 (SVNTN), 18 (EGHTN), 19 (NINTN), 20 (TWENT), 21 (TWYONE), 22 (TWYTWO), 23 (TWYTHR), 24 (TWYFOR), 25 (TWYFIV), 26 (TWYSIX), 27 (TWYSVN), 28 (TWYEGT), 29 (TWYNIN), 30 (THIRTY), 31 (THYONE), 32 (THYTWO), 33 (THYTHR), 34 (THYFOR), 35 (THYFIV), 36 (THYSIX), 37 (THYSVN), 38 (THYEGT), 39 (THYNIN), and 40 (FORTY). The play symbols and their captions located in the "YOUR NUMBERS" area are: 1 (ONE), 2 (TWO), 3 (THREE), 4 (FOUR), 5 (FIVE), 6 (SIX), 7 (SEVEN), 8 (EIGHT), 9 (NINE), 11 (ELEVN), 12 (TWLV), 13 (THRTN), 14 (FORTN), 15 (FIFTN), 16 (SIXTN), 17 (SVNTN), 18 (EGHTN), 19 (NINTN), 20 (TWENT), 21 (TWYONE), 22 (TWYTWO), 23 (TWYTHR), 24 (TWYFOR), 25 (TWYFIV), 26 (TWYSIX), 27 (TWYSVN), 28 (TWYEGT), 29 (TWYNIN), 30 (THIRTY), 31 (THYONE), 32 (THYTWO), 33 (THYTHR), 34 (THYFOR), 35 (THYFIV), 36 (THYSIX), 37 (THYSVN), 38 (THYEGT), 39 (THYNIN), and 40 (FORTY).

4. Prize symbols:
   The prize symbols and their captions located in the "YOUR NUMBERS" area are: $20.00 (TWENTY), $40.00 (FORTY), $50.00 (FIFTY), $100 (ONE HUN), $200 (TWO HUN), $500 (FIV HUN), $1,000 (ONE THO), $10,000 (TEN THO), $100,000 (ONEHUNTHO) and $1MILL (ONE MIL).

5. Prizes:
   The prizes that can be won in this game are: $20, $40, $50, $100, $200, $500, $1,000, $10,000, $100,000 and $1,000,000.

6. Approximate number of tickets printed for the game:
   Approximately 5,400,000 tickets will be printed for the Dog Days of Summer instant game.

7. Determination of prize winners:
   (a) Holders of tickets upon which any one of the "YOUR NUMBERS" play symbols matches any of the "WINNING NUMBERS" play symbols, and a prize symbol of $1MILL (ONE MIL) appears in the "prize" area under the matching "YOUR NUMBERS" play symbol, on a single ticket, shall be entitled to a prize of $1,000,000. This prize shall be paid as a one-time, lump-sum cash payment.

Figure #13(a)

(b) Holders of tickets upon which any one of the "YOUR NUMBERS" play symbols matches any of the "WINNING NUMBERS" play symbols, and a prize symbol of $100,000 (ONEHUNTHO) appears in the "prize" area under the matching "YOUR NUMBERS" play symbol, on a single ticket, shall be entitled to a prize of $100,000.

(c) Holders of tickets upon which any one of the "YOUR NUMBERS" play symbols matches any of the "WINNING NUMBERS" play symbols, and a prize symbol of $10,000 (TEN THO) appears in the "prize" area under the matching "YOUR NUMBERS" play symbol, on a single ticket, shall be entitled to a prize of $10,000.

(d) Holders of tickets upon which any one of the "YOUR NUMBERS" play symbols matches any of the "WINNING NUMBERS" play symbols, and a prize symbol of $1,000 (ONE THO) appears in the "prize" area under the matching "YOUR NUMBERS" play symbol, on a single ticket, shall be entitled to a prize of $1,000.

(e) Holders of tickets upon which any one of the "YOUR NUMBERS" play symbols matches any of the "WINNING NUMBERS" play symbols, and a prize symbol of $500 (FIV HUN) appears in the "prize" area under the matching "YOUR NUMBERS" play symbol, on a single ticket, shall be entitled to a prize of $500.

(f) Holders of tickets upon which any one of the "YOUR NUMBERS" play symbols matches any of the "WINNING NUMBERS" play symbols, and a prize symbol of $200 (TWO HUN) appears in the "prize" area under the matching "YOUR NUMBERS" play symbol, on a single ticket, shall be entitled to a prize of $200.

(g) Holders of tickets upon which any one of the "YOUR NUMBERS" play symbols matches any of the "WINNING NUMBERS" play symbols, and a prize symbol of $100 (ONE HUN) appears in the "prize" area under the matching "YOUR NUMBERS" play symbol, on a single ticket, shall be entitled to a prize of $100.

(h) Holders of tickets upon which any one of the "YOUR NUMBERS" play symbols matches any of the "WINNING NUMBERS" play symbols, and a prize symbol of $50.00 (FIFTY) appears in the "prize" area under the matching "YOUR NUMBERS" play symbol, on a single ticket, shall be entitled to a prize of $50.

(i) Holders of tickets upon which any one of the "YOUR NUMBERS" play symbols matches any of the "WINNING NUMBERS" play symbols, and a prize symbol of $40.00 (FORTY) appears in the "prize" area under the matching "YOUR NUMBERS" play symbol, on a single ticket, shall be entitled to a prize of $40.

(j) Holders of tickets upon which any one of the "YOUR NUMBERS" play symbols matches any of the "WINNING NUMBERS" play symbols, and a prize symbol of $20.00 (TWENTY) appears in the "prize" area under the matching "YOUR NUMBERS" play symbol, on a single ticket, shall be entitled to a prize of $20.

Figure #13(b)

1. Number and description of prizes and approximate odds:

| When Any Of Your Numbers Match Any Winning Number, Win Prize Shown Under The Matching Number. Win With: | Win: | Approximate Odds Are 1 In: | Approximate No. Of Winners Per 5,400,000 Tickets |
|---|---|---|---|
| $20 | $20 | 7.5 | 720,000 |
| $40 | $40 | 30 | 180,000 |
| $50 | $50 | 15 | 360,000 |
| $100 | $100 | 25 | 216,000 |
| $200 | $200 | 196 | 27,450 |
| $500 | $500 | 666 | 8,100 |
| $1,000 | $1,000 | 1,256 | 4,300 |
| $10,000 | $10,000 | 108,000 | 50 |
| $100,000 | $100,000 | 1,080,000 | 5 |
| $1,000,000 | $1,000,000 | 1,080,000 | 5 |

Prizes, including top prizes, are subject to availability at the time of purchase.

2. Conditional Secondary Game:
   (a) Eligibility for Conditional Secondary Game:
      (a) SAME AS 7b
      (b) SAME AS 7c
      (c) SAME AS 7d
   (b) Participation in Secondary Game:
      (a) Ticket holders will contact their local lottery office to schedule appointment for participation in Secondary Game.
      (b) During pre-scheduled visit, the ticket holder shall present ticket for validation. Upon successful validation, the ticket holder will be given one (1) chance to play the Conditional Secondary Game.
      (c) Participation in the Conditional Secondary Game does not forfeit original winning amount shown on the ticket.
   (c) Maximum Conditional Secondary Game winners shall be set at 10.
   (d) Conditional Secondary Game description of prizes and approximate odds:

| Original Winning Amount | Possible Winning Amount | Approximate Odds are 1 in: |
|---|---|---|
| $100,000 | $1,000,000 | 15 |
| $10,000 | $1,000,000 | 150 |
| $1,000 | $1,000,000 | 625 |

Figure #13(c)

1. Retailer incentive awards:
   The Lottery may conduct a separate Retailer Incentive Program for retailers who sell Dog Days of Summer instant lottery game tickets.

2. Retailer bonus:
   The Lottery may offer a retailer bonus in connection with the sale of instant lottery game tickets. If a retailer bonus is offered, a Lottery retailer shall be eligible for a bonus as described in this section. Lottery retailers who sell a winning ticket that entitles the ticket holder to a prize, either payable in a single installment or having a guaranteed minimum payout, of at least $100,000 and not exceeding $500,000 shall be paid a bonus of $500. Lottery retailers who sell a winning ticket that entitles the ticket holder to a prize, either payable in a single installment or having a guaranteed minimum payout, of at least $500,001 and not exceeding $1,000,000 shall be paid a bonus of $5,000. A Lottery retailer is entitled only to the largest bonus for which they qualify for on a winning ticket. A bonus will be initiated for payment after the instant ticket is claimed and validated. A bonus will not be awarded to a Lottery retailer that sells a non-winning Lottery instant ticket used to enter a Lottery second-chance drawing or promotion that is subsequently selected to win a prize.

3. Unclaimed prize money:
   For a period of 1 year from the announced close of Dog Days of Summer, prize money from winning Dog Days of Summer instant lottery game tickets will be retained by the Secretary for payment to the persons entitled thereto. If no claim is made within 1 year of the announced close of the Dog Days of Summer instant lottery game, the right of a ticket holder to claim the prize represented by the ticket, if any, will expire and the prize money will be paid into the State Lottery Fund and used for purposes provided for by statute.

4. Governing law:
   In purchasing a ticket, the customer agrees to comply with and abide by the State Lottery Law and the provisions contained in this notice.

5. Termination of the game:
   The Lottery may announce a termination date, after which no further tickets from this game may be sold. The announcement will be disseminated through media used to advertise or promote Dog Days of Summer or through normal communications methods.

6. Ticket Redemption
   a. Prizes up to $2,500 may be claimed at an authorized Lottery retailer.
   b. Prizes over $2,500 must be submitted to the Lottery Office with a completed claim form.
   c. Prizes over $600 require winner to file a Claim Form.

Figure #13(d)

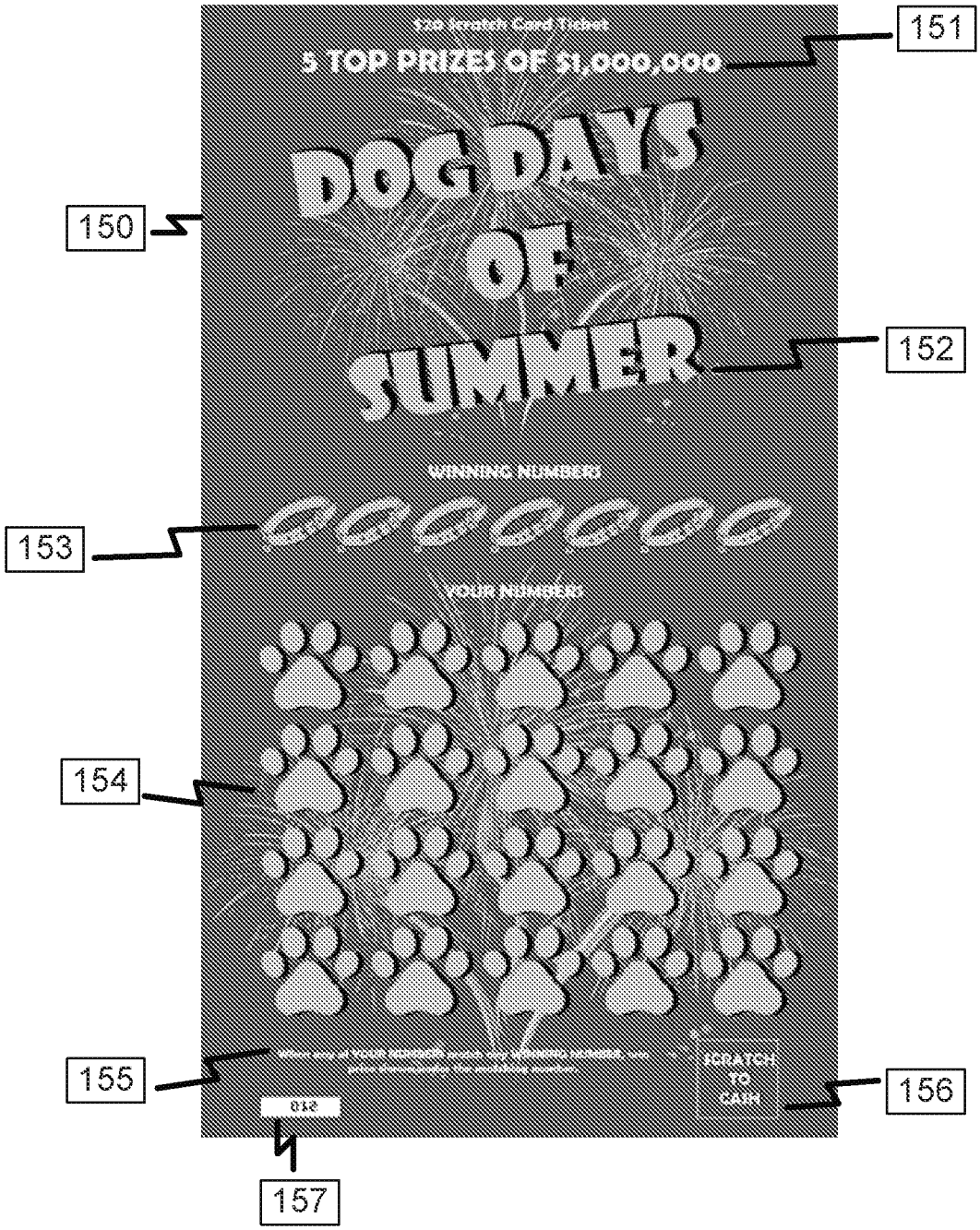
Figure #14

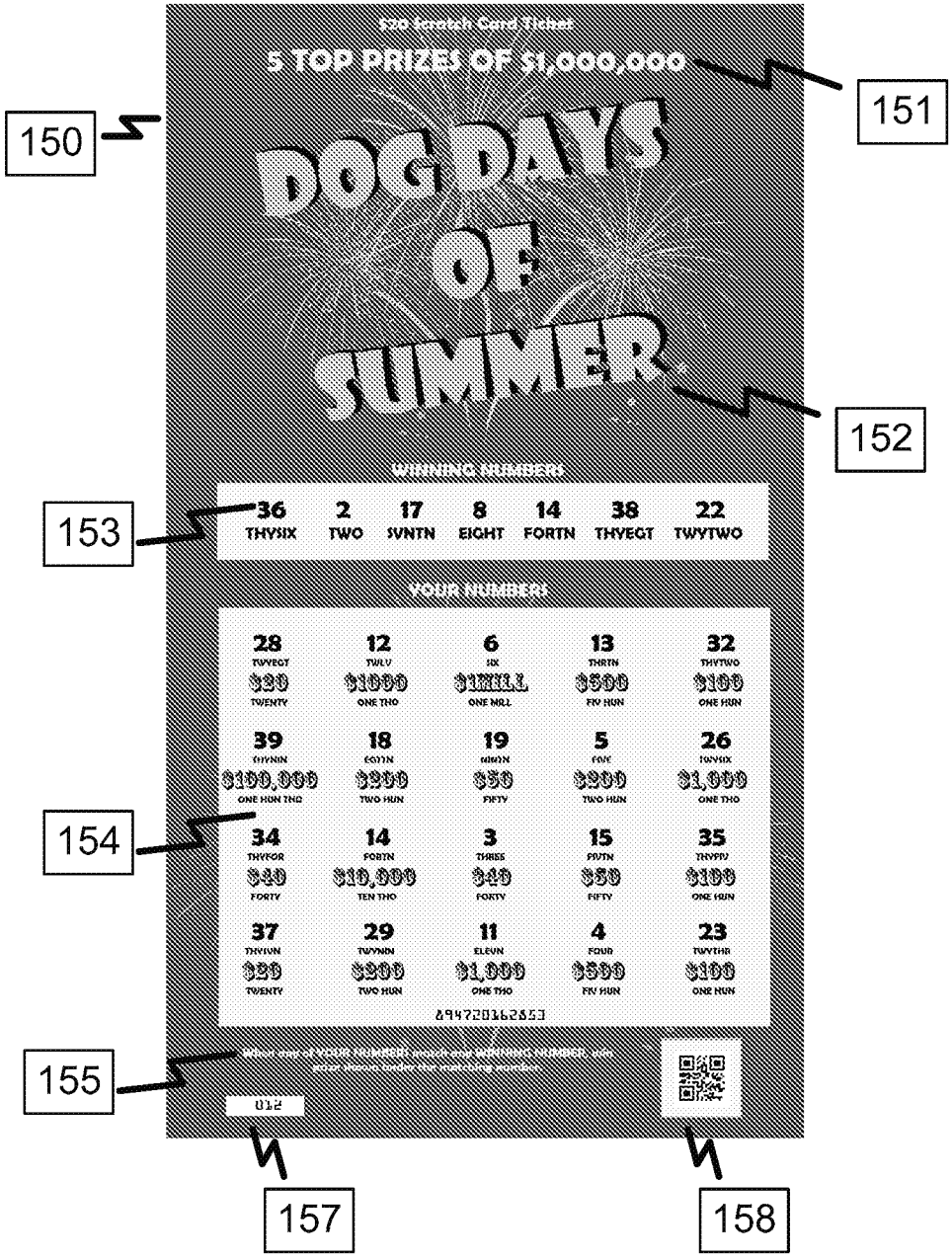
Figure #15

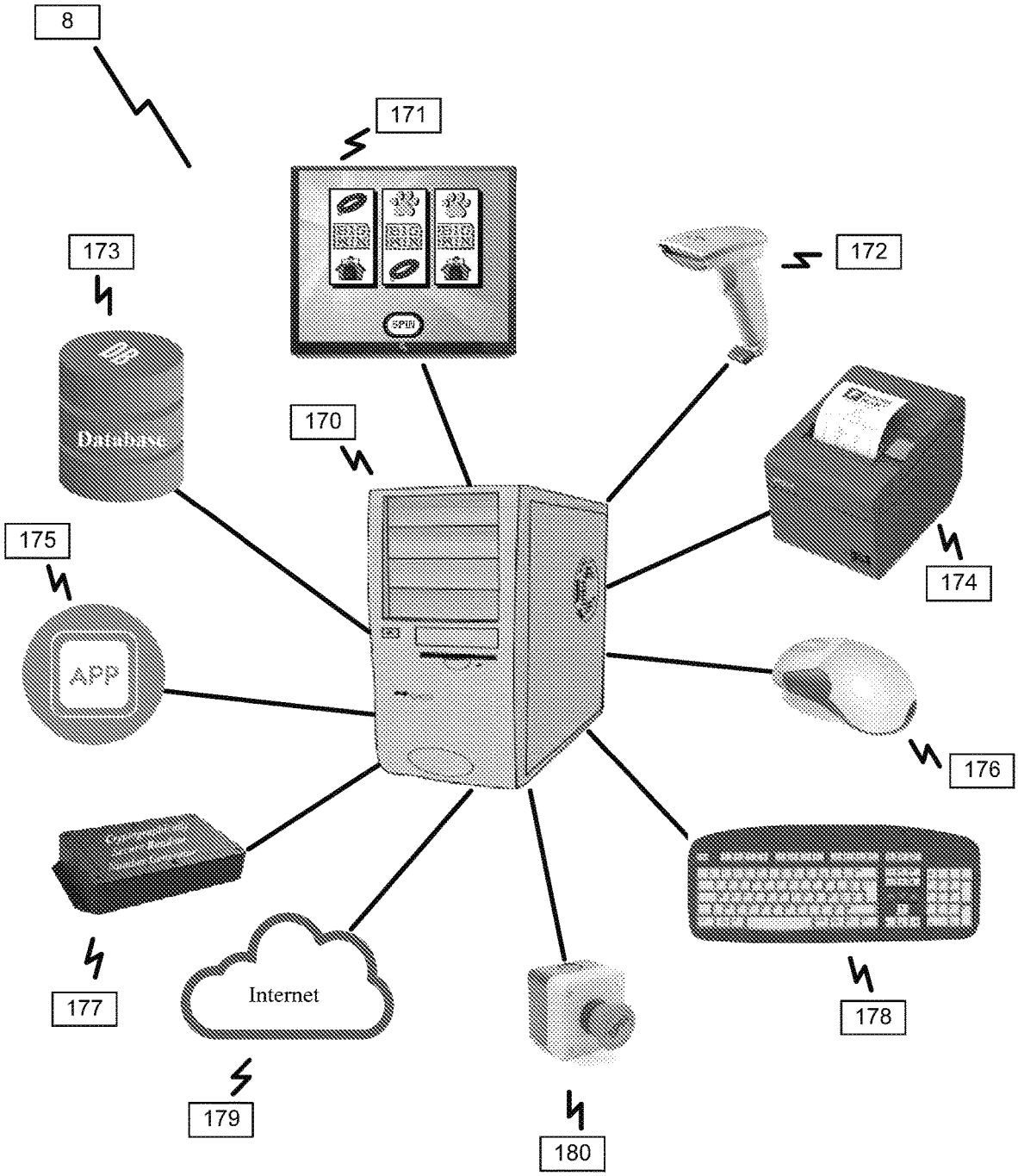
Figure #16

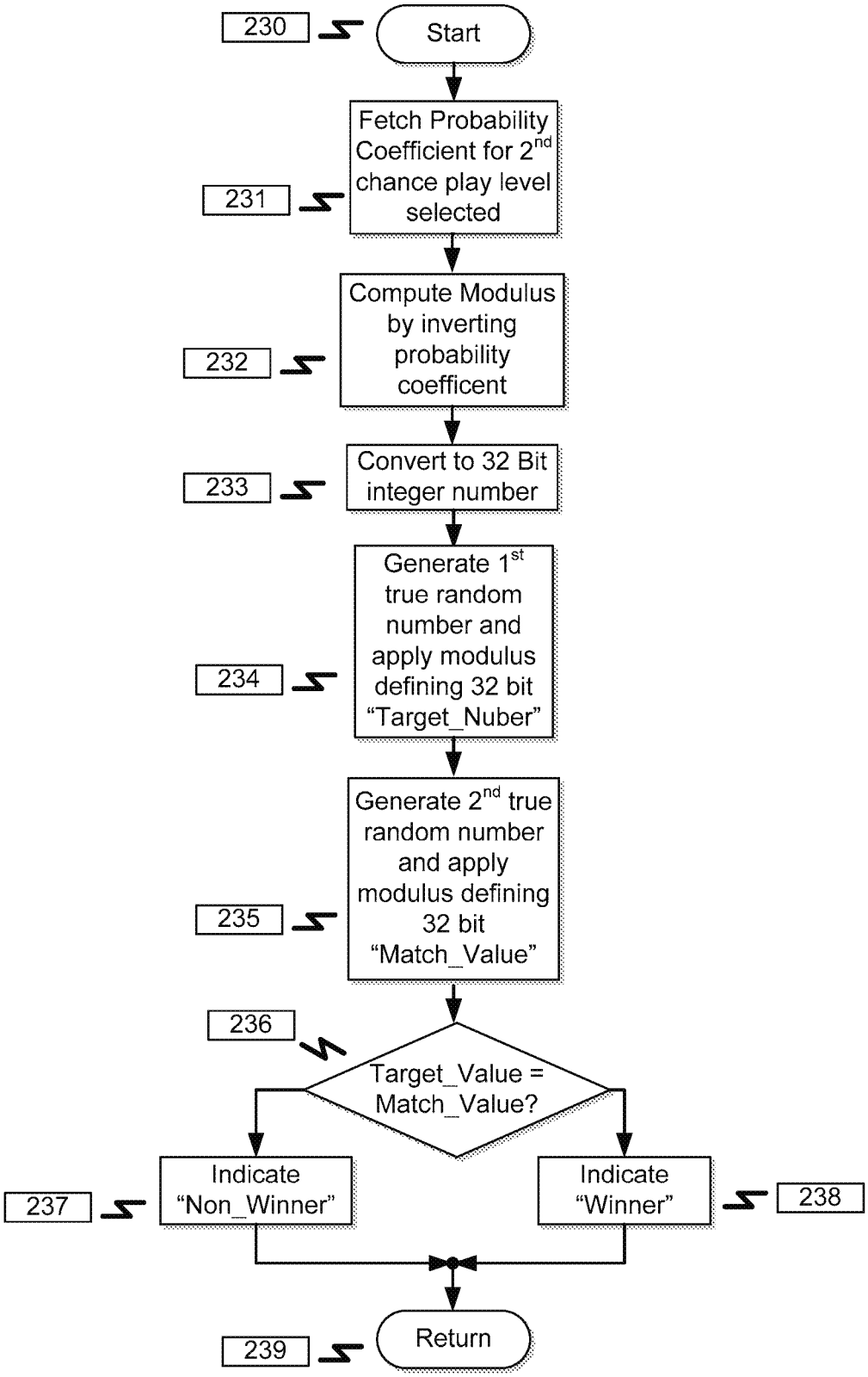
Figure #17

| Prize Level | Prize | Probability Coefficient |
|---|---|---|
| 1 | $ 100,000.00 | 0.0667 |
| 2 | $ 10,000.00 | 0.0067 |
| 3 | $ 1,000.00 | 0.0016 |
| 4 | $ 500.00 | 0.0 |
| 5 | $ 200.00 | 0.0 |
| 6 | $ 100.00 | 0.0 |
| 7 | $ 50.00 | 0.0 |
| 8 | $ 40.00 | 0.0 |
| 9 | $ 20.00 | 0.0 |

Figure #18

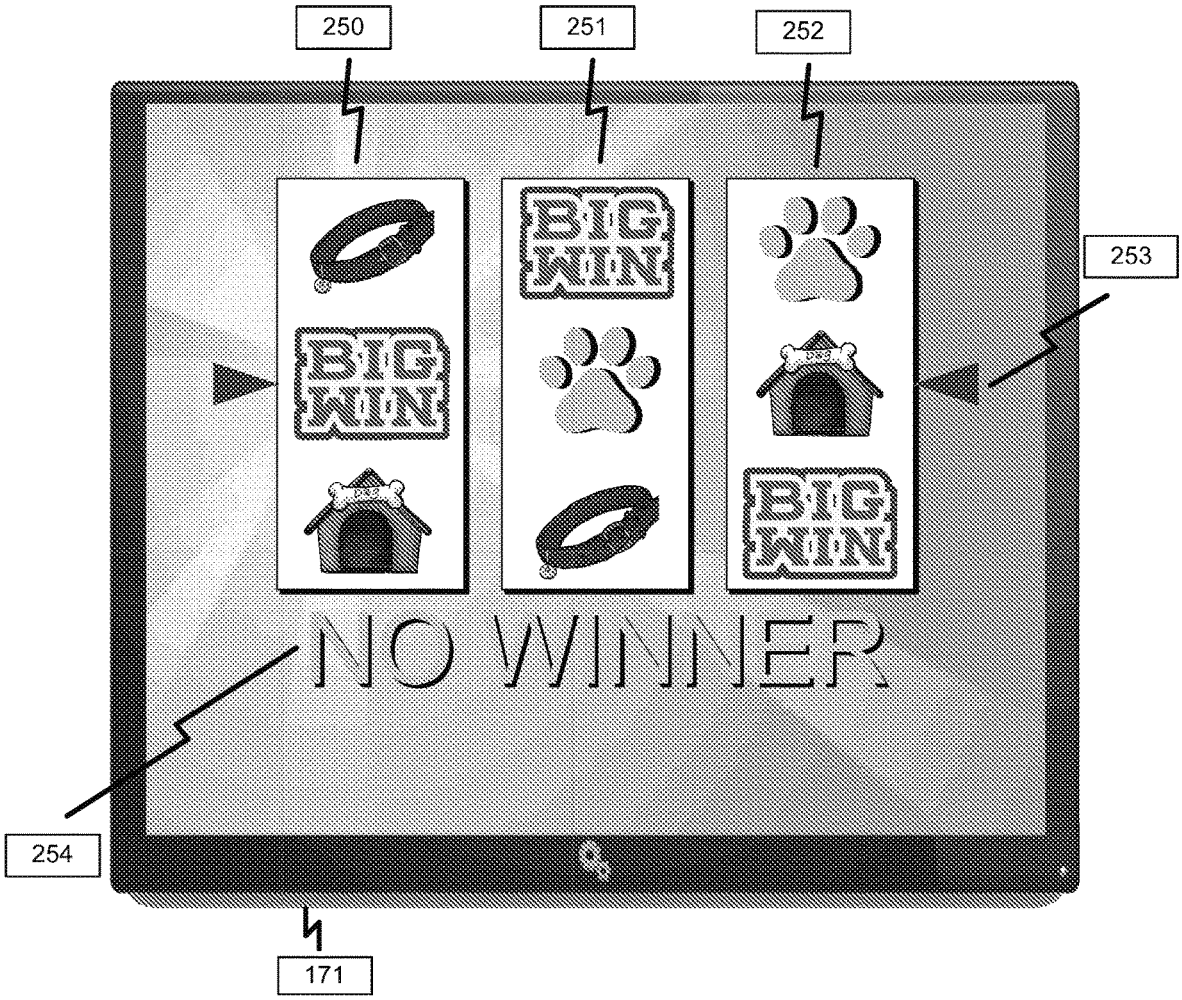
Figure #19

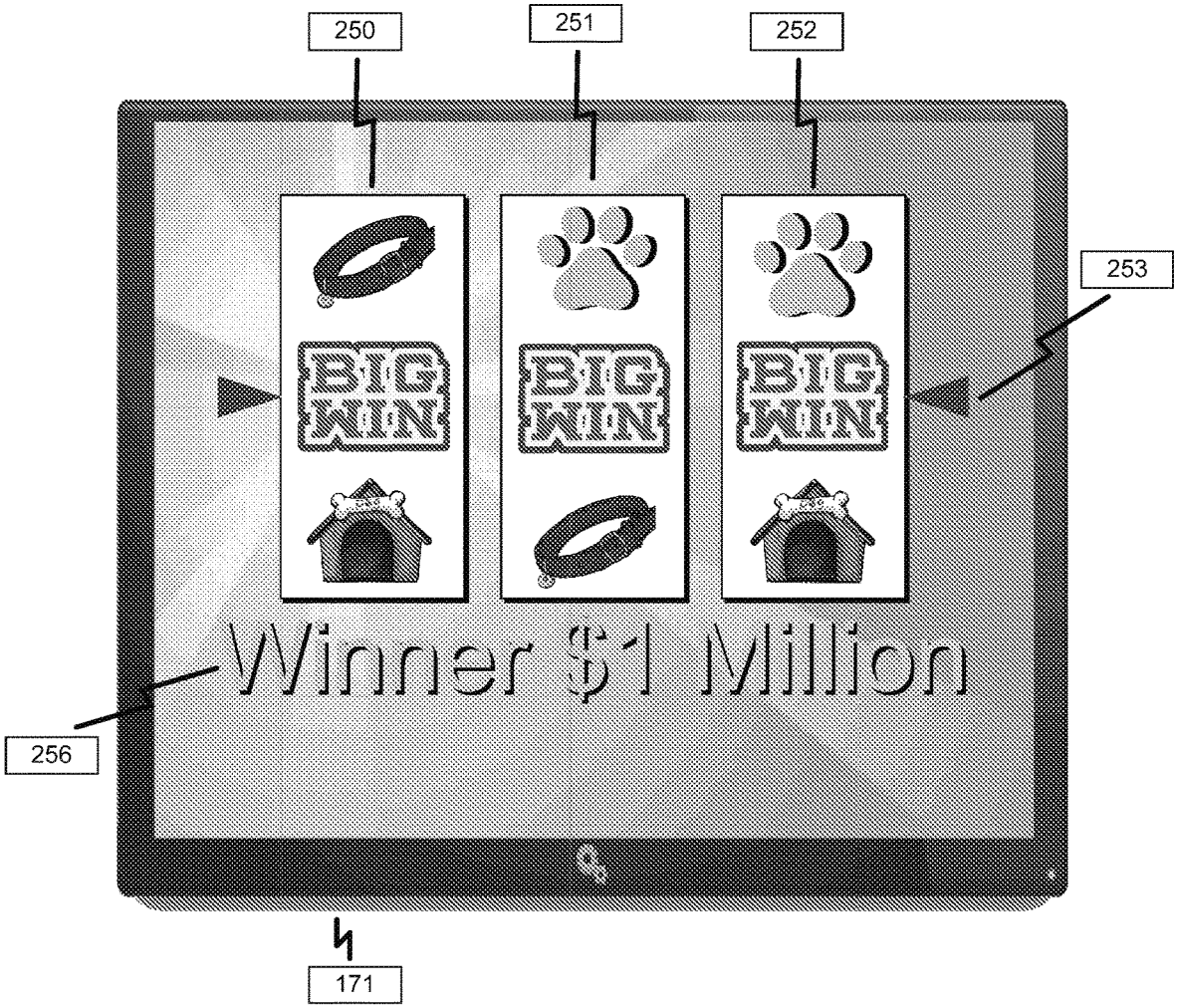
Figure #20

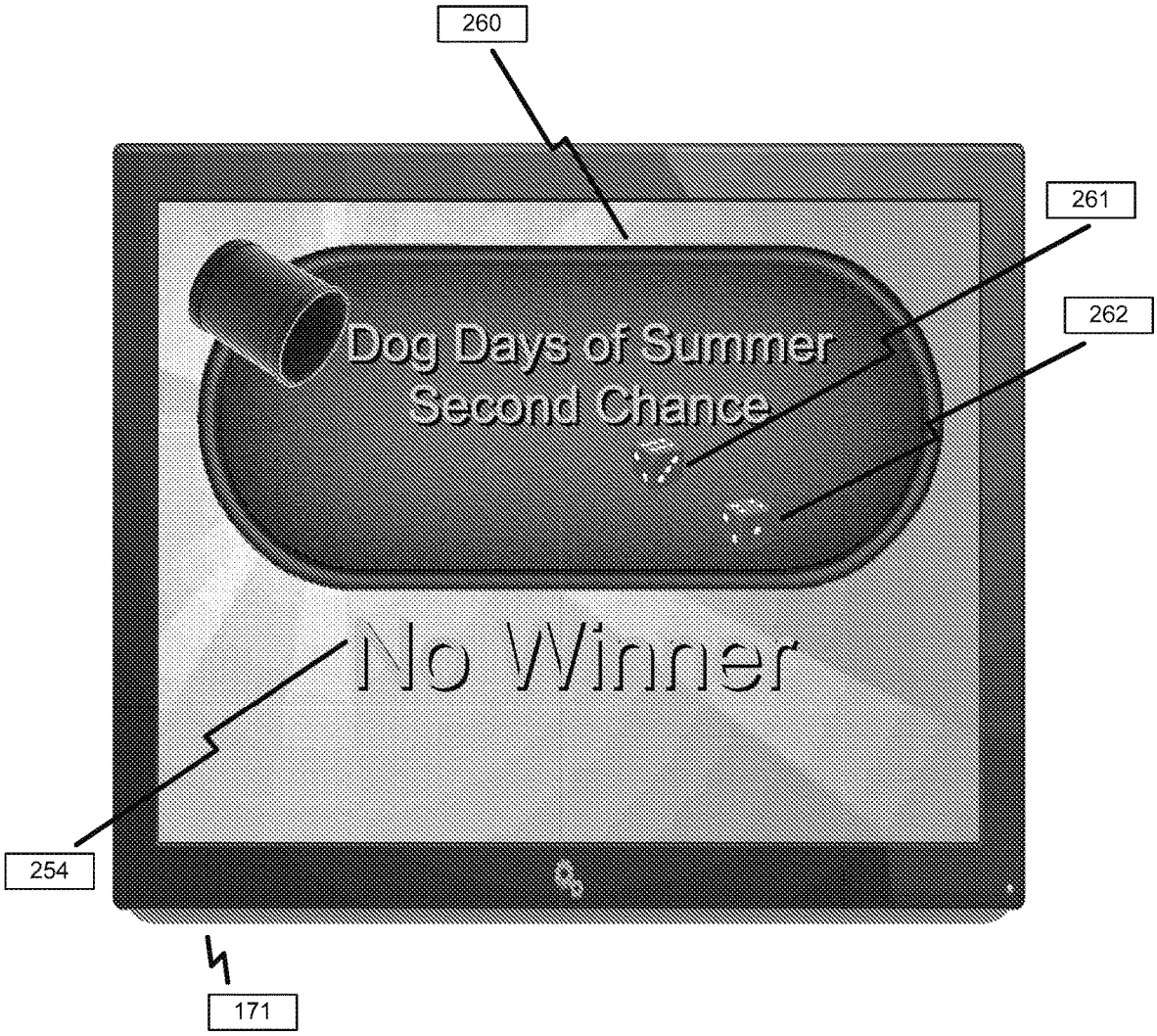
Figure #21

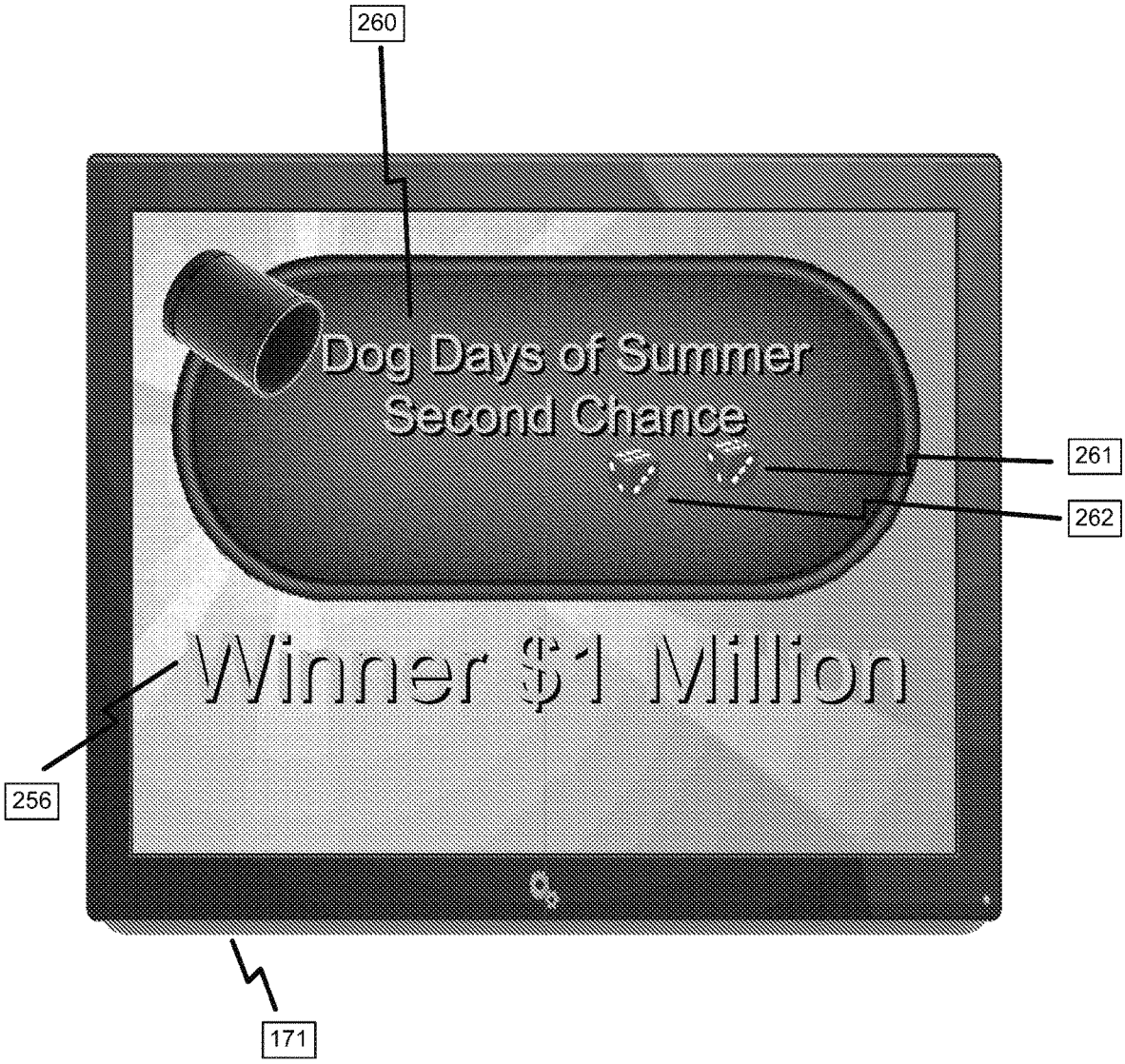
Figure #22

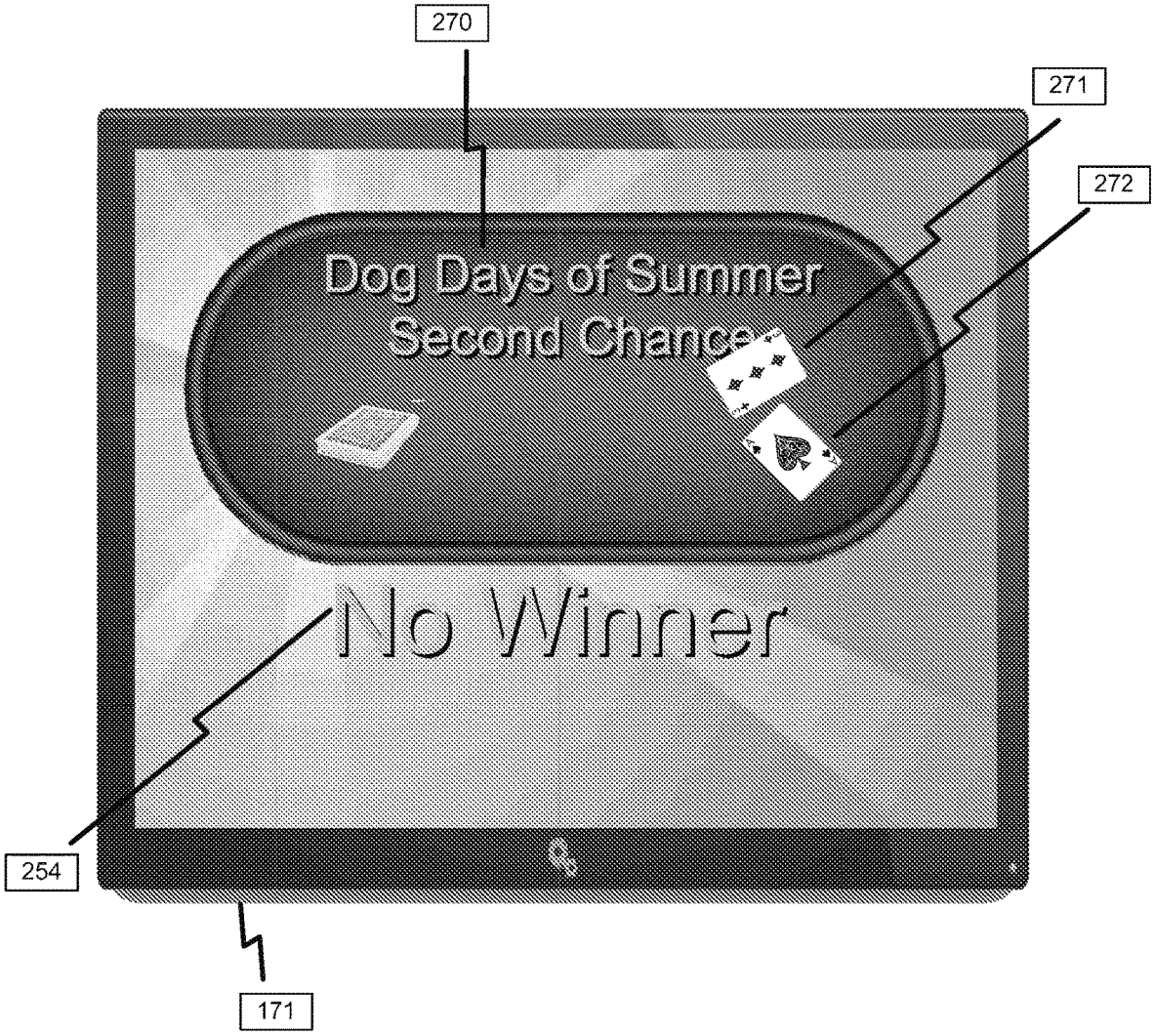
Figure #23

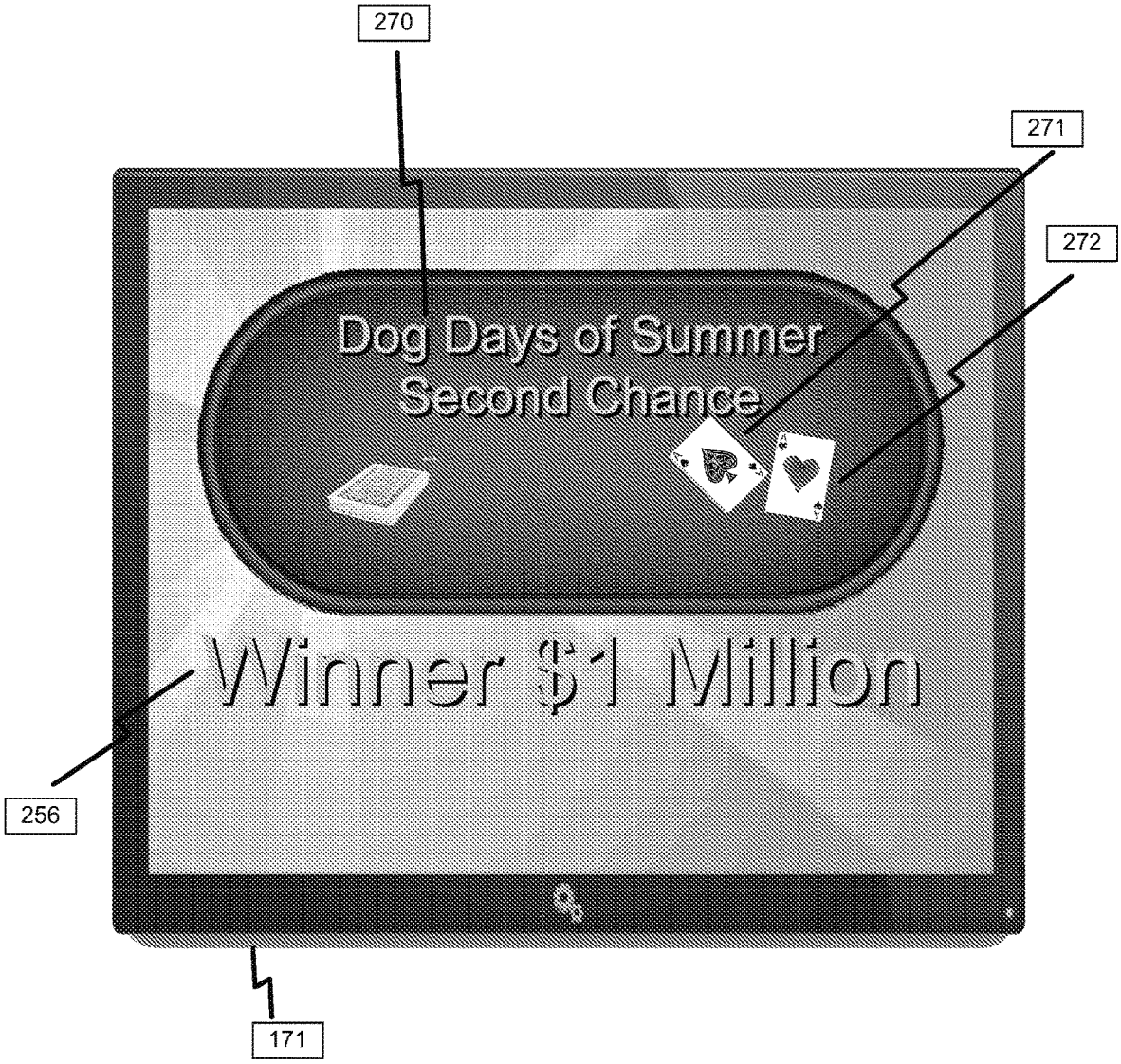
Figure #24

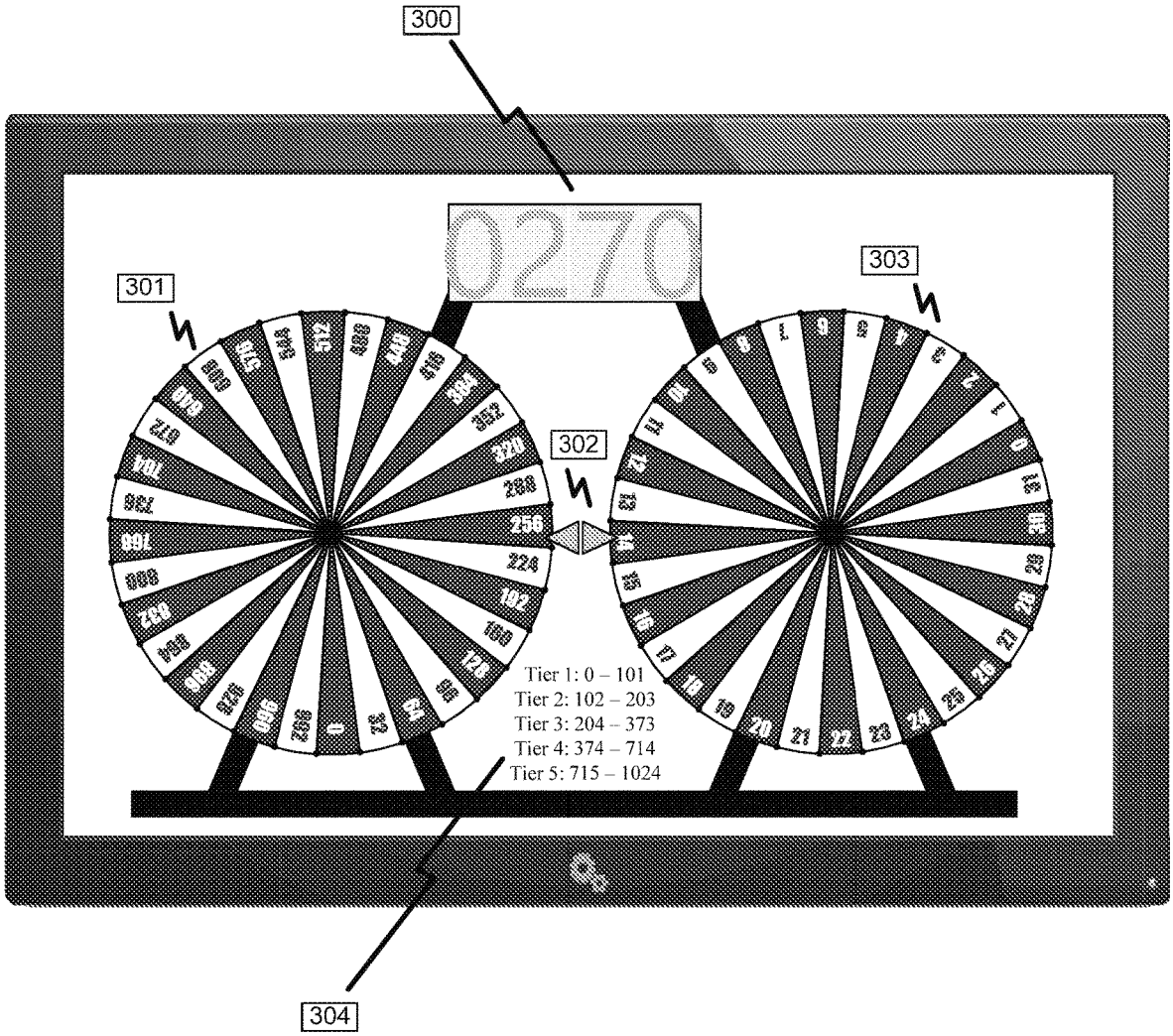
Figure #25

| Prize Tier | Prize | Probability Coefficient |
|---|---|---|
| 1 | $ 1,000,000.00 | 0.1000 |
| 2 | $ 100,000.00 | 0.1000 |
| 3 | $ 25,000.00 | 0.1667 |
| 4 | $ 10,000.00 | 0.6667 |

Figure #26

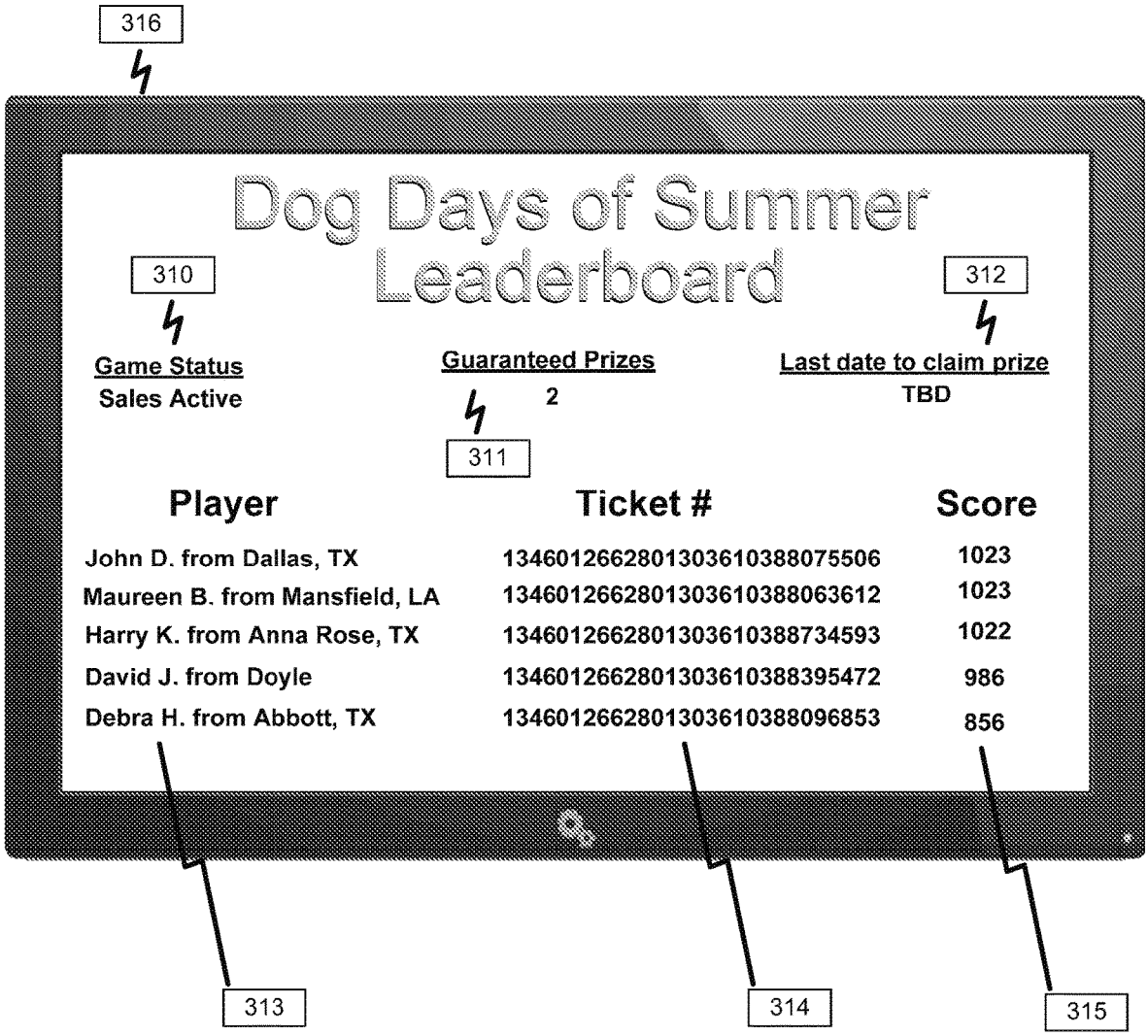
Figure #27

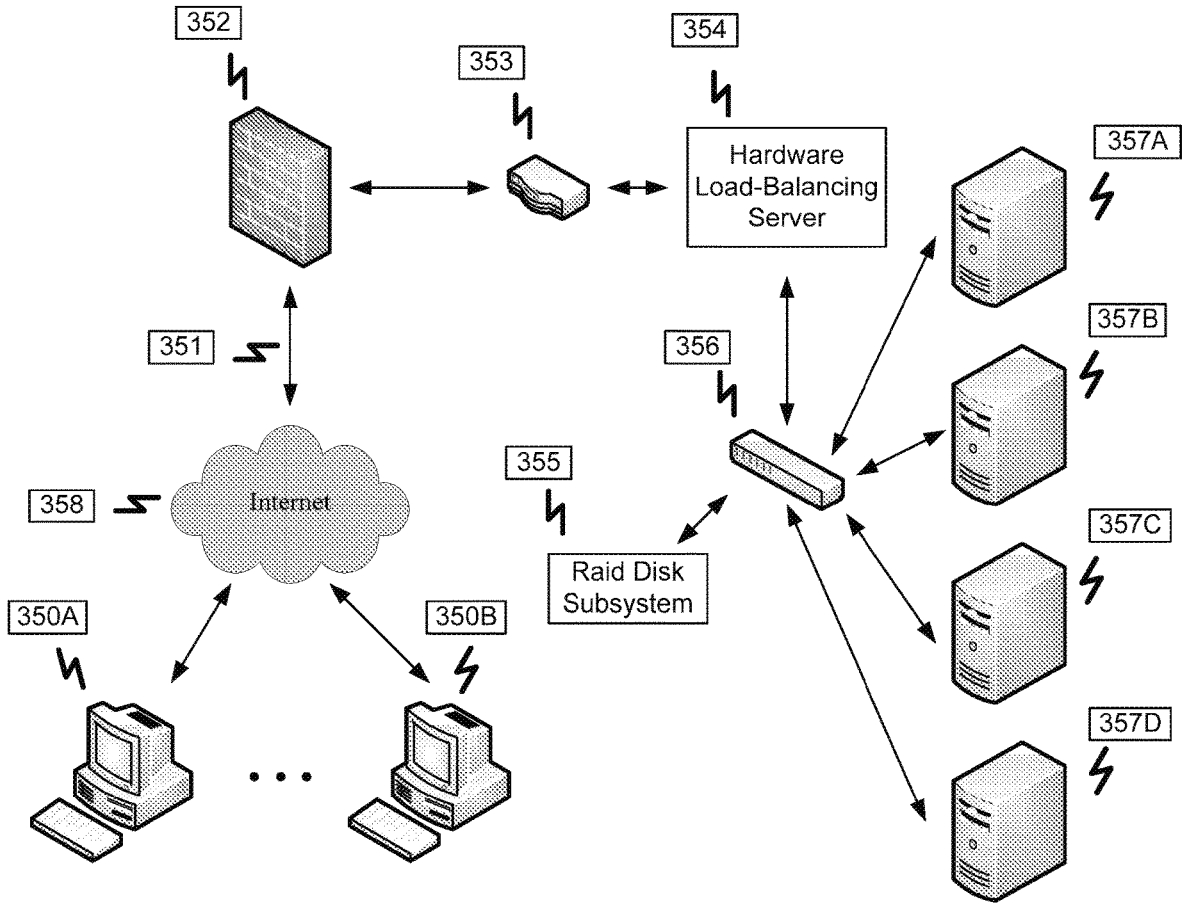
Figure #28

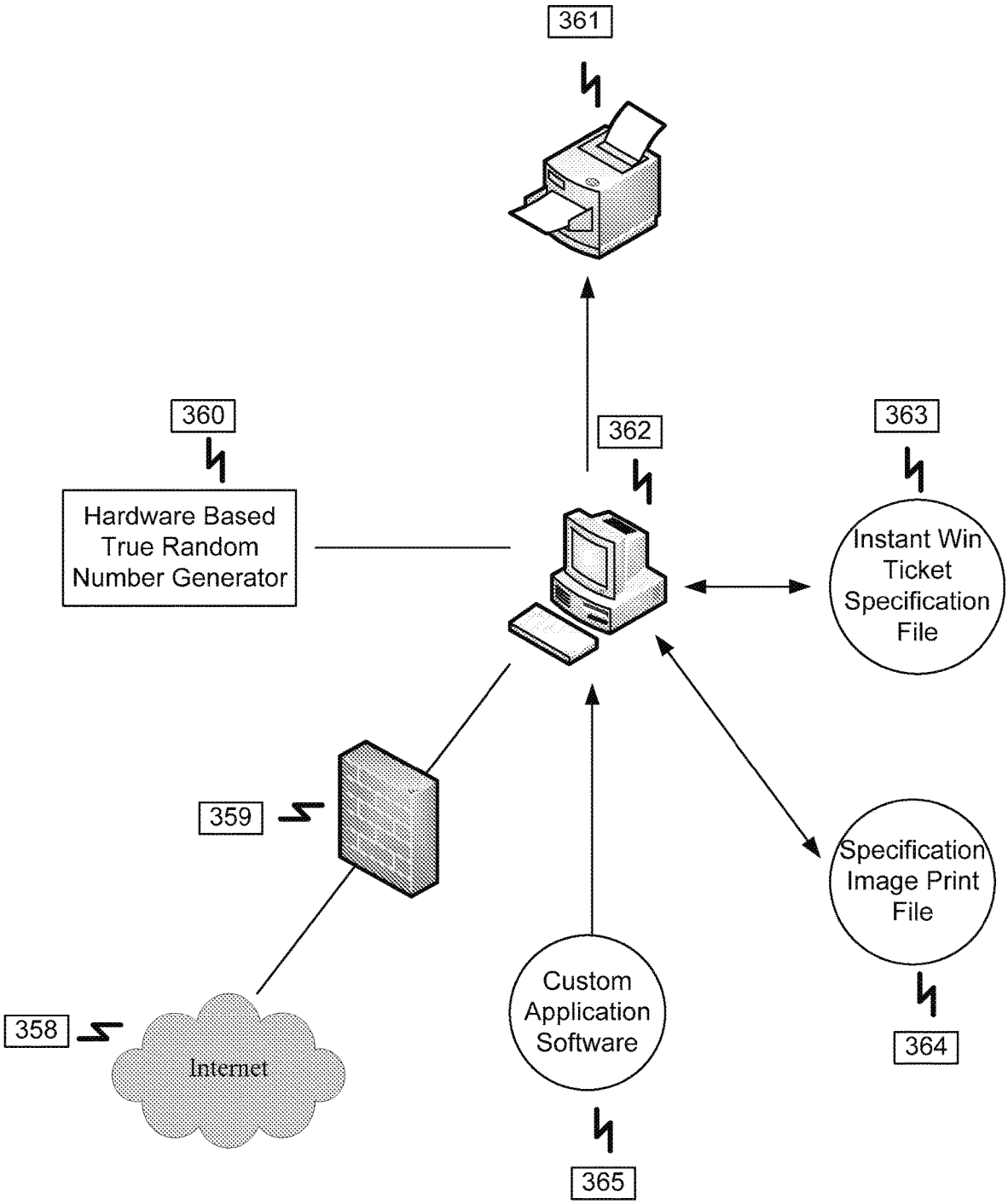
Figure #29

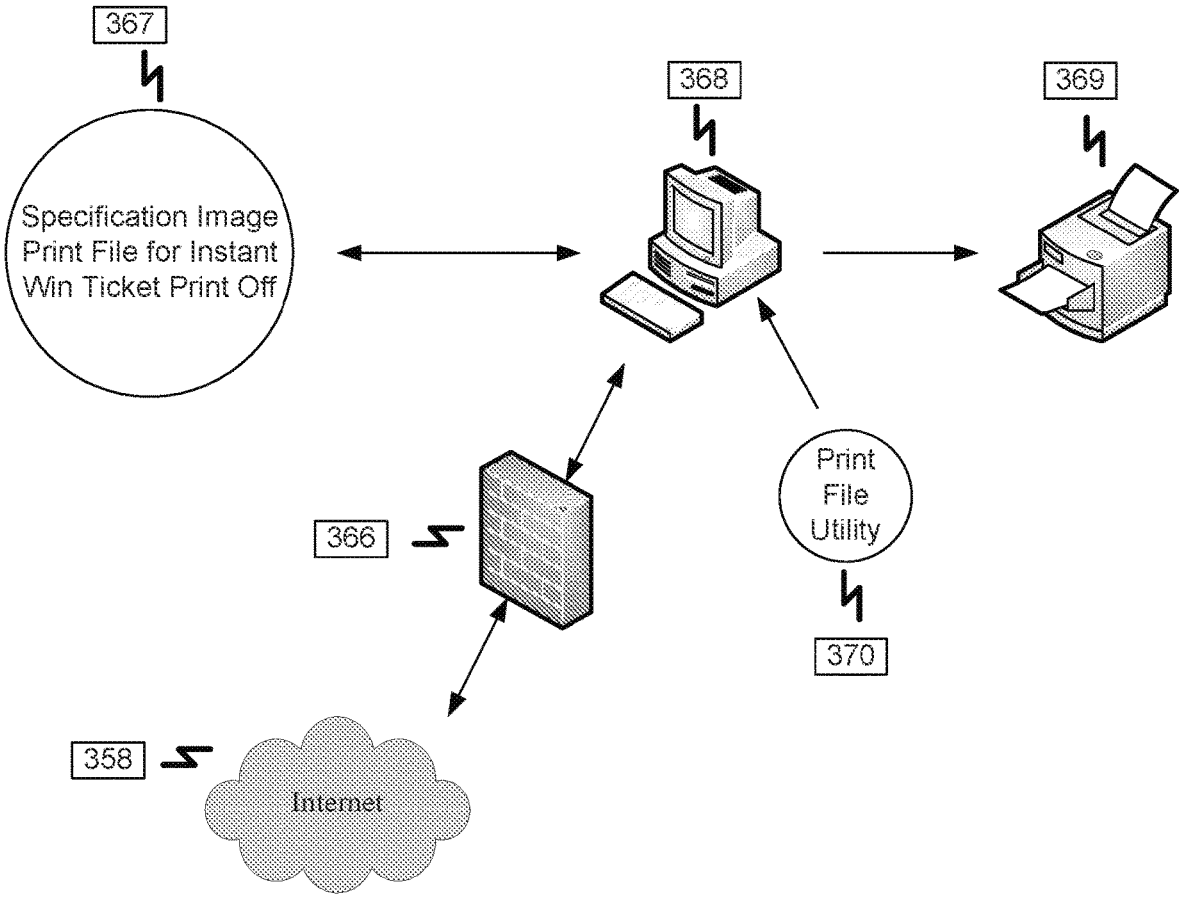
Figure #30

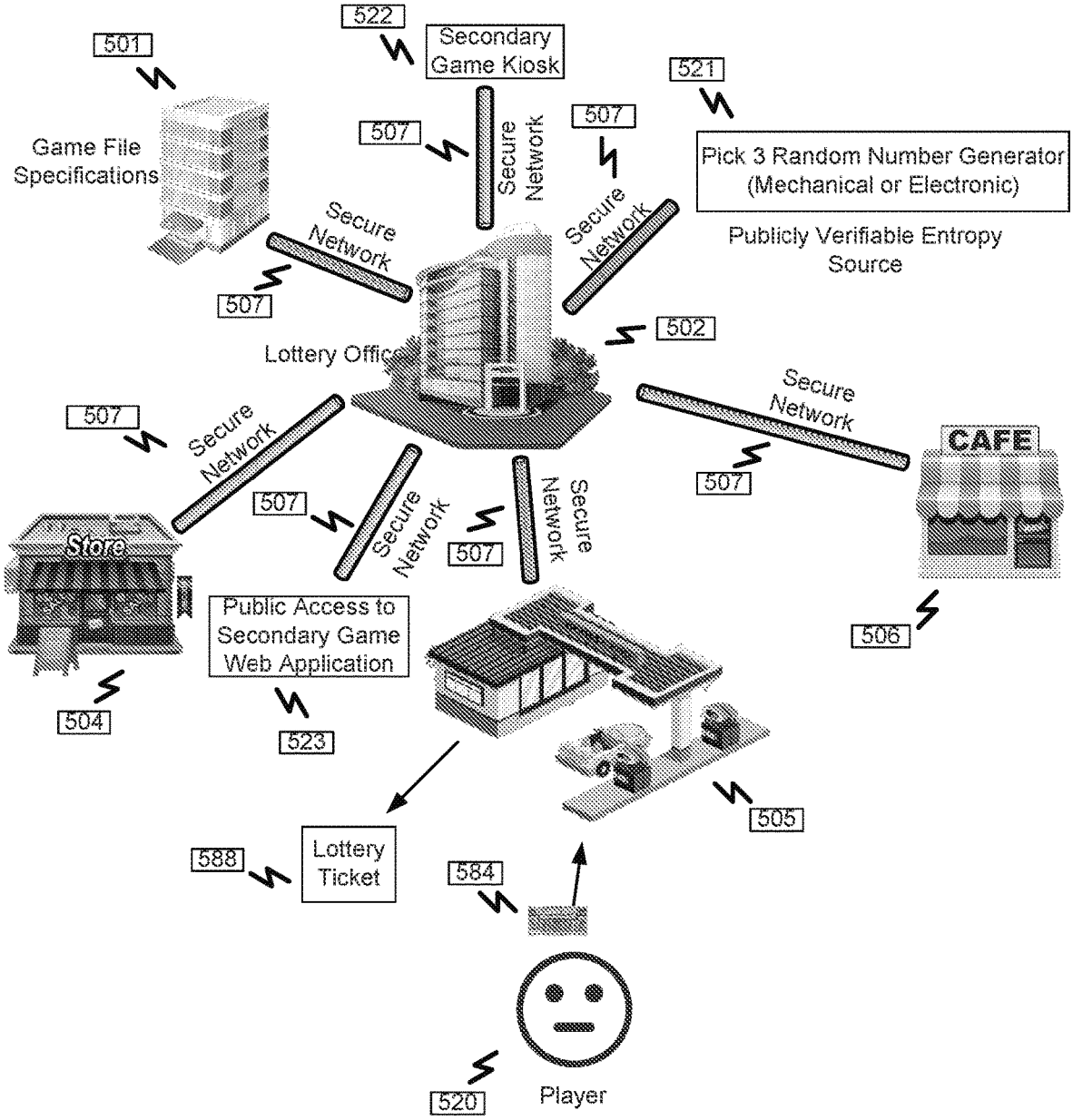
Figure #31

Lottery Department
Dog Days of Summer Scratch off Lottery Game 2136
(Modified for Publicly Verifiable Pick-3 Secondary Game)

1. Name of the game:
   The name of the game is Dog Days of Summer. The game number is DS-2136.

2. Price of the ticket:
   The price of a Dog Days of Summer instant lottery game ticket is $20.00.

3. Play symbols:
   Each Dog Days of Summer instant lottery game ticket will contain one play area featuring a "WINNING NUMBERS" area and a "YOUR NUMBERS" area. The play symbols and their captions located in the "WINNING NUMBERS" area are: 1 (ONE), 2 (TWO), 3 (THREE), 4 (FOUR), 5 (FIVE), 6 (SIX), 7 (SEVEN), 8 (EIGHT), 9 (NINE), 11 (ELEVN), 12 (TWLV), 13 (THRTN), 14 (FORTN), 15 (FIFTN), 16 (SIXTN), 17 (SVNTN), 18 (EGHTN), 19 (NINTN), 20 (TWENT), 21 (TWYONE), 22 (TWYTWO), 23 (TWYTHR), 24 (TWYFOR), 25 (TWYFIV), 26 (TWYSIX), 27 (TWYSVN), 28 (TWYEGT), 29 (TWYNIN), 30 (THIRTY), 31 (THYONE), 32 (THYTWO), 33 (THYTHR), 34 (THYFOR), 35 (THYFIV), 36 (THYSIX), 37 (THYSVN), 38 (THYEGT), 39 (THYNIN), and 40 (FORTY). The play symbols and their captions located in the "YOUR NUMBERS" area are: 1 (ONE), 2 (TWO), 3 (THREE), 4 (FOUR), 5 (FIVE), 6 (SIX), 7 (SEVEN), 8 (EIGHT), 9 (NINE), 11 (ELEVN), 12 (TWLV), 13 (THRTN), 14 (FORTN), 15 (FIFTN), 16 (SIXTN), 17 (SVNTN), 18 (EGHTN), 19 (NINTN), 20 (TWENT), 21 (TWYONE), 22 (TWYTWO), 23 (TWYTHR), 24 (TWYFOR), 25 (TWYFIV), 26 (TWYSIX), 27 (TWYSVN), 28 (TWYEGT), 29 (TWYNIN), 30 (THIRTY), 31 (THYONE), 32 (THYTWO), 33 (THYTHR), 34 (THYFOR), 35 (THYFIV), 36 (THYSIX), 37 (THYSVN), 38 (THYEGT), 39 (THYNIN), and 40 (FORTY).

4. Prize symbols:
   The prize symbols and their captions located in the "YOUR NUMBERS" area are: $20.00 (TWENTY), $40.00 (FORTY), $50.00 (FIFTY), $100 (ONE HUN), $200 (TWO HUN), $500 (FIV HUN), $1,000 (ONE THO), $10,000 (TEN THO), $100,000 (ONEHUNTHO) and $1MILL (ONE MIL).

5. Prizes:
   The prizes that can be won in this game are: $20, $40, $50, $100, $200, $500, $1,000, $10,000, $100,000 and $1,000,000.

6. Approximate number of tickets printed for the game:
   Approximately 5,400,000 tickets will be printed for the Dog Days of Summer instant game.

7. Determination of prize winners:
   (a) Holders of tickets upon which any one of the "YOUR NUMBERS" play symbols matches any of the "WINNING NUMBERS" play symbols, and a prize symbol of $1MILL (ONE MIL) appears in the "prize" area under the matching "YOUR NUMBERS" play symbol, on a single ticket, shall be entitled to a prize of $1,000,000. This prize shall be paid as a one-time, lump-sum cash payment.

Figure #32(a)

(b) Holders of tickets upon which any one of the "YOUR NUMBERS" play symbols matches any of the "WINNING NUMBERS" play symbols, and a prize symbol of $100,000 (ONEHUNTHO) appears in the "prize" area under the matching "YOUR NUMBERS" play symbol, on a single ticket, shall be entitled to a prize of $100,000.

(c) Holders of tickets upon which any one of the "YOUR NUMBERS" play symbols matches any of the "WINNING NUMBERS" play symbols, and a prize symbol of $10,000 (TEN THO) appears in the "prize" area under the matching "YOUR NUMBERS" play symbol, on a single ticket, shall be entitled to a prize of $10,000.

(d) Holders of tickets upon which any one of the "YOUR NUMBERS" play symbols matches any of the "WINNING NUMBERS" play symbols, and a prize symbol of $1,000 (ONE THO) appears in the "prize" area under the matching "YOUR NUMBERS" play symbol, on a single ticket, shall be entitled to a prize of $1,000.

(e) Holders of tickets upon which any one of the "YOUR NUMBERS" play symbols matches any of the "WINNING NUMBERS" play symbols, and a prize symbol of $500 (FIV HUN) appears in the "prize" area under the matching "YOUR NUMBERS" play symbol, on a single ticket, shall be entitled to a prize of $500.

(f) Holders of tickets upon which any one of the "YOUR NUMBERS" play symbols matches any of the "WINNING NUMBERS" play symbols, and a prize symbol of $200 (TWO HUN) appears in the "prize" area under the matching "YOUR NUMBERS" play symbol, on a single ticket, shall be entitled to a prize of $200.

(g) Holders of tickets upon which any one of the "YOUR NUMBERS" play symbols matches any of the "WINNING NUMBERS" play symbols, and a prize symbol of $100 (ONE HUN) appears in the "prize" area under the matching "YOUR NUMBERS" play symbol, on a single ticket, shall be entitled to a prize of $100.

(h) Holders of tickets upon which any one of the "YOUR NUMBERS" play symbols matches any of the "WINNING NUMBERS" play symbols, and a prize symbol of $50.00 (FIFTY) appears in the "prize" area under the matching "YOUR NUMBERS" play symbol, on a single ticket, shall be entitled to a prize of $50.

(i) Holders of tickets upon which any one of the "YOUR NUMBERS" play symbols matches any of the "WINNING NUMBERS" play symbols, and a prize symbol of $40.00 (FORTY) appears in the "prize" area under the matching "YOUR NUMBERS" play symbol, on a single ticket, shall be entitled to a prize of $40.

(j) Holders of tickets upon which any one of the "YOUR NUMBERS" play symbols matches any of the "WINNING NUMBERS" play symbols, and a prize symbol of $20.00 (TWENTY) appears in the "prize" area under the matching "YOUR NUMBERS" play symbol, on a single ticket, shall be entitled to a prize of $20.

Figure #32(b)

1. Number and description of prizes and approximate odds:

| When Any Of Your Numbers Match Any Winning Number, Win Prize Shown Under The Matching Number. Win With: | Win: | Approximate Odds Are 1 In: | Approximate No. Of Winners Per 5,400,000 Tickets |
|---|---|---|---|
| $20 | $20 | 7.5 | 720,000 |
| $40 | $40 | 30 | 180,000 |
| $50 | $50 | 15 | 360,000 |
| $100 | $100 | 25 | 216,000 |
| $200 | $200 | 196 | 27,450 |
| $500 | $500 | 666 | 8,100 |
| $1,000 | $1,000 | 1,256 | 4,300 |
| $10,000 | $10,000 | 108,000 | 50 |
| $100,000 | $100,000 | 1,080,000 | 5 |
| $1,000,000 | $1,000,000 | 1,080,000 | 5 |

Prizes, including top prizes, are subject to availability at the time of purchase.

2. Conditional Secondary Game
   (a) Eligibility for Conditional Secondary Game
      (a) SAME AS 7b
      (b) SAME AS 7c
      (c) SAME AS 7d
   (b) Participation in Secondary Game:
      (a) Ticket holders must obtain Pick-3 game ticket from authorized lottery retailor or local lottery office.
      (b) Ticket holders may visit the local lottery office with secondary game kiosk. Ticket holder will interact with game kiosk to enter personal contact information, scratch ticket and pick-3 ticket reference information and to select options defined in 9c to register for secondary game drawing. Ticket holder will receive a physical entry confirmation receipt.
      (c) Ticket holders may access the Lottery's website. The ticket holder will utilize website to personal contact information, scratch ticket and pick-3 ticket reference information and to select options defined in 9c to register for secondary game drawing. Ticket holder will receive an electronic entry confirmation receipt.
   (c) Conditional Secondary Game description of options:
      (a) Non-Parlay

Figure #32(c)

(1) Ticket holder may choose to participate in conditional secondary game on a non-parlay basis.
(2) Participation in the Conditional Secondary Game on a non-parlay basis, does not forfeit original winning amount in the case of a non-winning outcome of the Secondary Game.
(3) Pick-3 ticket obtained and entry confirmation receipt will be valid only for the next lottery drawing.
(4) Winning combinations and multipliers are as defined in 9e (b) Parlay
(1) Ticket holder may choose to participate in conditional secondary game on a parlay basis.
(2) Participation in the Conditional Secondary Game on a parlay basis, does forfeit original winning amount in the case of a non-winning outcome of the Secondary Game.
(3) Pick-3 ticket obtained and entry confirmation receipt will be valid only for the next lottery drawing.
(4) Winning combinations and multipliers are as defined in 9e
(5) The Mega Prize limit shall be set at $50 Million.

(d) Conditional Secondary Game description of winning scenarios
(a) Box: The numbers in the 3 digit sequence match the winning numbers drawn in any order.
(b) Straight: The numbers in the 3 digit sequence match the winning numbers drawn in exact order.

(e) Winning Combinations and multipliers:

| Game Type Selected | Winning Type | Winning Multiplier |
|---|---|---|
| Non-Parlay | Box | 1.5 times original winning amount |
| Non-Parlay | Straight | 5 times original winning amount |
| Parlay | Box | 7.5 times current winning amount |
| Parlay | Straight | 10 times current winning amount |

1. Retailer incentive awards:
The Lottery may conduct a separate Retailer Incentive Program for retailers who sell Dog Days of Summer instant lottery game tickets.

2. Retailer bonus:
The Lottery may offer a retailer bonus in connection with the sale of instant lottery game tickets. If a retailer bonus is offered, a Lottery retailer shall be eligible for a bonus as described in this section. Lottery retailers who sell a winning ticket that entitles the ticket holder to a prize, either payable in a single installment or having a guaranteed minimum payout, of at least $100,000 and not exceeding $500,000 shall be paid a bonus of $500. Lottery retailers who sell a winning ticket that entitles the ticket holder to a prize, either payable in a single installment or having a

Figure #32(d)

guaranteed minimum payout, of at least $500,001 and not exceeding $1,000,000 shall be paid a bonus of $5,000. A Lottery retailer is entitled only to the largest bonus for which they qualify for on a winning ticket. A bonus will be initiated for payment after the instant ticket is claimed and validated. A bonus will not be awarded to a Lottery retailer that sells a non-winning Lottery instant ticket used to enter a Lottery second-chance drawing or promotion that is subsequently selected to win a prize.

1. Unclaimed prize money:
   For a period of 1 year from the announced close of Dog Days of Summer, prize money from winning Dog Days of Summer instant lottery game tickets will be retained by the Secretary for payment to the persons entitled thereto. If no claim is made within 1 year of the announced close of the Dog Days of Summer instant lottery game, the right of a ticket holder to claim the prize represented by the ticket, if any, will expire and the prize money will be paid into the State Lottery Fund and used for purposes provided for by statute.

2. Governing law:
   In purchasing a ticket, the customer agrees to comply with and abide by the State Lottery Law and the provisions contained in this notice.

3. Termination of the game:
   The Lottery may announce a termination date, after which no further tickets from this game may be sold. The announcement will be disseminated through media used to advertise or promote Dog Days of Summer or through normal communications methods.

4. Ticket Redemption
   a. Prizes up to $2,500 may be claimed at an authorized Lottery retailer.
   b. Prizes over $2,500 must be submitted to the Lottery Office with a completed claim form.
   c. Prizes over $600 require winner to file a Claim Form.

Figure #32(e)

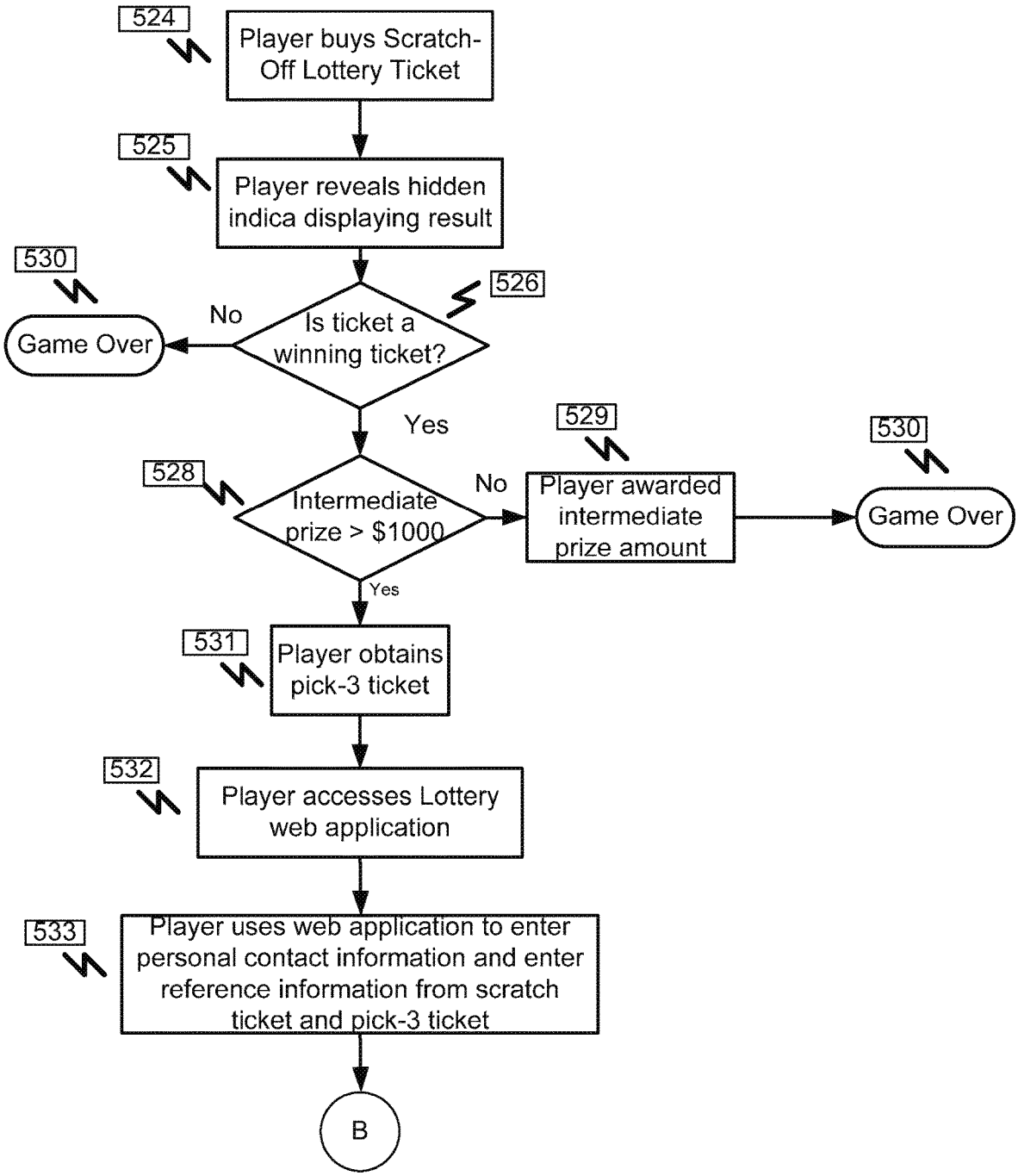
Figure #33(a)

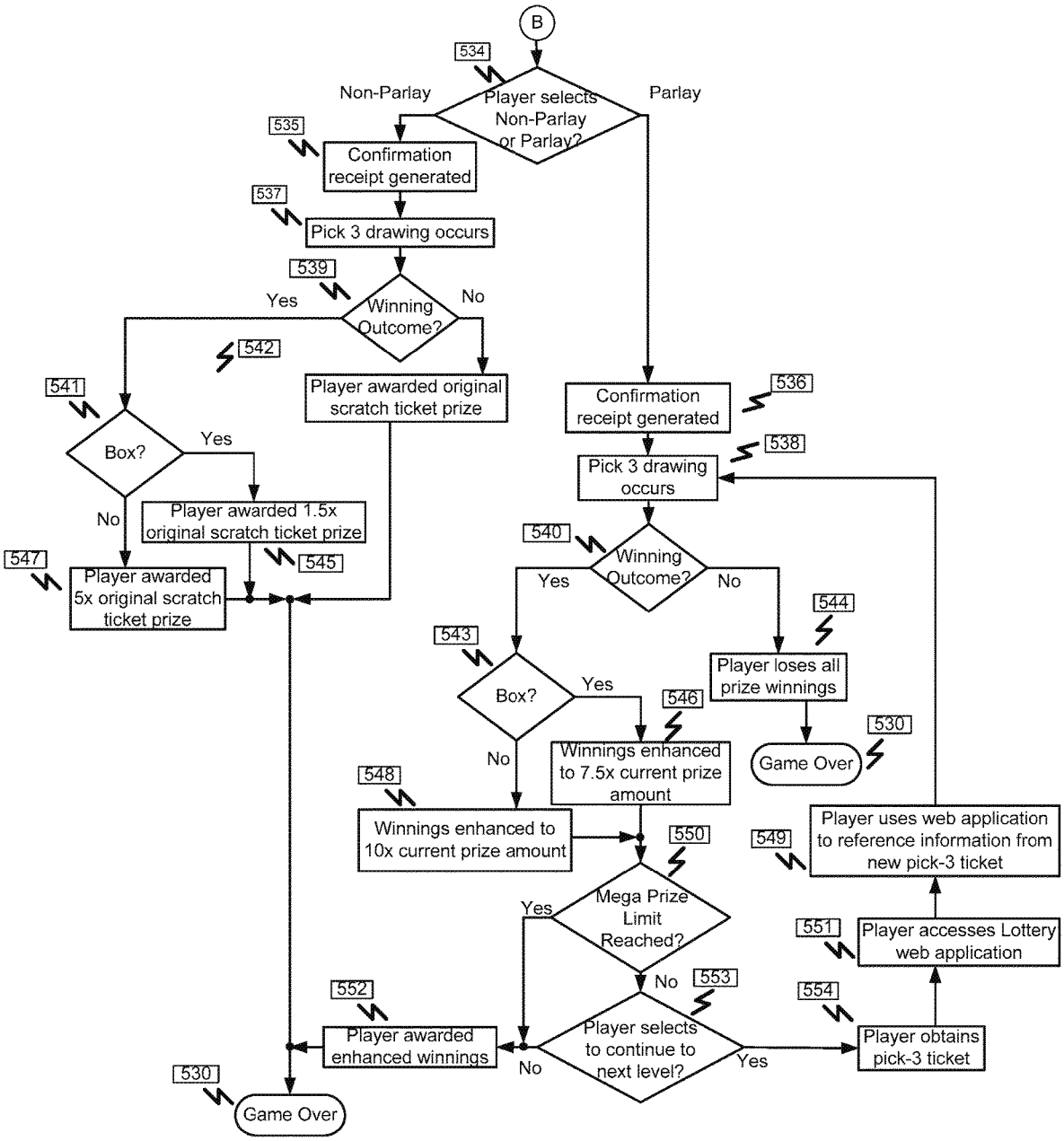
Figure #33(b)

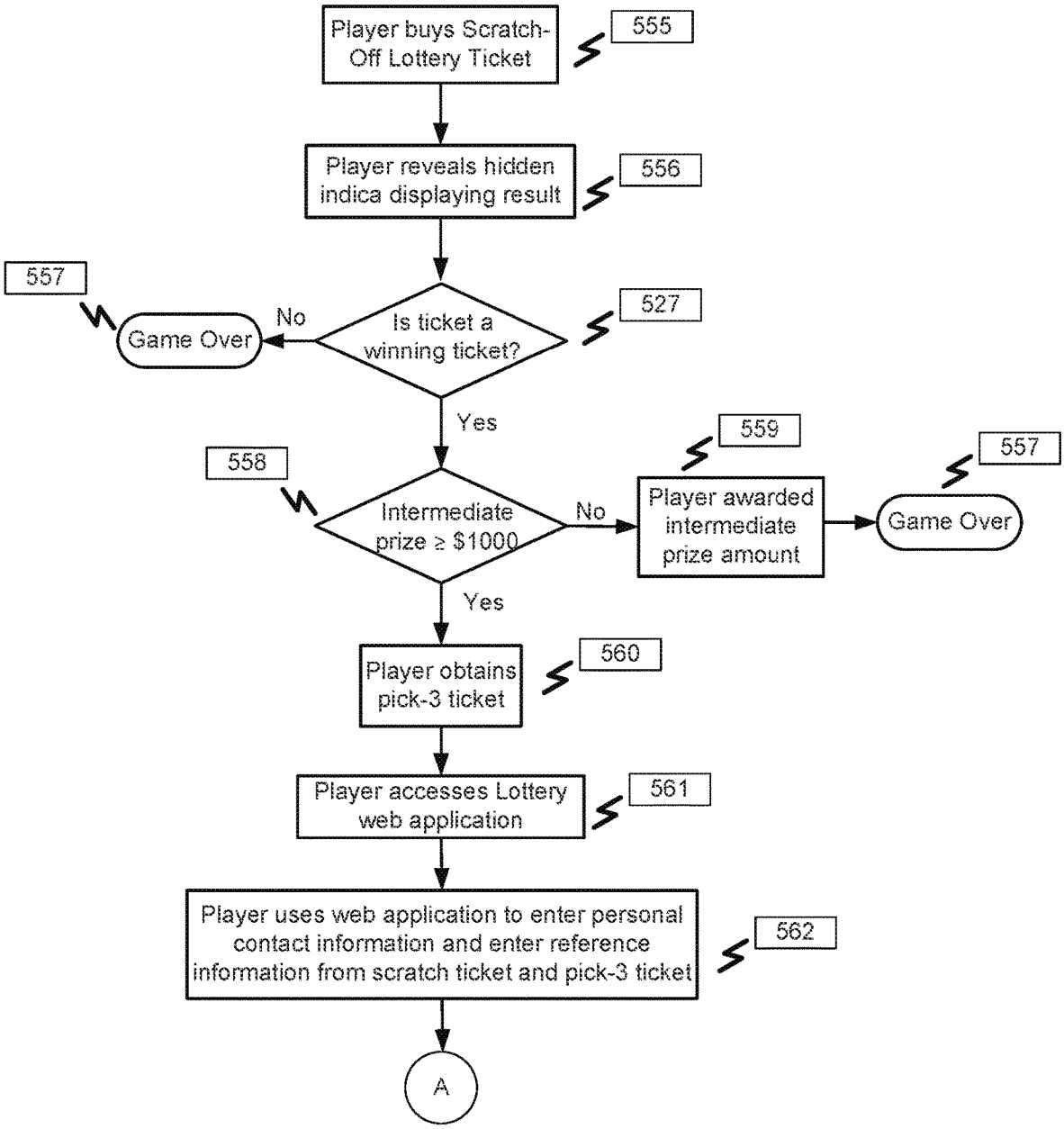
Figure #34(a)

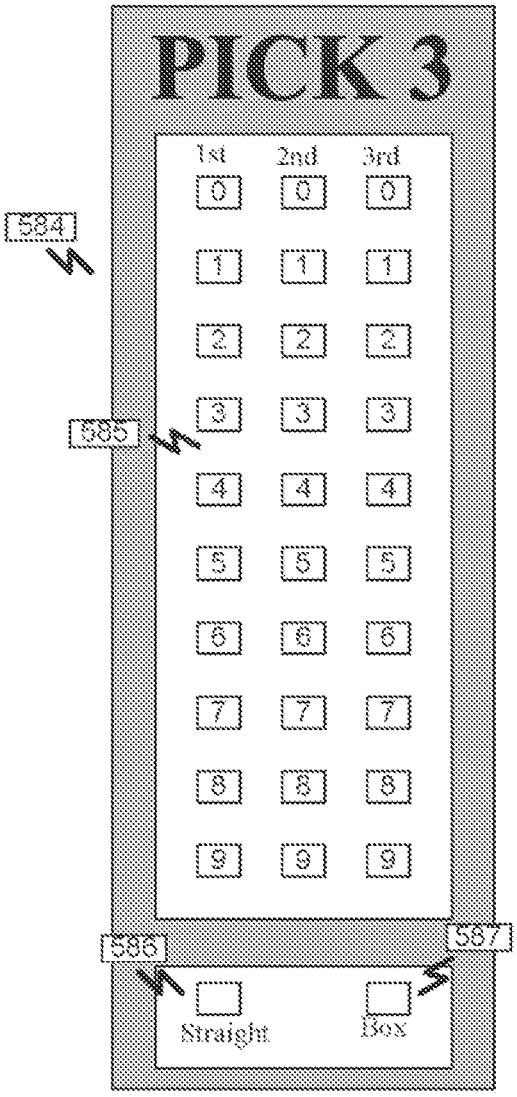
Figure #35

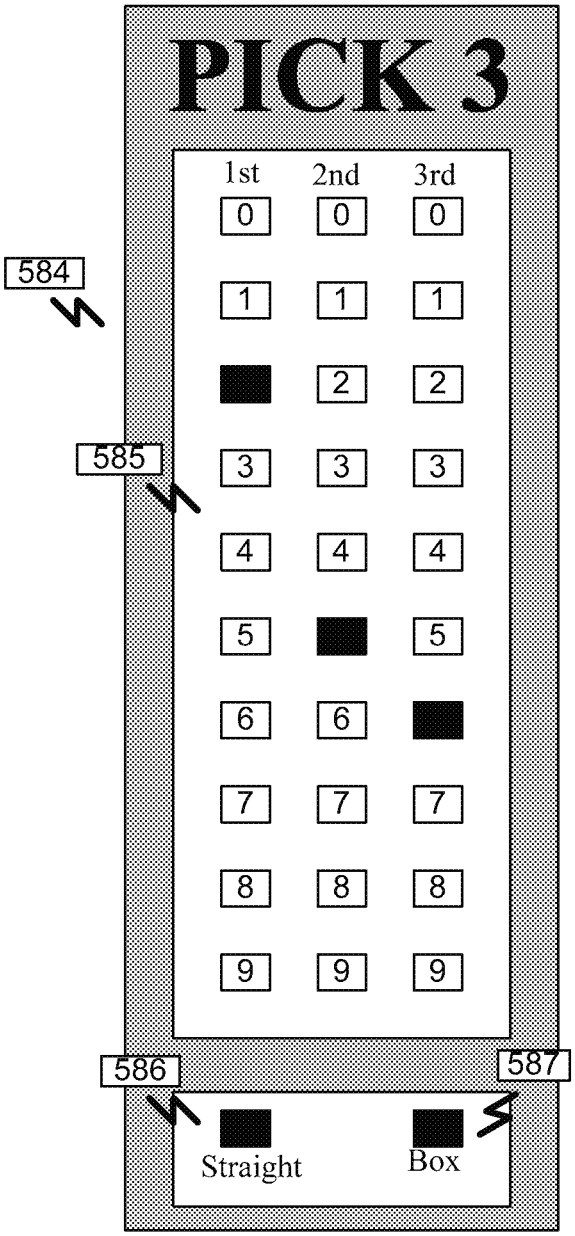
Figure #36

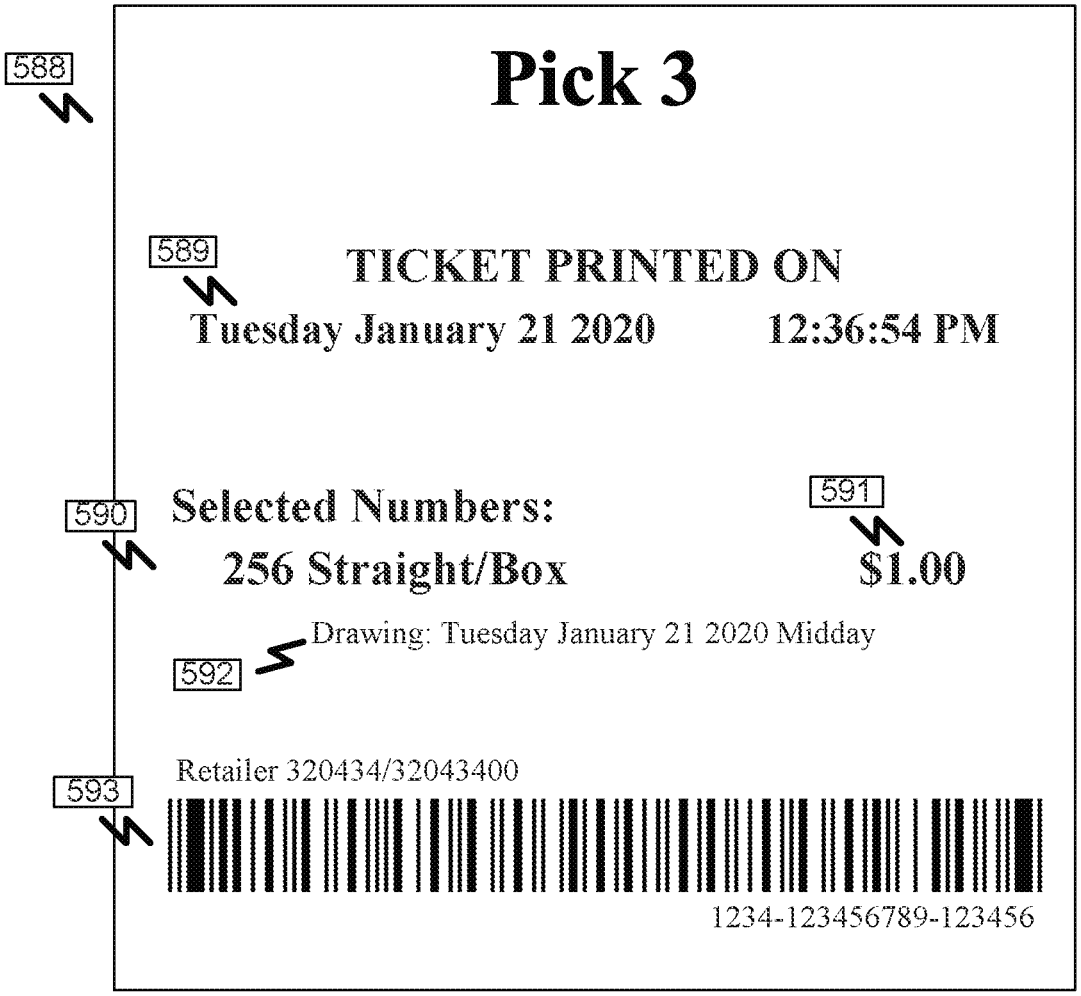
Figure #37

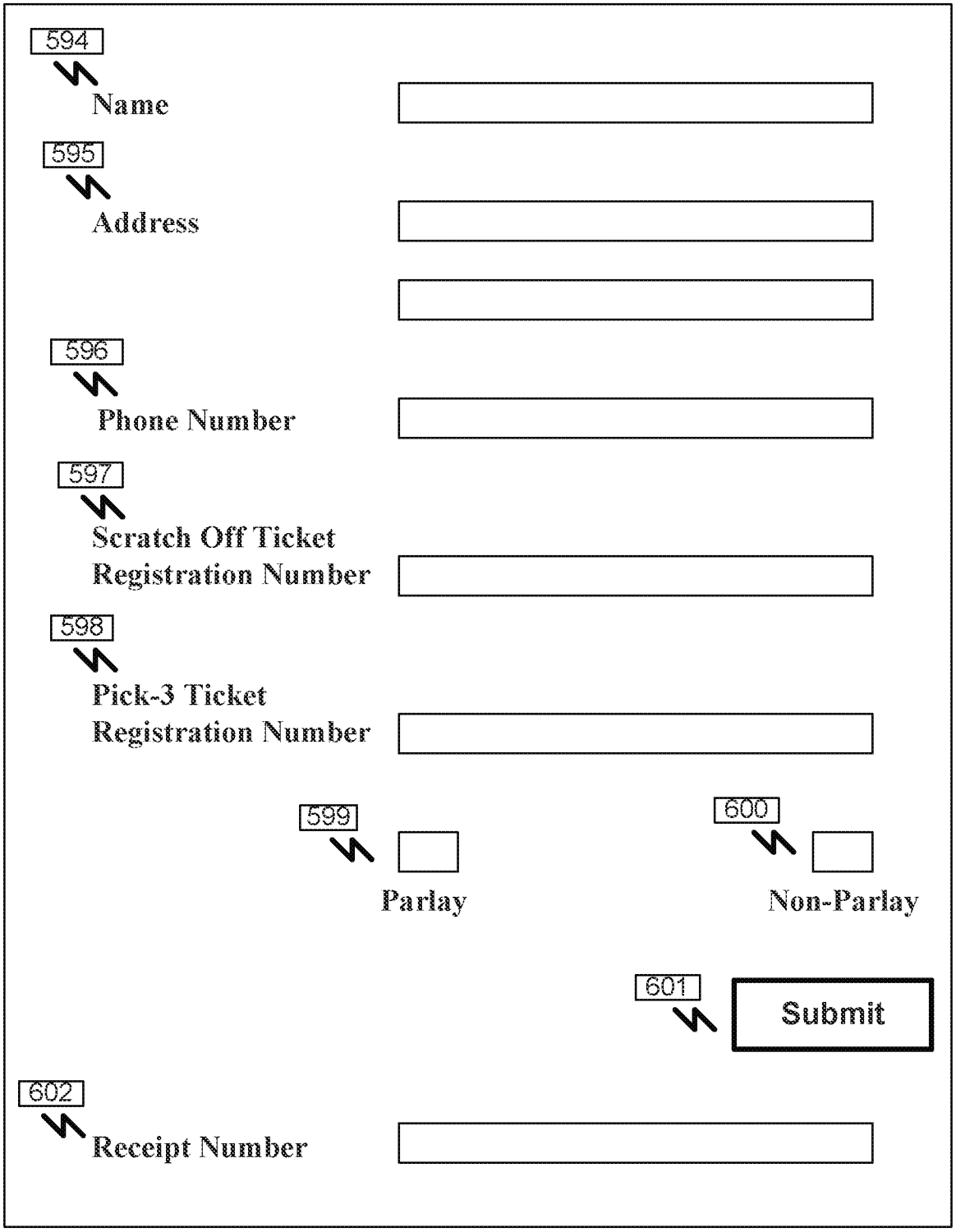
Figure #38

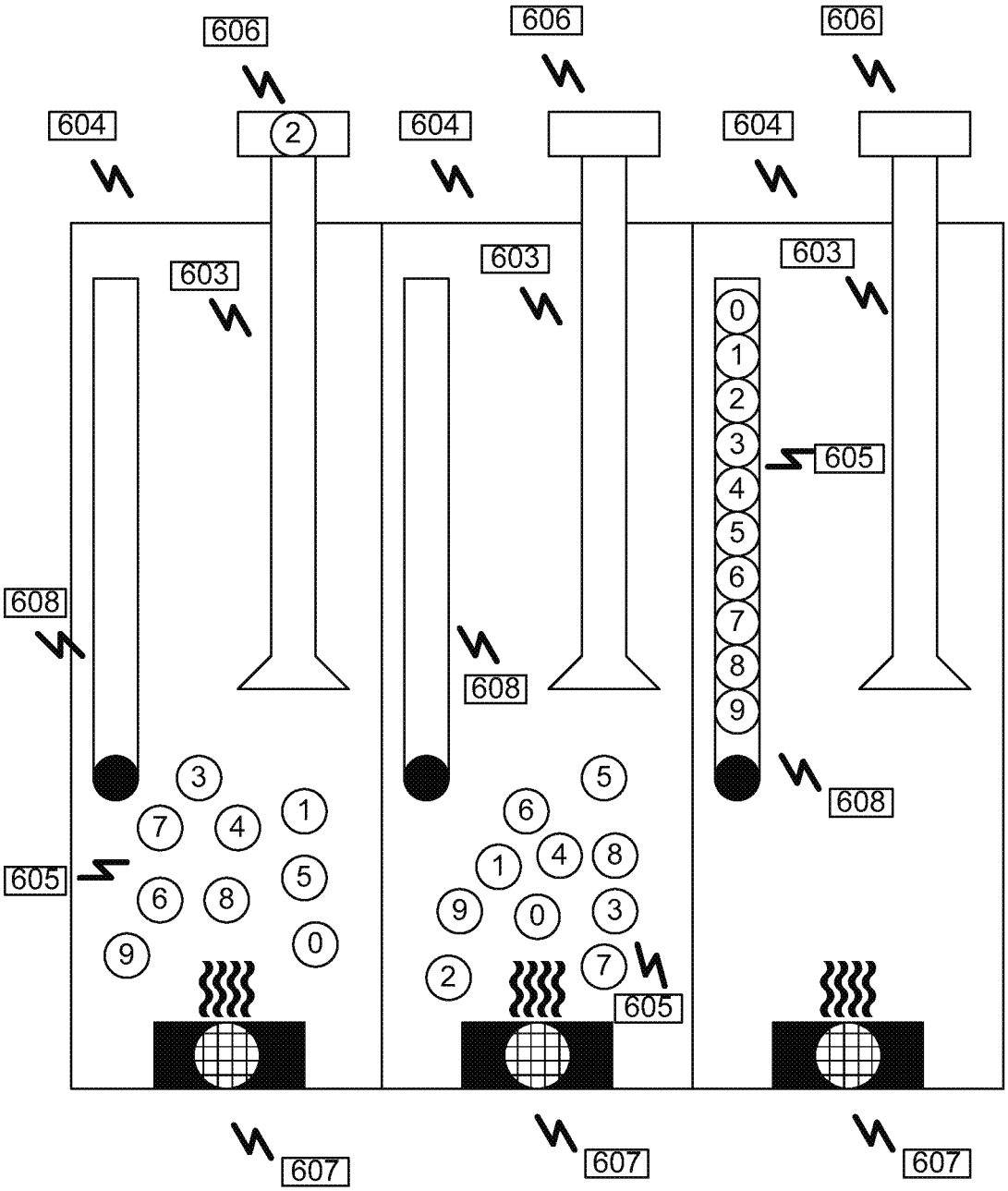
Figure #39

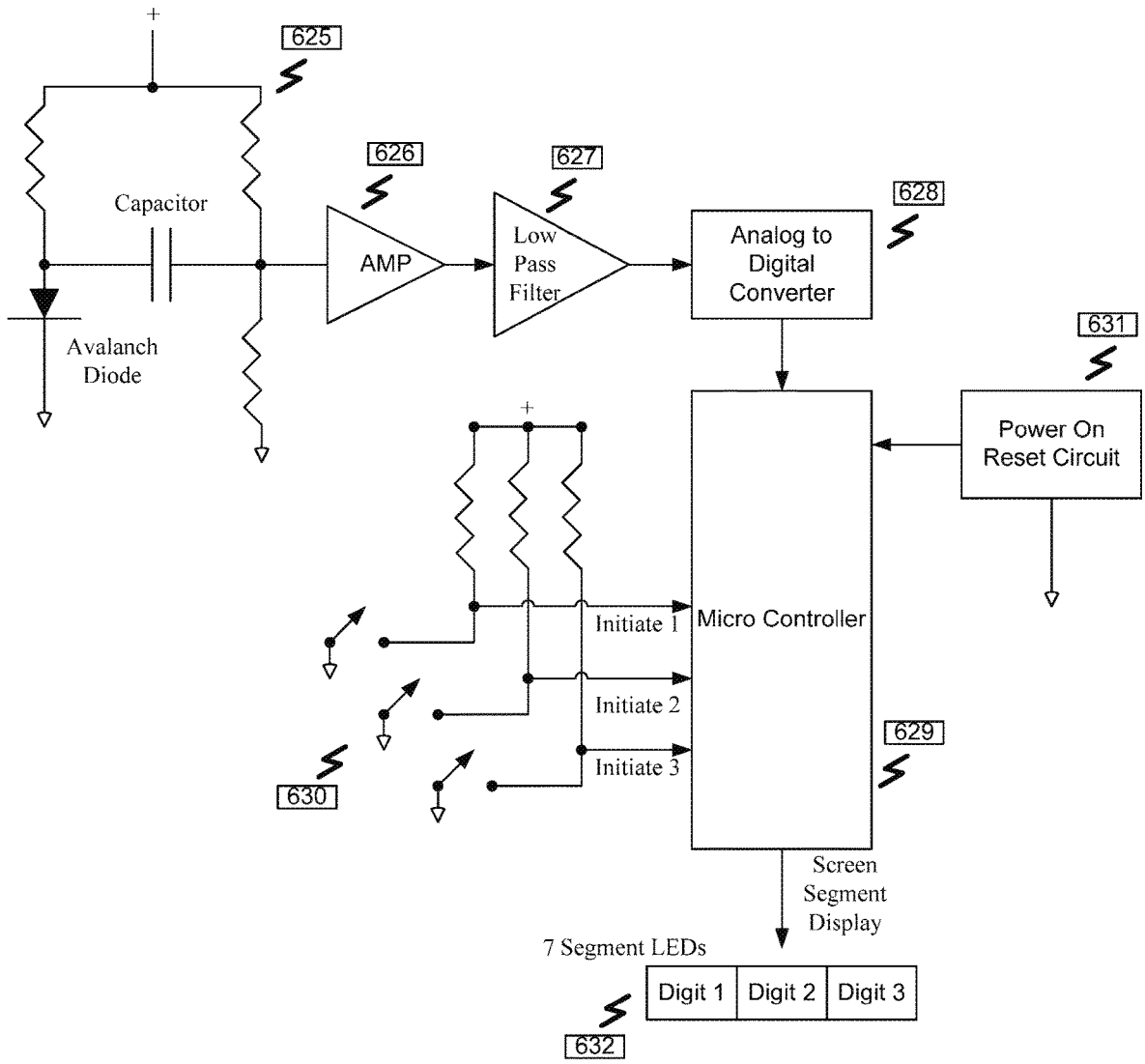
Figure #40

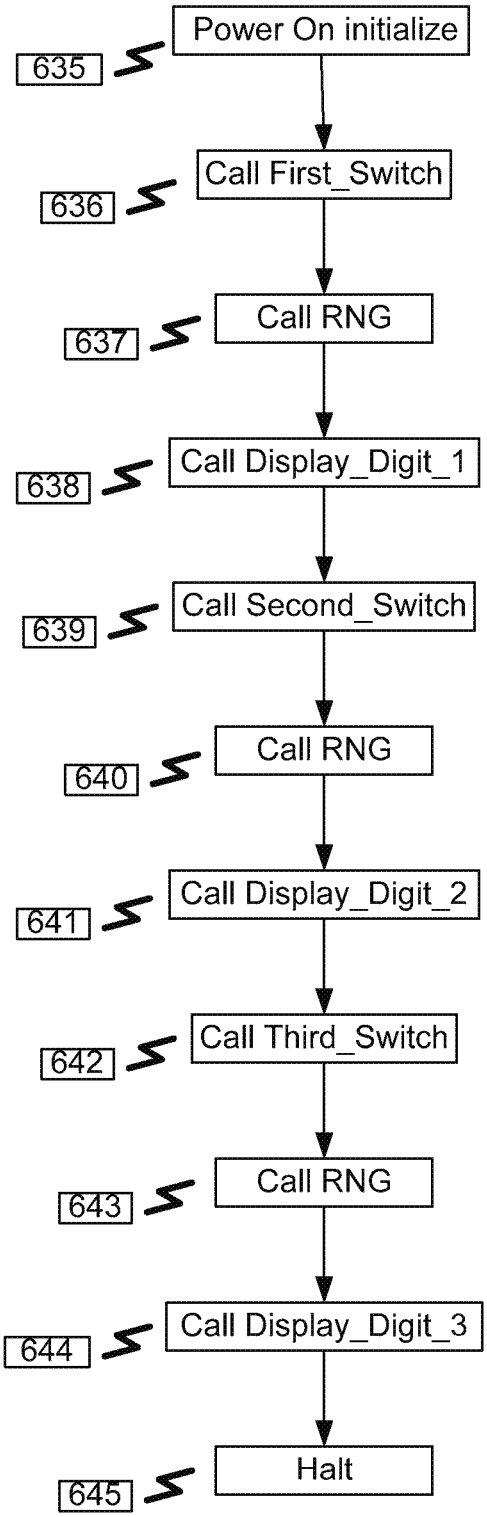
Figure #41

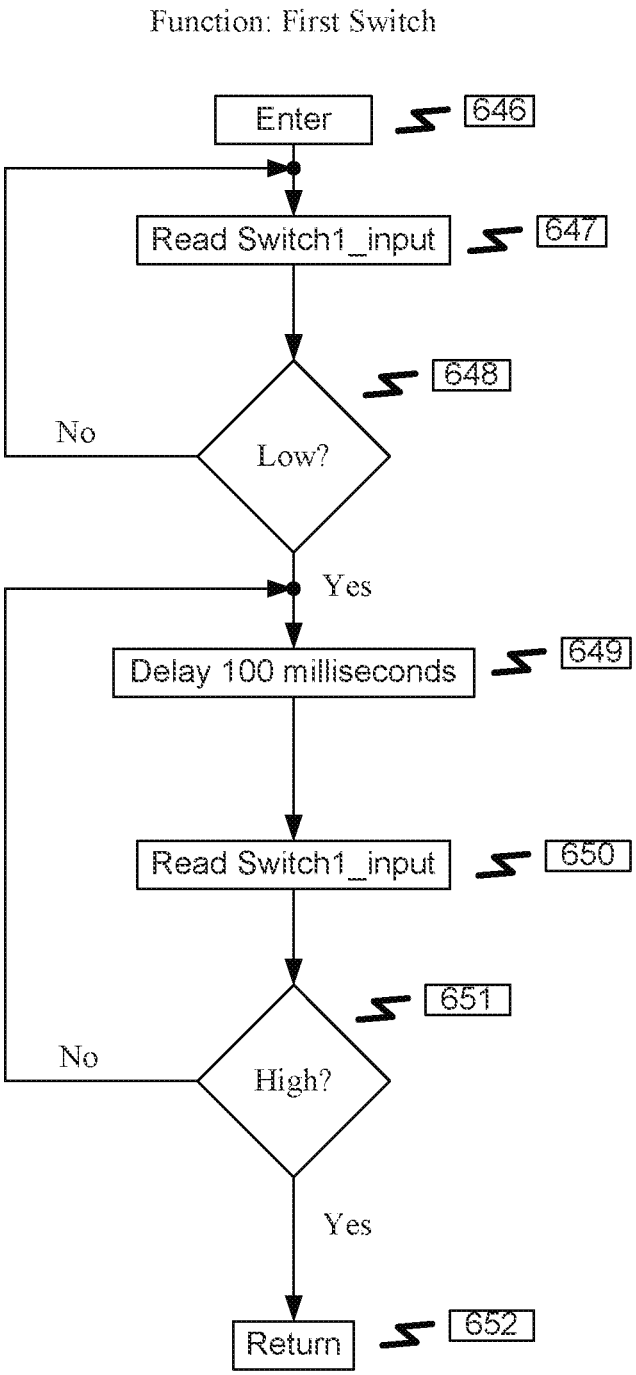
Figure #42

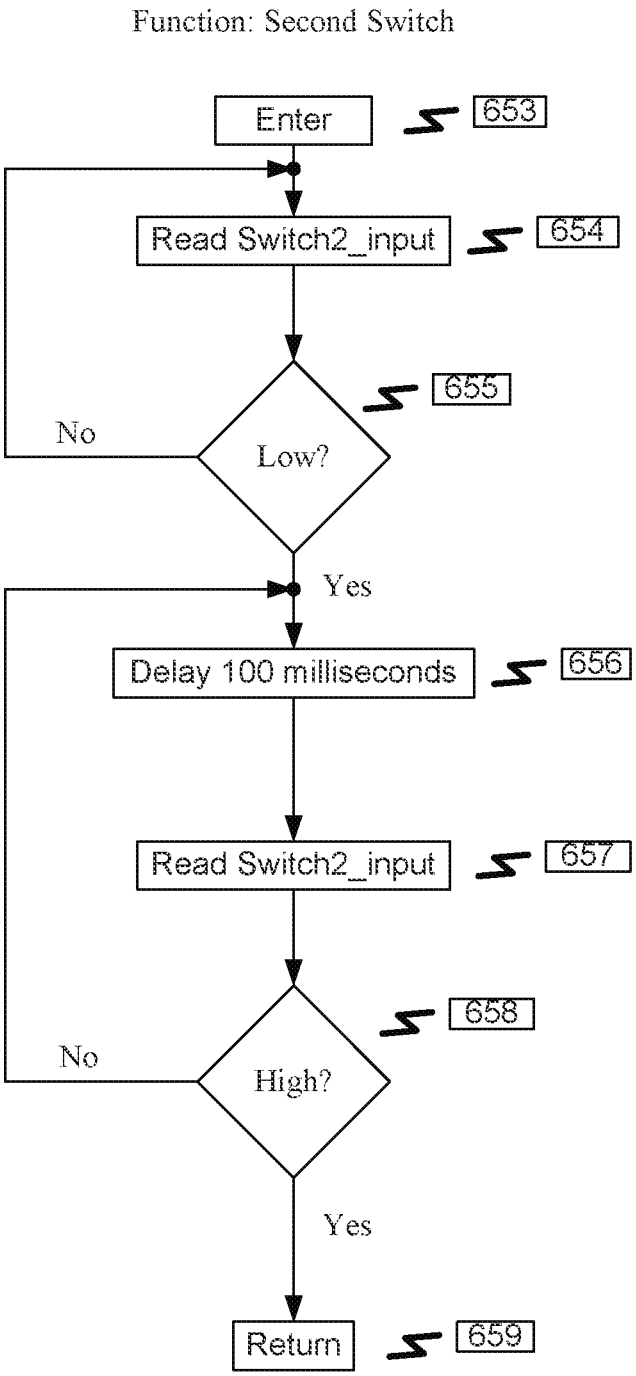
Figure #43

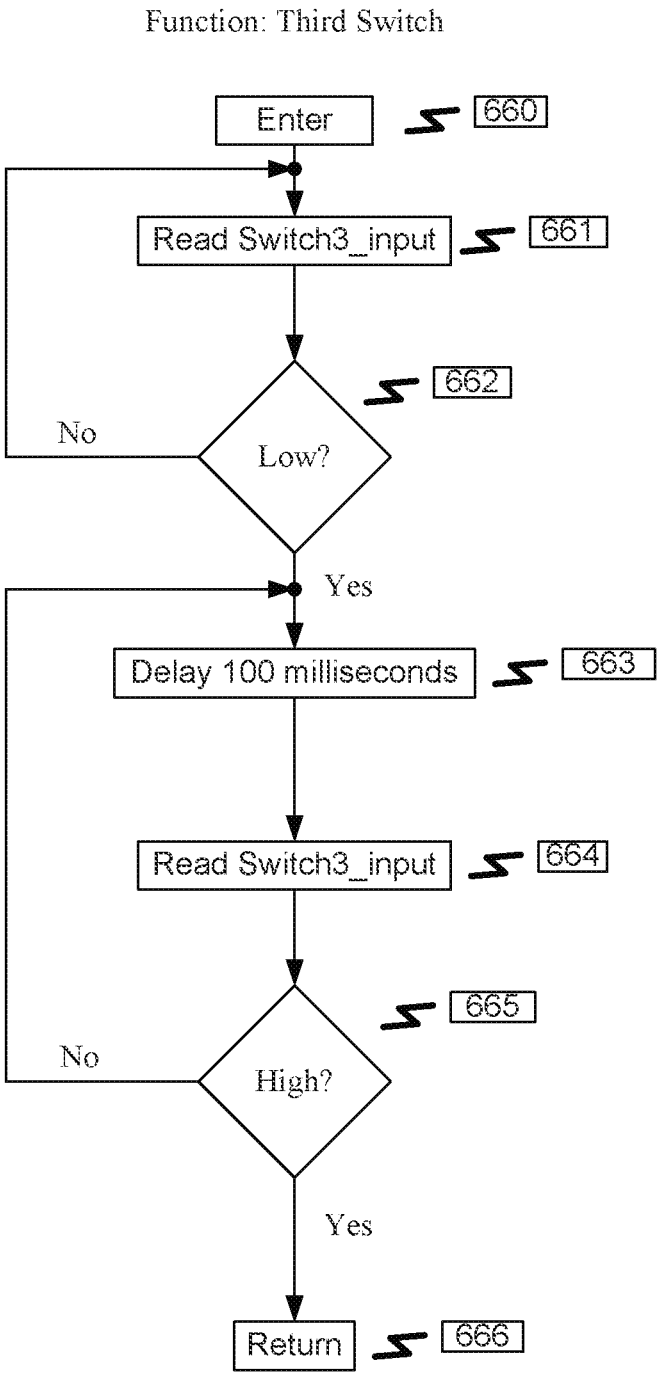
Figure #44

Function: Display_Digit_1

Figure #46

Function: Display_Digit_2

Figure #47

Function: Display_Digit_3

Table: Seven_Seg

| Image | | | (Byte Map) | | | | | | |
|---|---|---|---|---|---|---|---|---|---|
| | A | B | C | D | E | F | G | | Hex |
| 0 | 1 | 1 | 1 | 0 | 1 | 1 | 1 | | 37 |
| 1 | 0 | 0 | 1 | 0 | 0 | 1 | 0 | | 12 |
| 2 | 1 | 0 | 1 | 1 | 1 | 0 | 1 | | 5D |
| 3 | 1 | 0 | 1 | 1 | 0 | 1 | 1 | | 5B |
| 4 | 0 | 1 | 1 | 1 | 0 | 1 | 0 | | 3A |
| 5 | 1 | 1 | 0 | 1 | 0 | 1 | 1 | | 6B |
| 6 | 1 | 1 | 0 | 1 | 1 | 1 | 1 | | 6F |
| 7 | 1 | 0 | 1 | 0 | 0 | 1 | 0 | | 52 |
| 8 | 1 | 1 | 1 | 1 | 1 | 1 | 1 | | 7F |
| 9 | 1 | 1 | 1 | 1 | 0 | 1 | 0 | | 7A |

Figure #49

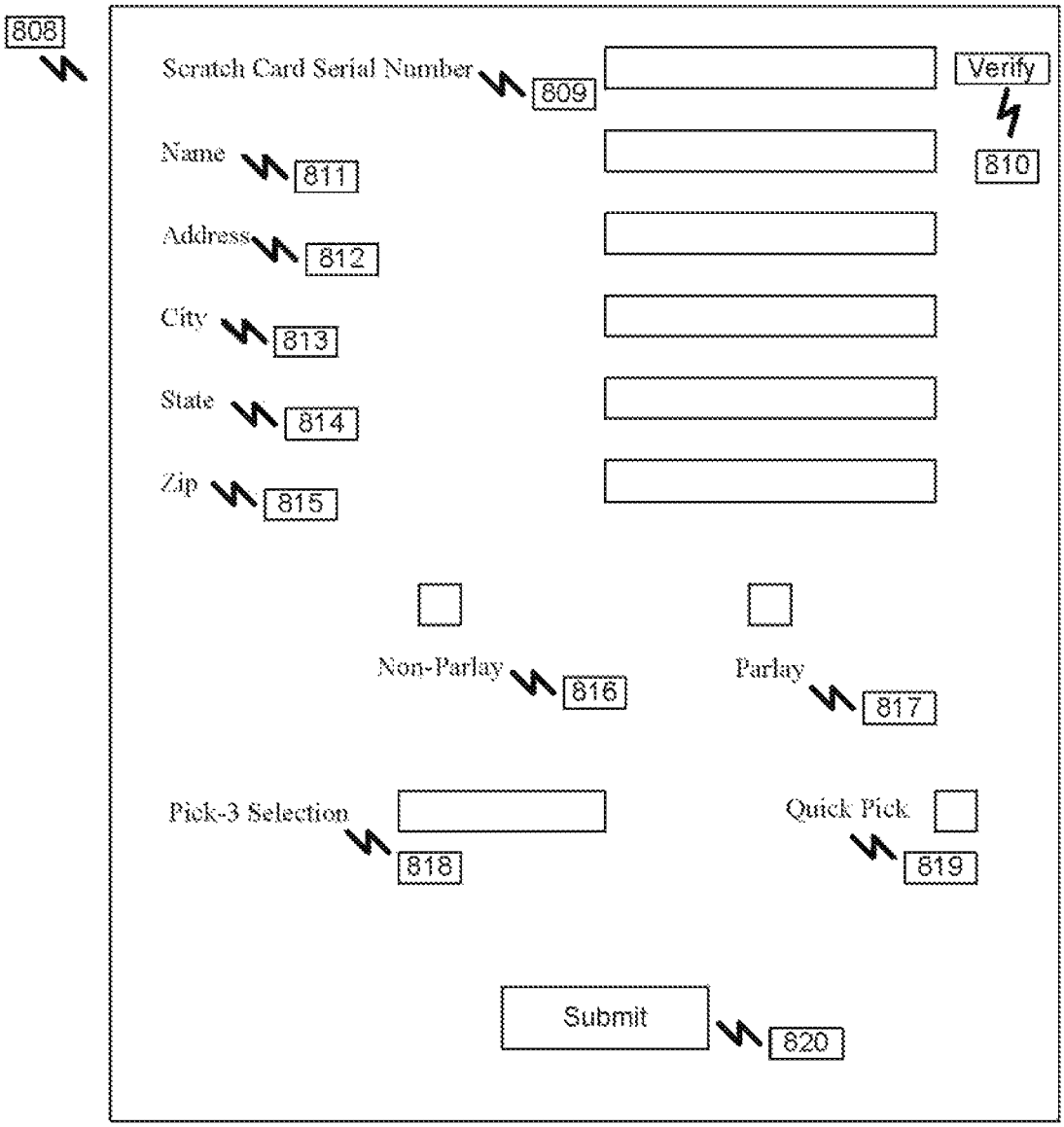
Figure #52

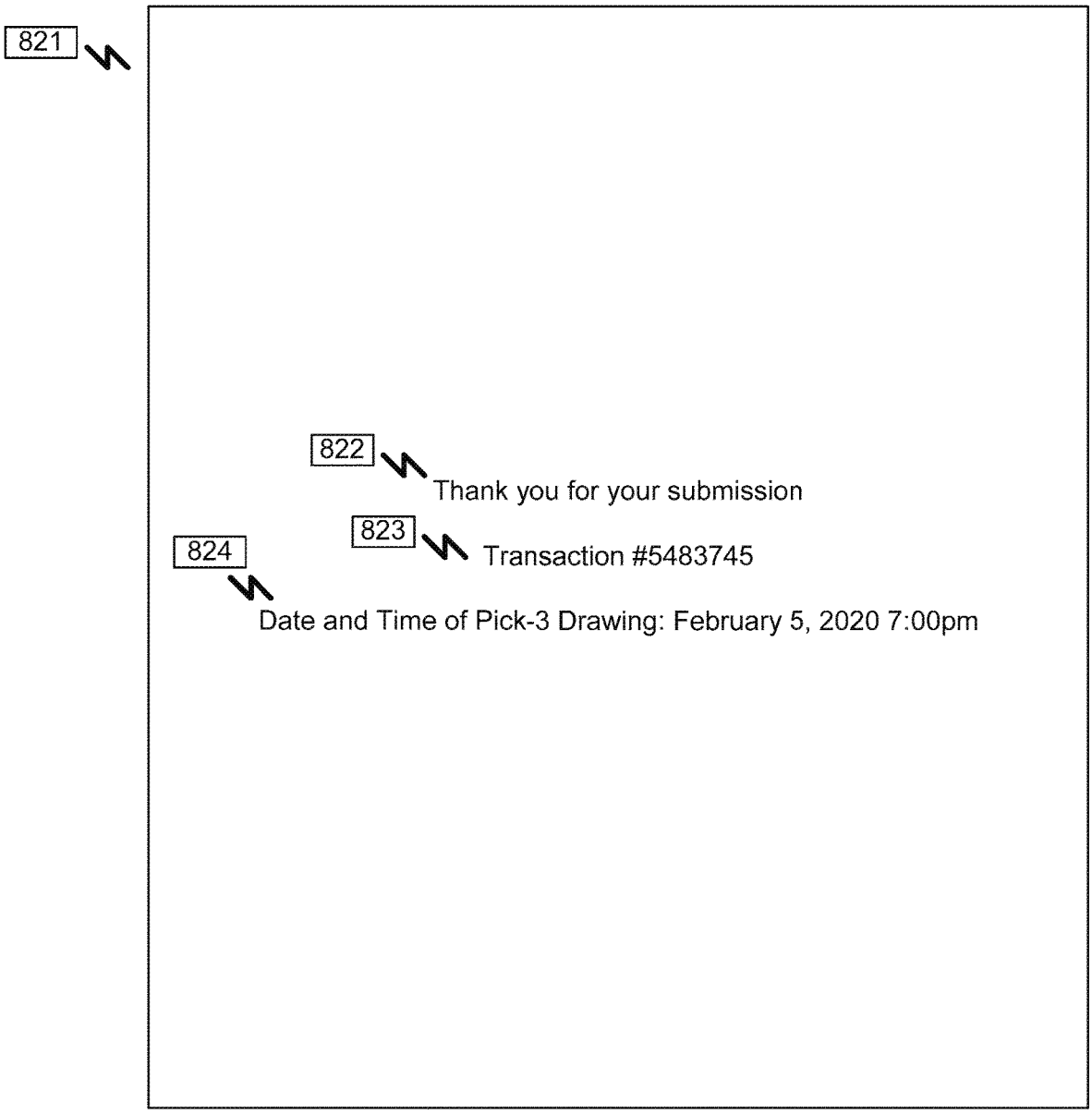
Figure #53

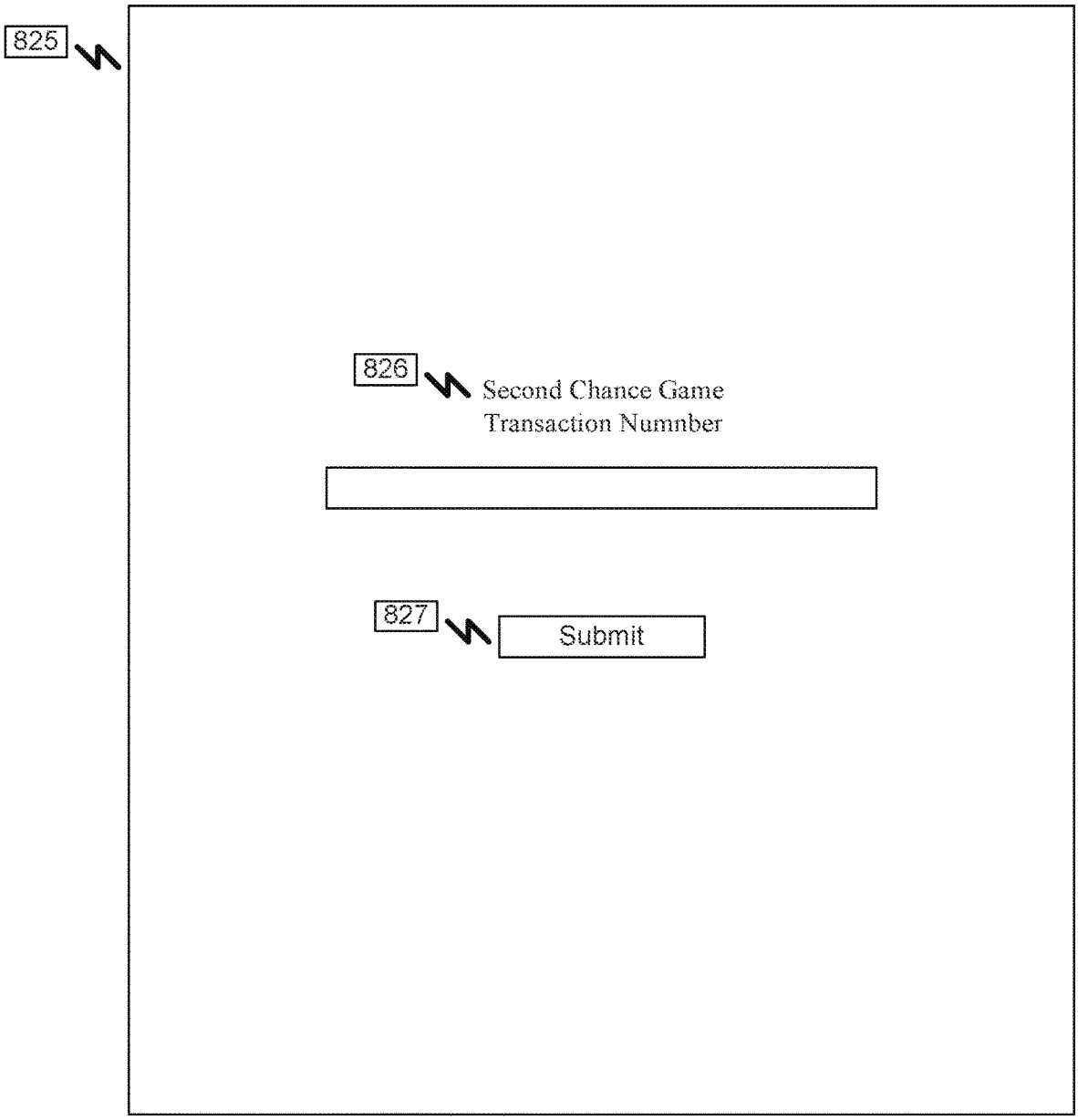
Figure #54

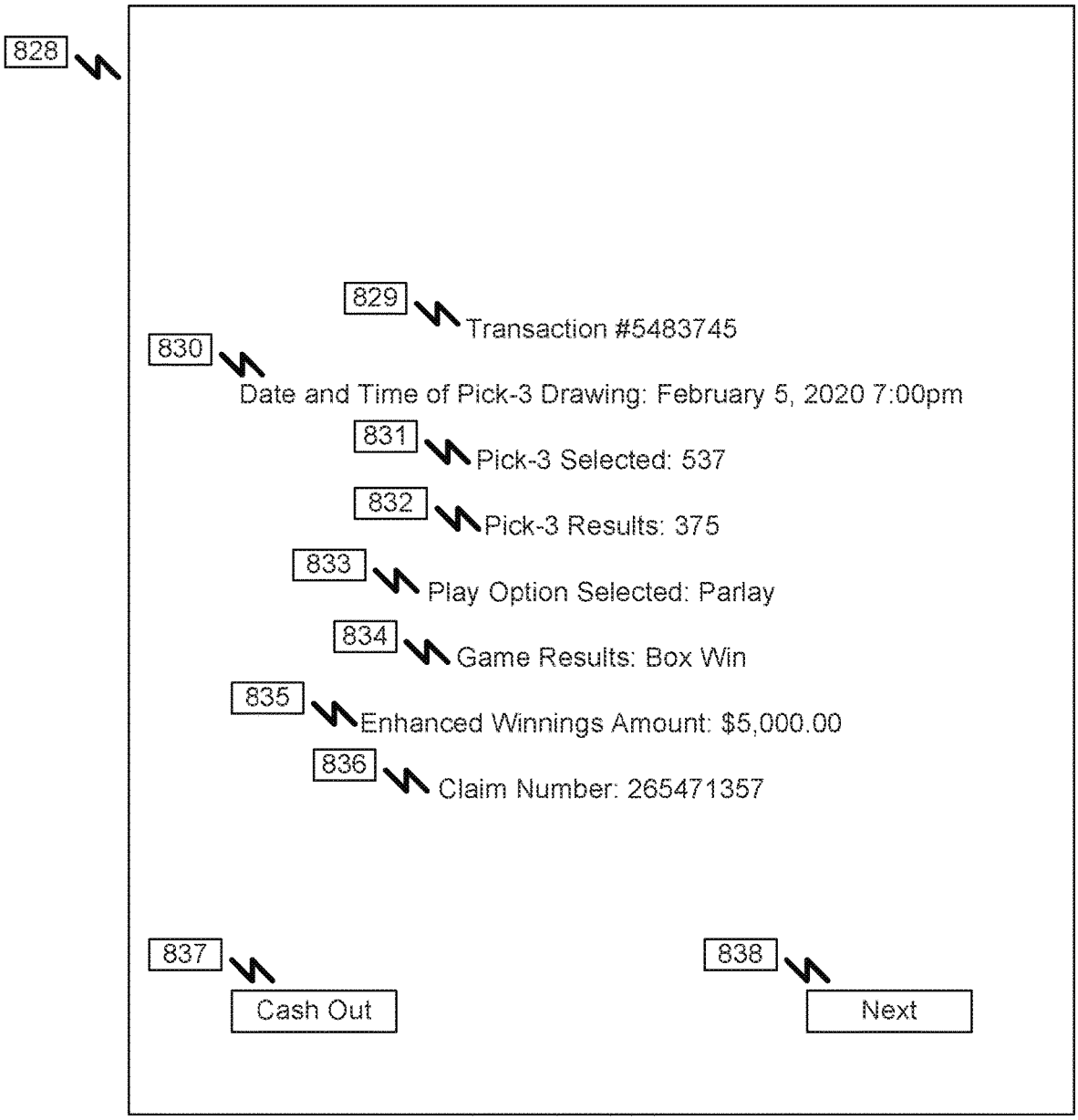
Figure #55

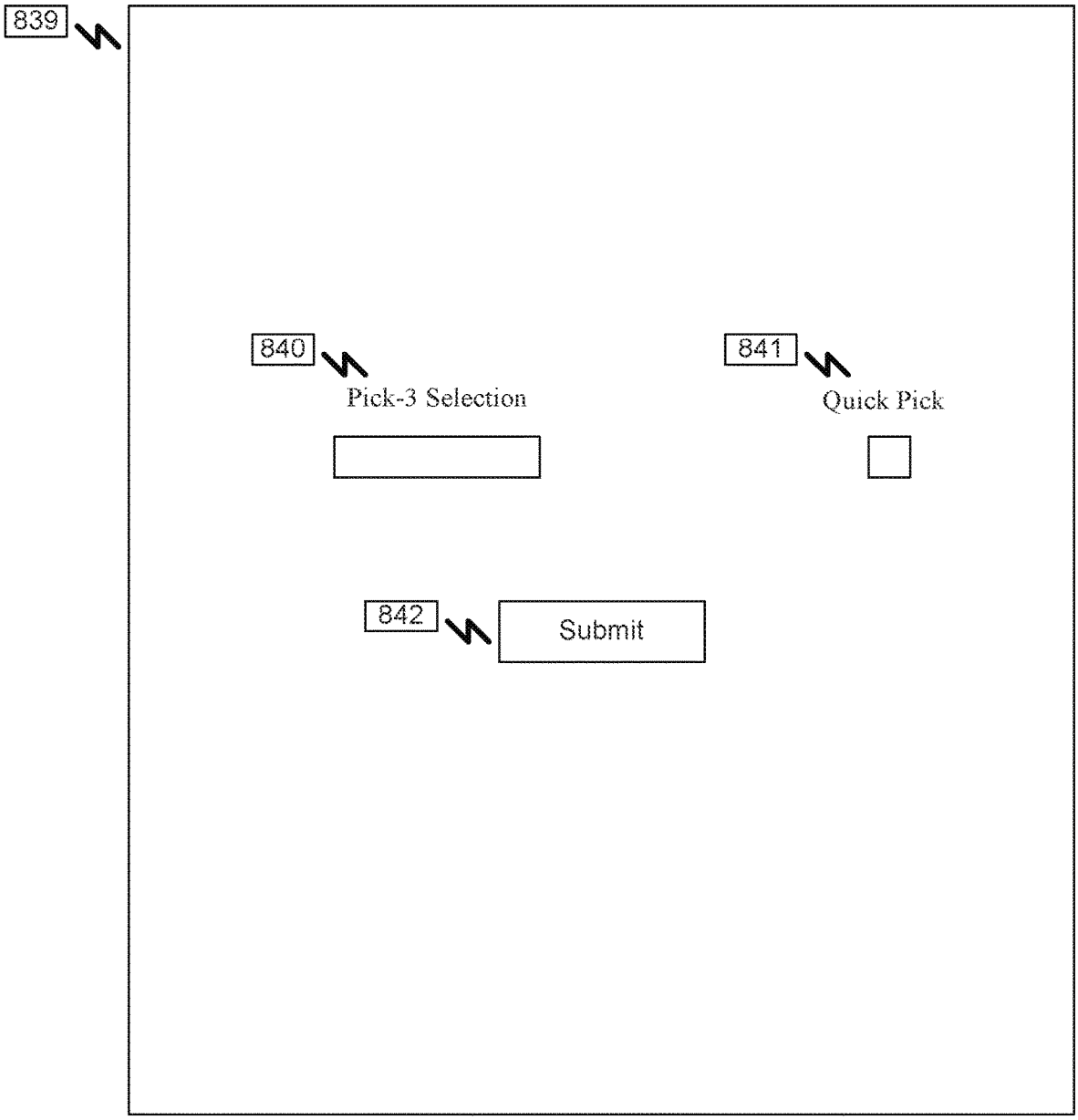
Figure #56

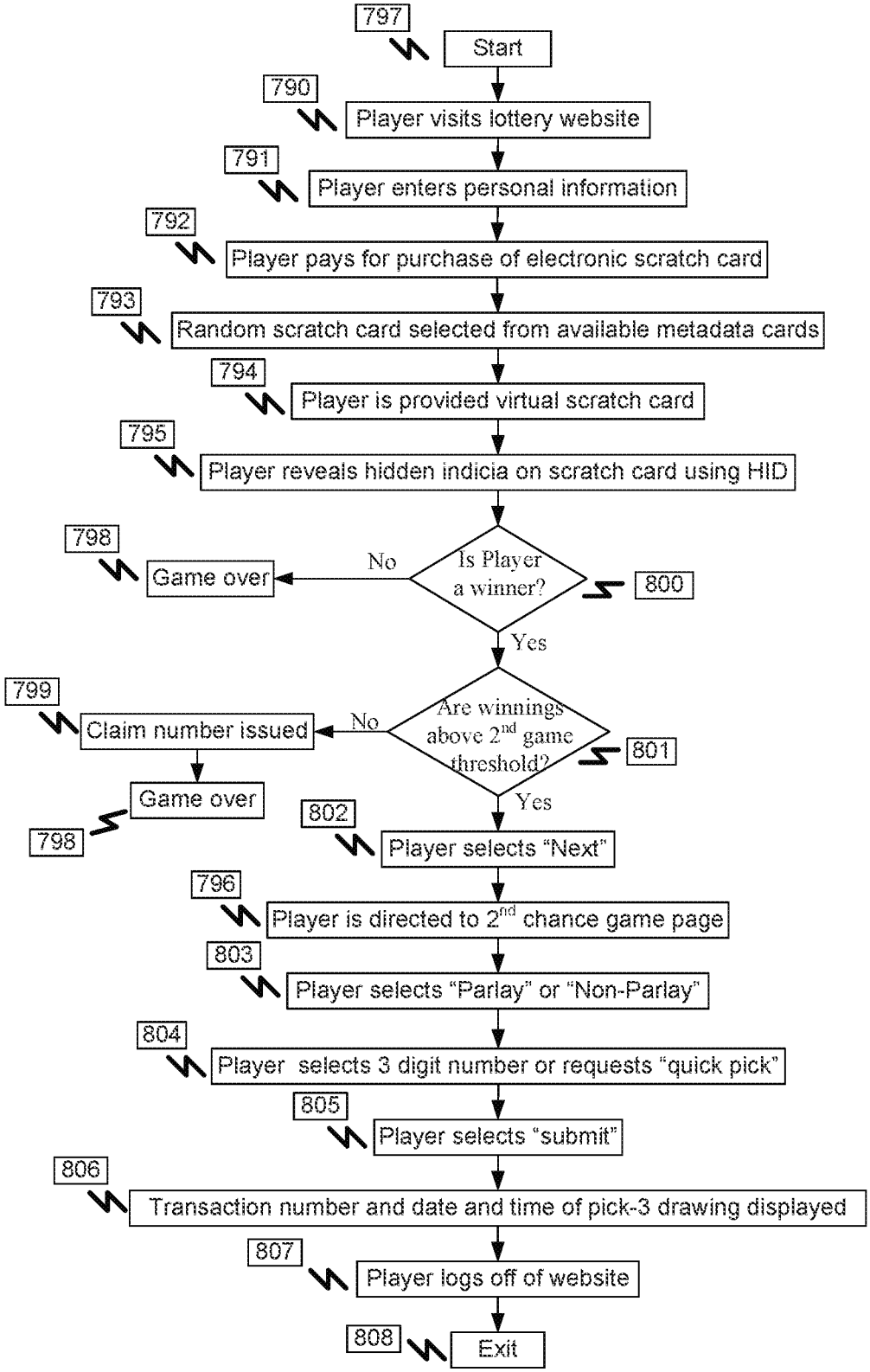
Figure #57

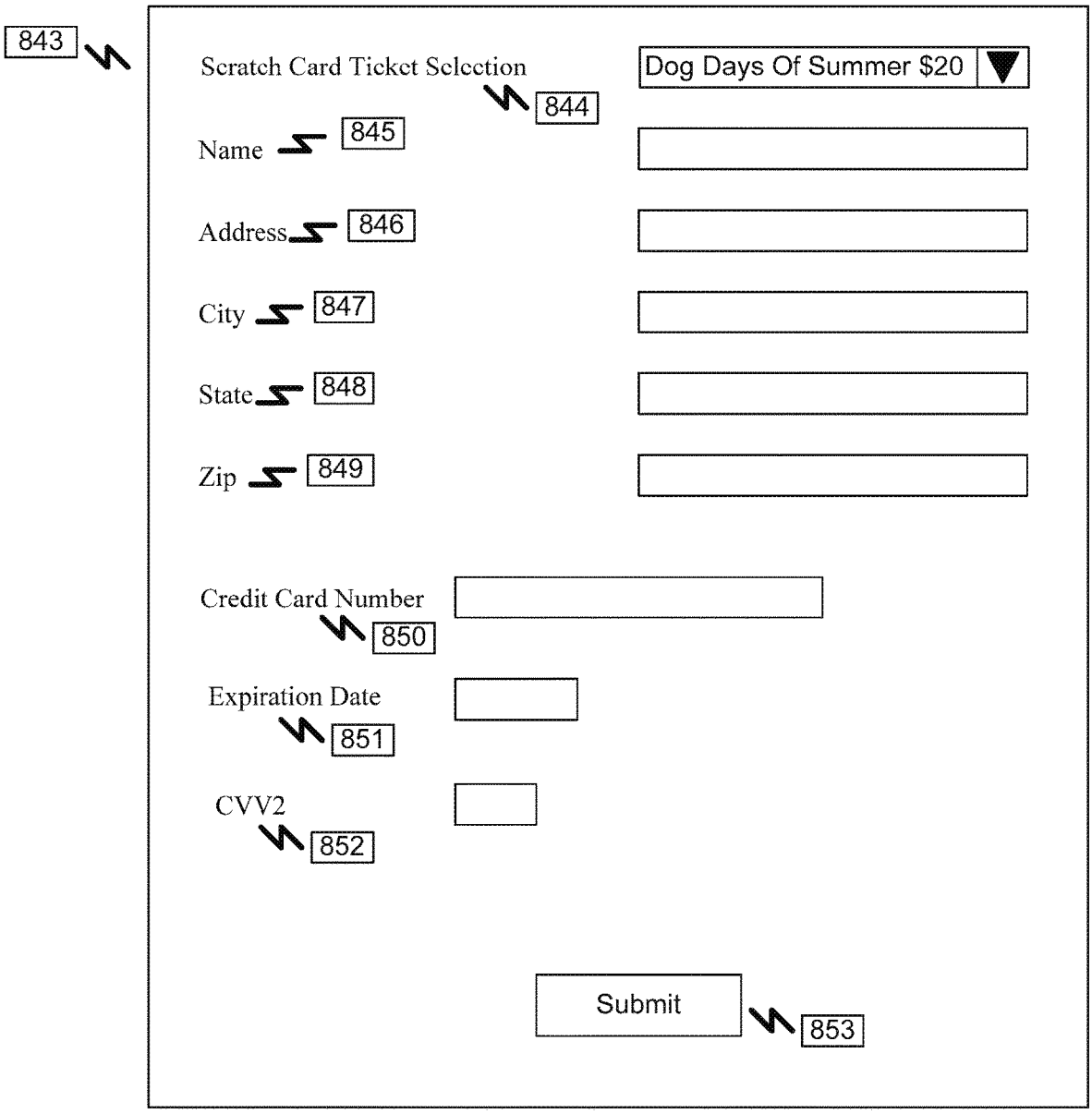
Figure #58

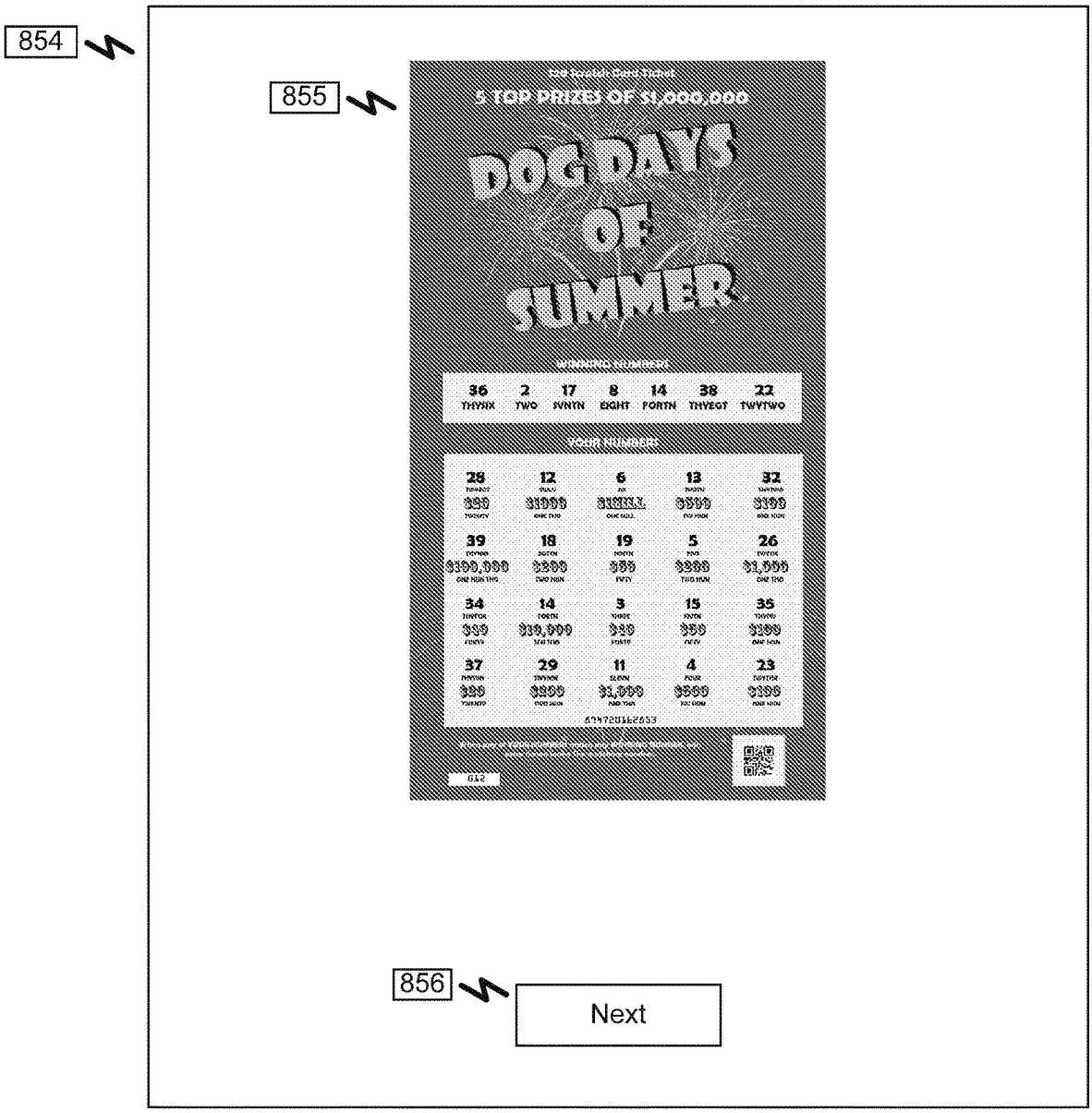
Figure #59

SYSTEM AND METHOD FOR INSTANT WIN SCRATCH OFF TICKET GAME WITH TICKET SALES MAXIMIZATION USING SECONDARY GAME

CROSS-REFERENCE TO RELATED APPLICATIONS

The present application is a continuation-in-part of, and claims priority to, nonprovisional application Ser. No. 16/558,898, filed Sep. 3, 2019, which claims priority to provisional application 62/919,389, filed Mar. 11, 2019, both of which are herein incorporated by reference in their entirety.

FIELD OF THE INVENTION

The present invention relates generally to public lottery games and, more particularly, to extending the play lifetime of an instant win scratch off ticket game of chance by including a conditional prize win feature.

BACKGROUND OF THE INVENTION

During the 1960s, grocery stores and gas stations handed out free game cards covered with a waxy coating that hid a possible prize. The prizes tended to be small, often worth only a penny. There were also free cards that could be compared to supermarket ads in newspapers in a manner similar to the game Bingo: If a card matched the graphic symbols in print, the consumer could win food, money, or prizes. These simple participant games evolved into what today is now referred to as instant win games, where a participant can potentially win a large sum of money playing a game of chance.

The first secure instant lottery ticket was developed in 1974 by scientist John Koza and retail promotions specialist Daniel Bower. Koza and Bower were the cofounders of Scientific Games in Las Vegas, Nev. This was the beginning of the instant lottery concept. When secure instant lottery tickets debuted in May 1974, players in Massachusetts had been buying roughly $1,000,000 worth of six-digit lotto drawing tickets every week. By the end of the first seven days of marketing instant-win cards, the state had sold $2,700,000 worth of them.

U.S. Pat. No. 4,174,857 (Koza), issued Nov. 20, 1979, provides evidence of a game ticket particularly useful as an instant win ticket. The ticket comprises at least a base sheet and a cover sheet which are adhesively joined together in a peripheral portion. Information to be concealed is placed on the surface of the base sheet which faces the cover sheet. This information is concealed by covering it with a suitable, removable material which is opaque, thus concealing the information until the opaque material is removed.

U.S. Pat. No. 4,191,376 (Goldman et al), issued Mar. 4, 1980, provides for an instant lottery ticket imprinted with lottery numbers and serial numbers that are uniquely related. Lottery numbers are covered from view until after purchase. This provides for control and distribution of winners with a high degree of security. Computerized fabrication allows for high security and low-cost production.

U.S. Pat. No. 4,299,637 (Oberdeck et al), issued Nov. 10, 1981, discloses a method for making a game ticket which has a base sheet adhesively joined together in peripheral portions of sections containing information used in the game. An opaque material is applied over the release coating to conceal information in the printed areas. The opaque material is adapted to be rubbed off when the ticket is used.

U.S. Pat. No. 4,643,454 (Ondis), issued Feb. 17, 1987 and assigned to Astro-Med Inc., provides an instant game type lottery ticket having a coating on the front side which includes a first metallic layer and an outwardly facing layer of thermally responsive chemicals, a removable opaque layer over at least a portion of the thermally responsive chemical layer, and a second metallic layer on the back side of the ticket. The metallic layers include vacuum deposited silver-colored metallized layers having protective transparent plastic films thereon. Game-playing indicia can be imprinted on the lottery ticket at the point of sale without damaging the removable opaque layer by selectively activating the thermally responsive chemicals under the removable opaque layer with a thermal printhead. The transparent plastic films allow the ticket to be thermally imprinted with a thermal printhead without damaging the printhead and the metallized layers adding opacity to the lottery ticket.

U.S. Pat. No. 8,579,693 (Bennett), issued Nov. 12, 2013, discloses a system and method for providing an additional or end of game drawing to players of a lottery game. A player participates in a lottery and subsequently submits a validation code from his ticket to a lottery ticket provider. The lottery ticket provider then applies an algorithm to the validation code to determine if the player is entered into a secondary game or end of game drawing.

Approximately 43 US states and territories currently offer a lottery with a scratch off ticket available for purchase. Scratch off tickets significantly increase lottery revenue when they are utilized. A limitation to existing scratch off ticket games is that when the grand prizes associated with a specific game or series of tickets are exhausted the sales of the remaining tickets of that specific game are terminated. With increasing grand prize amounts and quantities awarded, the Lottery risks a deficit or a significant revenue shortfall if all of the grand prizes are awarded before a "critical point" in sales has occurred.

As an example, consider a scratch off lottery game with the following specifications:

1) A print run 5,400,000 divided into 50 pools and 360,000 rolls of tickets.

2) Each pool contains 108,000 tickets divided across 7200 rolls with 15 tickets per roll.

3) Each ticket costs $20.00.

4) Five grand prize-winning tickets seeded uniformly and randomly across the 50 pools amount of $1,000,000 each.

The Grand Prize tickets "seeded" across the ticket print run should allow the game to operate for an acceptable length of time. The game rules require the game to terminate when all five grand prize tickets are claimed. Using the Grand Prize seeding methods, the probability of all five grand prize tickets being won early, while low, is still possible and will result in the game being terminated "early" before ticket sales have generated sufficient revenue, leading to poor monetary performance.

As such, there is a need for a system and method to extend the playtime of an instant win scratch off ticket game.

SUMMARY OF THE INVENTION

According to various embodiments, a system, method, and non-transitory computer-readable medium for increasing the operational lifetime of a scratch-off ticket lottery game where all maximum award amount tickets have been identified by establishing a secondary game with qualified entry is disclosed. The system, method, and non-transitory computer-readable medium include a computer system configured with a game specification file and at least one random number generator based on a publicly verifiable entropy source. The computer system is programmed based on the game specification file and random number generator to randomly generate sequences of characters for the scratch-off lottery game. Each sequence of characters corresponds to one of a winning combination and a losing combination. The winning combinations have different winning award amounts and the losing combinations having a zero winning award amount. At least one sequence of characters corresponds to a winning combination having a maximum award amount for the scratch-off lottery game. The computer system is further programmed to establish a winning award amount threshold to qualify for entry into a secondary game. The winning award amount threshold is less than the maximum award amount for the scratch-off lottery game but greater than a lowest winning award amount. The computer system is additionally programmed to randomly distribute the sequences of characters among a plurality of tickets for purchase. A holder of a purchased ticket with a sequence of characters corresponding to a winning combination having a winning award amount greater than or equal to the winning award amount threshold qualifies to play the secondary game.

Various other features and advantages will be made apparent from the following detailed description and the drawings.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only exemplary embodiments of the invention and are not, therefore, to be considered to be limiting its scope, the invention will be described and explained with additional specificity and detail through the use of the accompanying drawings, in which:

FIG. 1 depicts an example instant win scratch off ticket game system according to an embodiment of the present invention;

FIG. 2 depicts an instant win scratch off ticket game with conditional secondary game diagram according to an embodiment of the present invention;

FIG. 3 depicts a scratch off ticket instant win game with conditional secondary game process flow diagram according to an embodiment of the present invention;

FIG. 4 depicts a sample of scratch off ticket game parameter values according to an embodiment of the present invention;

FIG. 5 depicts a flow diagram of populate and shuffle prize pool arrays according to an embodiment of the present invention;

FIG. 6 depicts a flow diagram of prize pool determination according to an embodiment of the present invention;

FIG. 7 depicts a flow diagram of populating a prize pool with associated prize tokens according to an embodiment of the present invention;

FIG. 8 depicts a flow diagram of scratch off ticket formulation and printing according to an embodiment of the present invention;

FIG. 9 depicts a flow diagram of a Durstenfeld shuffle function according to an embodiment of the present invention;

FIG. 10 depicts an example of a Durstenfeld shuffle according to an embodiment of the present invention;

FIG. 11 depicts a flow diagram of a true random number generator with modulus according to an embodiment of the present invention;

FIG. 12 depicts a flow diagram of a resolve modulus bit mask function according to an embodiment of the present invention;

FIG. 13(*a*) depicts sample rules for an instant win scratch off ticket game with a conditional secondary game according to an embodiment of the present invention;

FIG. 13(*b*) further depicts sample rules for an instant win scratch off ticket game with a conditional secondary game according to an embodiment of the present invention;

FIG. 13(*c*) further depicts sample rules for an instant win scratch off ticket game with a conditional secondary game according to an embodiment of the present invention;

FIG. 13(*d*) further depicts sample rules for an instant win scratch off ticket game with a conditional secondary game according to an embodiment of the present invention;

FIG. 14 depicts an example of a scratch off ticket with indicia hidden according to an embodiment of the present invention;

FIG. 15 depicts an example of a scratch off ticket with indicia exposed according to an embodiment of the present invention;

FIG. 16 depicts an instant win scratch off ticket secondary game kiosk according to an embodiment of the present invention;

FIG. 17 depicts a flow diagram of random secondary game win determination function according to an embodiment of the present invention;

FIG. 18 depicts a secondary game control table according to an embodiment of the present invention;

FIG. 19 depicts an example of a secondary game kiosk with no winner slot variation according to an embodiment of the present invention;

FIG. 20 depicts an example of a secondary game kiosk with winner slot variation according to an embodiment of the present invention;

FIG. 21 depicts an example of a secondary game kiosk with no winner dice variation according to an embodiment of the present invention;

FIG. 22 depicts an example of a secondary game kiosk with winner dice variation according to an embodiment of the present invention;

FIG. 23 depicts an example of a secondary game kiosk with no winner card variation according to an embodiment of the present invention;

FIG. 24 depicts an example of a secondary game kiosk with winner card variation according to an embodiment of the present invention;

FIG. 25 depicts an example of a secondary game kiosk with double wheel summation variation according to an embodiment of the present invention;

FIG. 26 depicts a conditional secondary game control table according to an embodiment of the present invention;

FIG. 27 depicts an example of a conditional secondary game kiosk leaderboard according to an embodiment of the present invention;

FIG. 28 depicts an example of a server farm according to an embodiment of the present invention;

FIG. 29 depicts an example of a specification computer system according to an embodiment of the present invention;

FIG. 30 depicts an example of a printing computer subsystem according to an embodiment of the present invention;

FIG. 31 depicts an example instant win scratch off ticket game system according to an embodiment of the present invention;

FIG. 32(*a*) depicts sample rules for an instant win scratch off ticket game with a conditional secondary game according to an embodiment of the present invention;

FIG. 32(*b*) depicts sample rules for an instant win scratch off ticket game with a conditional secondary game according to an embodiment of the present invention;

FIG. 32(*c*) depicts sample rules for an instant win scratch off ticket game with a conditional secondary game according to an embodiment of the present invention;

FIG. 32(*d*) depicts sample rules for an instant win scratch off ticket game with a conditional secondary game according to an embodiment of the present invention;

FIG. 32(*e*) depicts sample rules for an instant win scratch off ticket game with a conditional secondary game according to an embodiment of the present invention;

FIG. 33(*a*) depicts a first part of a scratch off ticket instant win game with conditional secondary game process flow diagram according to an embodiment of the present invention;

FIG. 33(*b*) depicts a second part of the scratch off ticket instant win game with conditional secondary game process flow diagram according to an embodiment of the present invention;

FIG. 34(*b*) depicts a second part of the scratch off ticket instant win game with conditional secondary game process flow diagram according to an embodiment of the present invention;

FIG. 35 depicts an example of a typical blank pick-3 selection ticket according to an embodiment of the present invention;

FIG. 36 depicts an example of a typical completed pick-3 selection ticket according to an embodiment of the present invention;

FIG. 37 depicts an example of a typical pick-3 lottery ticket according to an embodiment of the present invention;

FIG. 38 depicts an example of the conditional secondary game registration screen used on the secondary game kiosk or web application according to an embodiment of the present invention;

FIG. 39 depicts an example of a mechanical version of a publicly verifiable entropy source according to the present invention;

FIG. 40 depicts an example of a schematic drawing of an electronic version of the publicly verifiable entropy source according to an embodiment of the present invention;

FIG. 41 depicts a method for electronically selecting and displaying a publicly verifiable entropy source according to an embodiment of the present invention;

FIG. 42 depicts an example of a method for determining a switch closure for selecting the 1st digit of a publicly verifiable entropy source according to an embodiment of the present invention;

FIG. 43 depicts an example of a method for determining a switch closure for selecting the 2nd digit of a publicly verifiable entropy source according to an embodiment of the present invention;

FIG. 44 depicts an example of a method for determining a switch closure for selecting the 3rd digit of a publicly verifiable entropy source according to an embodiment of the present invention;

FIG. 52 depicts an electronic screen layout for player's information submission to enter a secondary game according to an embodiment of the present invention;

FIG. 53 depicts an electronic confirmation screen providing a player with a transaction number and a date and time for the publicly verifiable pick-3 drawing according to an embodiment of the present invention;

FIG. 54 depicts an electronic transaction number submission screen according to an embodiment of the present invention;

FIG. 55 depicts an electronic screen showing secondary game results of a player based on the transaction number of the player according to an embodiment of the present invention;

FIG. 56 depicts an electronic screen permitting the player to select and submit a pick-3 number for a new entry into a secondary game according to an embodiment of the present invention;

FIG. 57 depicts a flow diagram for a process of a player purchasing an electronic scratch card and conditionally selecting a game mode and pick-3 number to enter in the secondary game function according to an embodiment of the present invention;

FIG. 58 depicts an electronic screen allowing a player to purchase an electronic scratch off card according to an embodiment of the present invention; and FIG. 59 depicts an image of a purchased electronic scratch off card with all hidden indicia exposed according to an embodiment of the present invention.

DETAILED DESCRIPTION OF THE INVENTION

Figure 34B:
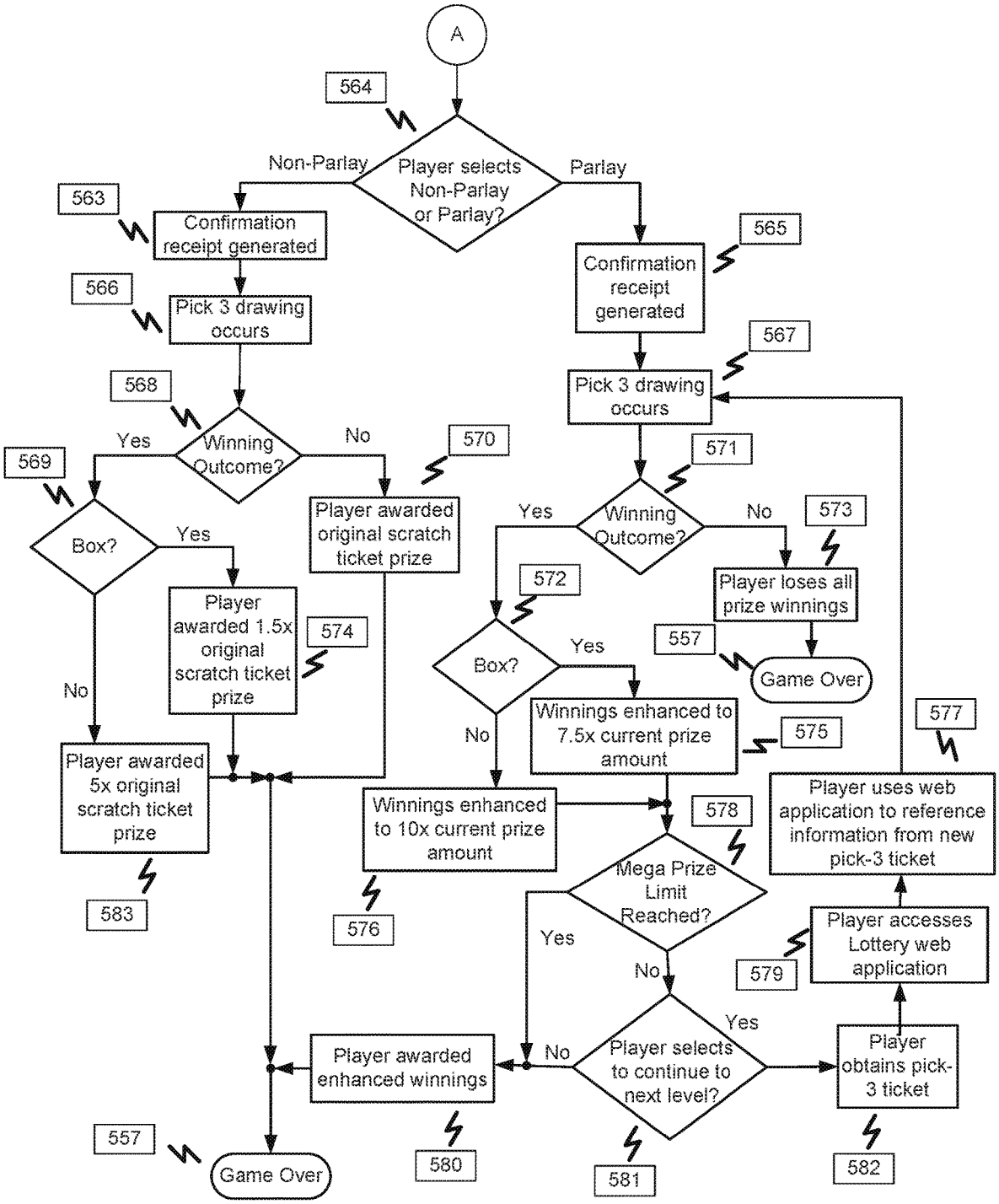
FIG. 34(*a*) depicts a first part of a scratch off ticket instant win game with conditional secondary game process flow diagram according to an embodiment of the present invention.

Generally disclosed herein is a system and method to increase the operational lifetime of a scratch off ticket instant win lottery game by incorporating a conditional secondary game function. The secondary game function permits lower tier monetary prizes to be converted to upper tier prizes (Grand Prize) using an "A Priori" probabilistic method. Effectively, this adds more grand prizes to the game which can increase the temporal "lifetime" of the instant win game. Increasing the game lifetime will effectively increase the number of tickets sold prior to the game's termination (all grand prizes have been claimed thus concluding the game) and therefore improves the gross income of the game. If eligible for a prize upgrade, the game participant can play a secondary game at an officially sponsored lottery kiosk. In the event there is a "No Win" outcome on the secondary game play, the game participant keeps the original monetary prize awarded by the scratch off ticket and the player enters an extended playoff round supported by a leaderboard tracking system (if available).

FIG. 1 depicts an example of an instant win scratch off ticket game system without a conditional secondary game. A game specification 1 and a set of game rules (not shown) define the characteristics of the scratch off ticket game. The lottery office 2 coordinates the printing and distribution of the lottery tickets to the authorized retailers 4, 5, 6. A game player 20 can purchase a lottery scratch off ticket 19 from one or more lottery retailers 4, 5, 6. The scratch off ticket 19 purchased by the player 20 is printed by the printing facility 3, and distributed to the authorized lottery retailers 4, 5, 6 via the main lottery office 2.

Depending on hidden indicia found on the scratch off ticket 19, the following options are available to the player 20 and the game ends for the player 20:

1) There is no winner amount. There is no further action required by the player 20.

2) The player 20 has won a monetary prize below a specific threshold (the state lottery commission sets this threshold) and is able to "cash in" the scratch off ticket 19 at a lottery retailer 4, 5, 6.

3) The player 20 has won a monetary prize above the specific threshold. The player 20 can mail in a claim form with their winning ticket 19 to the lottery office 2 to receive the monetary prize or directly visit the lottery office 2 and "cash in" a winning scratch off ticket 19.

FIG. 2 depicts a block diagram representing a lottery system capable of supporting a scratch off instant win lottery game with a conditional secondary game. The process of creating the scratch off game begins with the creation of the game specifications 1. The specification can be developed at a secure site external to the main lottery office 2. Communication of the game specification may occur using a secure data network 7.

Three game participants 16A-B, 17, 18 are shown interacting with the lottery system supporting the scratch off ticket instant win game with the secondary game feature. Player 18 has just purchased an instant win scratch off ticket 15 with the new secondary game feature from an authorized lottery retailer 6. Player 18 has revealed the indicia hidden on the scratch off ticket 15 by rubbing off the removable coating on the scratch off ticket 15. Player 18 has concluded that he has no winnings. To confirm that conclusion, player 18 can return to the authorized lottery retailer 6 and have them confirm the outcome by using an optical scanner to read the ticket information. The ticket information is communicated from the authorized lottery retailer 6 to the main lottery office 2 via a secure network 7 to confirm via the game database (not shown) in the lottery office 2 that the player 18 ticket is not a winner.

Player 17 has made a purchase of a scratch off ticket 14 from an authorized lottery retailer 5. After revealing the ticket 14 indicia by rubbing off the top coating on the ticket 14, player 17 has determined the scratch off ticket 14 represents a small win of $20. According to example game rules (described later with regards to FIGS. 13(*a*)-(*d*)), a $20 win is not entitled to a secondary game play to increase the winnings of player 17. The $20 win is below the threshold where player 17 would have to submit the ticket 14 to the lottery office 2 for payment (according to the example game rules in FIGS. 13(*a*)-(*d*)). Player 17 may seek payment of the winnings at any authorized lottery retailer such as 4, 5, 6.

Player 16A purchases a scratch off lottery ticket 13 from an authorized lottery retailer 4. After exposing the indicia on the purchased scratch off ticket 13, player 16A identifies that they are a $10,000 winner. According to the example rules of the game, the $10,000 prize is above the threshold allowing player 16A to take advantage of the secondary game monetary upgrade. To determine if the ticket 13 will be upgraded to a million-dollar win, player 16A must visit the lottery office 2 and play the electronic kiosk 8 providing a secondary game win opportunity. Player 16A inputs his or her personal details and optically scans the scratch off ticket at the kiosk 8. Once the player's 16A information, which includes information from the scratch off ticket 13, is loaded into and confirmed by the game database (not shown), player 16A may try their luck at the kiosk 8. The kiosk 8 indicates player 16A has just upgraded their winnings to $1,000,000 and leaves with their winnings becoming a million-dollar winner 16B.

The game file specifications 1 are shown as a building separate from the main lottery office 2. However, the building only represents a "placeholder" for development, where a secure computer system (physically and electronically secure) establish the specifications 1. This secure computer system is independent of the main lottery computer system associated with the lottery office 2. The main lottery computer system may reside at a "server farm", which constitutes a large number of computers (example 100 or more) that includes extensive internet secure communications. The main lottery computer system is designed to communicate with the at least thousands of lottery retail outlets (shown as examples 4, 5, 6). The main lottery computer system may also contain one or more computers which support large disk arrays and provides database functionality.

The secondary game kiosk 8 is shown in FIG. 2 to be located at the lottery office 2, but the kiosk (or multiple kiosks) could be at the retail outlets 4,5,6 or a separate location as well. However, regardless of where the kiosk 8 (or multiple kiosks) are, they will communicate to the main lottery computer system and update a database system of the main lottery computer system with secondary game results.

A printing computer located at a printing facility 3, which is separate from the specification computer system for the game specifications 1, identifies the unique contents for every single ticket being printed. For example, if there were 5,400,000 tickets being printed, there would be 5,400,000 records in the file. The ticket printing facility 3 should be both electronically and physically secure.

FIG. 3 is a process flow diagram demonstrating the typical process a player will perform to play and potentially win a prize, such as a grand prize or a grand prize using the secondary game feature of the game.

Step 200 starts the process. At step 201 the player purchases a scratch off ticket at a retail lottery store of their choice. In step 202 the player scratches off the ticket coating to reveal the underlying indicia. At step 203 the player examines the ticket to determine if there is any win combination. If there is no win combination, the play event is complete and therefore exit 204 occurs. Purchasing another ticket is the only option to "stay in the game".

If at step 203 the player determines they have a winner, the player needs to determine (according to the rules of the game which may state by example a specially marked ticket with a unique symbol or that a certain prize tier must be shown) if the win entitles them to a secondary game upgrade attempt, which occurs at step 205.

If the ticket is not eligible for a secondary game upgrade, at step 208, the player now has to determine if the ticket face value allows for payment at any lottery retailer or if the win amount is above a specific threshold set by the lottery commission (stated in the rules of the game). If the win amount is over the preset threshold, the player will have to mail in the scratch off ticket 213 or visit the main lottery office in order to redeem their winnings. The lottery database is updated at step 216, the lottery will issue a check for the winning amount at step 218, and the event is complete at step 221. If ticket prize value is below the threshold of local reimbursement, the player proceeds to an authorized lottery retailer to collect their winnings 209. The lottery retailer will inform the lottery office of the player's win status, where in turn the game database at the lottery office is updated with the player's win information 210. The player can then receive their winnings from the retailer in exchange for the winning ticket 214 and leave the retailer with their winnings, completing this event 215.

In the event the player's ticket winnings are eligible for enhancement by playing the secondary game feature, the player will have to travel 206 to the nearest secondary game kiosk, which for this example exists at the lottery office. Once at the lottery office, the player will provide their personal information to update the game database 207. The player will then proceed to play the secondary game 211 on the game kiosk. The win determination function (to be described in further detail with respect to FIG. 17) will decide, based on chance, if the player's winnings can be upgraded to the grand prize 212. In the event that the secondary game outcome is a win, the lottery game database is updated 217 and the player receives a check for the grand prize ($1,000,000 by example) 220. If the secondary game outcome was a "no win", the lottery will issue the winnings originally won on the scratch off ticket 219. This event then ends at step 222.

For the sample game that players, such as players 16A-B, 17, and 18, are participating in, FIG. 4 provides the sample game parameter values. The parameter values may vary from game to game and will be established as part of the game file specifications 1. In this example, there will be a total of 5,400,000 scratch off tickets printed for the game. The prize schedule in FIG. 4 shows the individual prize counts for each monetary prize tier. From the print run size and the tier level prize counts, the odds of purchasing a ticket at a specific tier level can be calculated. By example, there are just five $1,000,000 tickets available. This defines the odds of purchasing a ticket worth $1,000,000 at 5/5,400,000 or 1 in 1,080,000. As shown, there will only be 5 printed tickets with a face value of $1,000,000 (Grand Prize) for the sample game. This is also the case for the $100,000 ticket count.

FIG. 5 is a prototypical method flow chart for the population and randomization of the fifty prize pool arrays, to be performed by the secure computer system that establishes the game specifications 1. The function begins at "start" 23. The first step in the process is to call the subroutine prize_pool_determination 24 function. A table is loaded into memory which assigns a token number to each prize level 25. Variables called Pool_ID and Array_Pointer are initialized to zero 26, 27. The Pool_ID variable identifies which prize pool is currently being processed and the Array_Pointer variable identifies which element is currently being processed. The subfunction Prize Pool Population 28 is called next. Once the prize pool array is populated with the appropriate prize tokens, another subfunction is called to Perform a Durstenfeld Shuffle 29 to randomize the prize pool array. When the randomization is completed the Prize Pool_Array is stored 30 into the Lottery Office main database (not shown). The variable Pool_ID is incremented by one 31. The variable is then checked to see if it is equal to fifty 32 indicating if there are more prize pool arrays to populate and shuffle. If there are more arrays to populate the method begins to populate the next array 28; otherwise, the method ends 33.

FIG. 6 is the method flow chart used to determine which prize pools will contain the prizes which are less than one per pool as defined in the game specifications 1. This method is performed by the secure computer system that establishes the game specifications 1. In this example, the Prize Determination method will determine which prize pool array will contain the token numbers for the $1,000,000 (token #10) and $100,000 (token #9) prizes. The function enters at Start 35 and creates a temporary array of 50 elements and populates the positions with values between 0 to 49 representing the 50 prize pool arrays 36. The method next performs a Durstenfeld shuffle 37 to randomize the values of the array. When the shuffle is completed the first 5 array elements are retrieved 38A and will be used to indicate which prize pool will contain the token number for the prize of $1,000,000. The next five elements are retrieved and will be used for the assignment of the $100,000 token numbers 38B. The method returns 40 the values to the calling routine.

FIG. 7 is the flow chart for the method which populates each of the 50 prize pool arrays with the tokens for the prizes available to win. The process is performed by the secure computer system that establishes the game specifications 1. The method begins by creating a pool_array with 108,000 elements all assigned to zero 42 which is the token number for a non-winning scratch off ticket. The method then checks if the Pool_ID variable (which is passed from the calling array) indicates this is a pool array which receives the token for a $1,000,000 ticket 43. If so, the method replaces the element in the pool array at location of the array_pointer with token #10 44 before incrementing the array_pointer 45. The method next checks to see if this pool_array will contain the token for a $100,000 winner 46. If yes, the method updates the current element to #9 47 before incrementing the array_pointer 48. As there is one $10,000 winner per prize pool the method populates the next index with token #8 49. Not shown is the process of incrementing the array_pointer by the number of indexes updated, in this case the pointer is incremented by one. The next 86 indexes are populated with token #7 for the $1,000 winners 50 and the array_pointer is incremented by 86 also (not shown). The method populates the next 162 indexes with token #6 51, increments the array_pointer (not shown) before populating the following 549 indexes with token #5 52. The method continues the population of the specified number of indexes 53, 54, 55, 56 of the array and incrementing of the array pointer (not shown) for each prize level. The remaining indexes in the pool_array have already been initialized to zero, which is the token number for non-winning scratch off tickets. The method returns to the calling method 57.

FIG. 8 is a process flow chart for the creation and printing of the scratch off lottery tickets. The computer system at the printing facility will contain a program from the lottery office which would receive over a secure network all data required to create the scratch off tickets. This process flow would be a part of that program. The process would begin 58 by reading a text file which contains the text strings of the prizes available and storing them in a PrizeStrArray 59. The variables PoolCount and IndexPtr would be initialized to zero 60, 61. The PoolCount variable identifies which prize pool is currently being processed and the IndexPtr variable identifies which element is currently being processed. The first pool_array with an index of zero (pool_array(PoolCount)) is copied to a temporary array called CardArray( ) 62. This array contains the 108,000 elements of Token ID numbers. The token number located at CardArray(IndexPtr) is copied to a temporary variable named tokenNum 63. This will be used later in the element to determine if the scratch off ticket to be printed will be a winning or non-winning ticket. Based on the rules (FIGS. 13(*a*)-(*d*)) the range of numbers used for this game is 1 to 40, therefore an array called NumArray is created and populated with the number 1 to 40 at step 64. A Durstenfeld shuffle is then performed on the NumArray( ) 65. After the randomization is complete, the first 7 elements are copied to a new array called WinningNumArray 66. The next 20 elements will be copied to an array called YourNumArray( ) 67. These two sets of numbers will be printed in the scratch to reveal sections on the physical scratch off ticket in the "winning numbers" 153 area and the "your numbers" 154 area (to be described later with respect to FIG. 15). In step 68, the program communicates with a random number generator (RNG) to randomly select the prize that will be printed on the ticket.

Prior to printing however, the tokenNum variable is checked 69. If tokenNum equals zero, the ticket is a non-winning ticket and the process can go directly to the printing process. If the value is greater than zero the ticket should be a winner so the method must modify the YourNumArray( ) so one element matches an element in the WinningNumArray.

The method will first copy the text string for the winning prize from PrizeStrArray(tokenNum) to a temporary variable WinningPrize 70. The method will interface with a true random number generator (RNG) to select which index in the WinningNumArray( ) will be used as the matching numbers and will copy to a temporary variable called WinningNum 71. The method will next interface again to the RNG to determine which location in the YourNumArray will contain the matching number and will assign that to the WinningLocation variable 72. The method then replaces the number at the index YourNumArray(WinningLocation) with the number stored in the WinningNum variable 73. The program will also replace the text stored at WinningPrizesArray(WinningLocation) with the WinningPrize variable 74.

The various arrays associated with the Winning Numbers and Your Numbers area are now properly populated and the scratch off ticket can now be printed through a specialized printing process which will be known by those skilled in the art 75. Once the specialized printing process is completed, the indexPtr variable is incremented by one 75 and checked to see if it is equal to 108,000 at step 77. If IndexPtr is less than 108K, the module copies return to the step of reading the next TokenNum 63. If IndexPtr equals 108K, then all tickets in that prize pool have been printed and the variable PoolCount is incremented by one 78. The method then compares the PoolCount to 50 at step 79 to check if there are more prize pools left. If there are, control of the module returns to setting the IndexPtr to zero 61. If all 5,400,000 scratch off tickets have been printed, the method ends 80.

FIG. 9 shows a process flow chart for the Durstenfeld Shuffle function used to randomize the various data arrays. The process enters the function through the Start 83 block. Since various routines utilize this function, the Shuffle_Count variable must be set to equal the Array_Size 84 and the Array_Pointer variable is set to Array_Size−1 at step 85. Once a 32-Bit True Random Number is generated 86 a non-truncated biased modulus function is performed 87 to ensure the Random Number generated is within the range of 0 to Array_Pointer. The result of the modulus function is set to the Swap_Pointer 88 and the values in the array stored at Array_Pointer and Swap_Pointer are transposed 89. The variable shuffle_count is decremented by one 91 and checked to see if it is equal to zero 92. If shuffle_count is not equal to zero, there are more elements to shuffle so array_pointer is decremented by one 90 and the process repeats from the selection of the 32-bit number 86. Once shuffle_count equals zero, the shuffle of the array has been completed and the function can return 93 to the calling routine.

FIG. 10 shows an example of the Durstenfeld shuffle function on a six-element array. The initialization and population 94 of the array would be performed prior to this function being called and would be 0, 1, 2, 3, 4, 5. In Swap 1 at step 95, the variable "array_pointer" has been set to array_size−1 (refer to FIG. 9 block 85). A true random number has been generated (FIG. 9 block 86) and a modulus function has been performed (FIG. 9 block 87) resulting in R mod Pointer equal to two. The values in the array at position 5 ("array_pointer") and position 2 ("swap_pointer") are transposed (FIG. 9 block 89). Not shown is the shuffle_count variable being decremented by 1, determining shuffle_count is not zero, and decrementing the array_pointer (FIG. 9 blocks 91, 92, 90).

In Swap 2 at step 96 the result of the R (random number) mod Pointer ("array_pointer") is zero. Therefore, the values in the array at locations zero and four are transposed. Swap 3 at step 97 has R mod Pointer equal to one so the value "1" stored at array location one is transposed with "3" which is stored at array location three. Swap 4 at step 98 again has R mod Array_Pointer (now equal to two) equal to one. The two values at the array locations one and two have already been swapped by previous loops but are once again transposed to new locations. The routine continues through one more loop as Swap 5 at step 99. Once the values are transposed in swap 5, the function will decrement the shuffle_count and determine there are no more swaps to occur and will return to the calling function with the final contents 100 of the array being 5, 4, 3, 1, 0, 2.

FIG. 11 is a flow chart for the process of generating a true random number between the vales of 0 and "N". The process is performed by an RNG embedded computer connected to the computer system establishing the game specifications 1. The term true indicates that some physical source of noise or random behavior is being measured and an unsigned 32-bit digital number is produced. Some examples of physical random sources are nuclear decay of a radioactive material, white noise voltages produced by a resistor at a specific temperature, randomly phased oscillators being sampled, or semiconductor "shot" noise, to name a few examples. The key attribute of the various "noise" sources is that they are non-deterministic in terms of behavior and can only be described on a statistical basis. Usually the physical noise source is "whitened" using software to decorrelate sample values.

If left at an unsigned 32-bit integer, the random values would vary from 0 to 4,294,967,296.

When targeting specific probabilities, a modulus function is used to set the upper limit on the random outcome, by example 1 in 100. A modulus of 100 applied to the 32-bit raw random number value will produce a random value of 0-99. The modulus function is based on an arithmetic decision function generally expressed as: N/D, remainder R. By example, if N is 10 and D is 8, then R=2. For the purpose of random number generation, the modulus function introduces "truncation bias" which will affect the statistical outcome. The effect of truncation bias must be compensated for when producing random integer value between 0 and "N".

Step 103, 104 starts the function of generating a 32-bit unsigned random number between a value of 0 to "N", where N is an input variable defining the upper limit of the random number return. Step 105 determines an "ANDing" logical mask to be applied to the modulus "N" to correct for truncation bias (FIG. 12 will describe this in further detail below). Step 106 traps an error whereby the modulus is 0 and returns to the calling function at step 115. Step 107 starts the process of requesting an unsigned 32-bit hardware generated random number. Step 108 executes a suitable function to access the true random number generator. Step 109 applies the truncation correction bit mask.

Step 110 determines if the random number exceeds the modulus limit defined by the bit mask. If the random number is within the limits of the bit mask, the value is returned at step 113. If the random number exceeds the bit mask limit, the loop_count is incremented at step 111 and the loop_count limit is checked (64 in the example). If loop_count is 64 at step 112, then an error is declared at step 114, otherwise a new random number is selected, returning to step 108.

FIG. 12 provides details on creating a modulus bit mask in flowchart form. The modulus value is in a 32-bit unsigned format, which can be broken into four 8-bit groups (bytes). Each byte of the modulus is checked for a non-zero value 126, 129, 132, 135. If found, a bit mask will be resolved 128, 131, 134, 137 and the function exits 139. If all four groups are set to 0, then the modulus is set to 0, which is an illegal value. If a 0 modulus is detected, an error flag is set (zero_flag) at step 138 and the function exits 139. The index into a table containing the applicable mask is assigned to Table_Offset variable 127, 130, 133, 136.

FIGS. 13(*a*)-(*d*) represent an example of the rules associated with a conditional secondary game instant win scratch off game. The rules indicated the name of the associated game and a game ID number along with the cost to purchase a scratch off ticket from an authorized lottery retailer. The play symbols which may appear in the "Winning Numbers" and "Your Numbers" area are defined as well as the prize symbols to be used in those areas. Also defined are the available prizes that can be won on a scratch off ticket and the total number of tickets that will be printed for this game.

How and which prize a player wins is defined next in the rules. There is a table included in the rules that shows in more detail the prizes available to win, the odds of winning each prize and the number of tickets printed that will contain each of the prizes.

There should be a section in the rules which describe various aspects of the conditional secondary game drawing such as the eligibility to enter the secondary game and how the player would participate in the game. Also indicated is the maximum number of conditional secondary game winners (10). There is also a table which shows which prizes can be won in the conditional secondary game dependent on the original amount won on the scratch off ticket. In this example the player has a chance to win $1,000,000 if their original scratch off ticket was a winner for the amounts of $1000, $10000 or $100000. The table also indicates that odds of winning the secondary game based on the original win amount.

Some lotteries may offer retailer incentive awards and bonuses for selling lottery tickets specifically winning lottery tickets. If so, the details of these awards and bonuses will be described in the game rules. There is also a disclaimer indicating the time frame to redeem a winning scratch off ticket, which laws will be in effect for this game (which is typically the state where the lottery office is located), and how the player may redeem their winning scratch off tickets.

There is a disclaimer that the lottery office may announce a termination date which would end the sale of this games scratch off tickets. A termination date may be announced for several reasons such as a predetermined date or all top prize tickets have been redeemed.

FIG. 14 illustrates the front of a prototypical instant win or scratch-off ticket 150 for a lottery game series named "Dog Days of Summer" 152. The ticket measures approximately 4 inches wide×8 inches long, though this is not limiting and any dimensions can be used. In this example the "Dog Days of Summer" 152 lottery game series has 5 top prizes of $1,000,000 151.

There are multiple scratch-to-reveal areas on this scratch off ticket 153, 154, 156 which are shown in their initial state (unrevealed). In this example, scratch-to-reveal area "winning numbers" 153 contains the numbers that must be matched in the "your numbers" area 154 for the player to win prizes. Area 155 of the scratch off ticket 150 gives the player a brief description of how to win prizes. If any number revealed in "winning numbers" area 153 are revealed in the "your numbers" area 154, the player will win the amount shown under the matching number.

A control number 157 which typically indicates the ticket position on a roll of tickets is shown in the lower left corner of the ticket. In this example the control number 157 indicates the ticket was the twelfth ticket on the roll. The "scratch to cash" area 156 is another scratch-to-reveal area. When revealed, this area 156 typically displays a type of bar code used to electronically scan the ticket and to verify if the scratch off ticket 100 is a winning or non-winning ticket as stored in the lottery authority's central database.

FIG. 15 illustrates the front of the scratch off ticket 150 for the lottery game "Dog Days of Summer" 152. In this figure, the scratch-to-reveal areas 153, 154, 156 are in their final state with the hidden indicia revealed. The winning number area 153 shows the seven numbers that can be matched for the player to win prize(s). In this example the player can win a prize if any of "36, 2, 17, 8, 14, 38, 22" are also shown in the "your numbers" area 154. There are twenty numbers allocated to the player in the "your numbers" area 154. In this example the number "14" appears in both the "winning numbers" area 153 and the "your numbers" area 154 allowing the player to win the prize amount shown below the number "14" in the "your numbers" area 154. In this example the winning amount is $10,000. Referring to FIG. 13(*a*)-(*d*) "Sample Rules", this ticket would allow the player to use the secondary game kiosk to possibly increase their winnings to $1,000,000.

A quick response (QR) code 158 is revealed in the "scratch to cash" area 156 in the lower right corner of the scratch off ticket. This code can be electronically scanned with an optical scanner at an authorized lottery retailer and/or at the secondary game kiosk to confirm the ticket is valid and has not been previously redeemed.

The disclosure of a ticket sales maximization method and system using a secondary game constitutes the improvement over the prior art instant win scratch off ticket games.

There are at least two fundamental variants (embodiments) of the secondary games that may be deployed. Both embodiments are designed to increase the number of grand prize tickets by upgrading lower tier monetary prizes to a grand prize value conditionally, using an a priori method with true random number generators.

The first variant for the secondary game feature uses a Bernoulli Trial to produce a win or no-win outcome.

The second variant of the secondary game produces a score for the player using, by example, dual spinning wheels whereby, the stop positions of the wheels are combined algebraically. By example, two wheels are implemented in a video format using a computer application program to execute the procedures required. Both wheel one and wheel two have 32 slots labeled 0 through 31. The formula used to generate a random number between 0 and 1023 is:

$$X=(32\times N)+M$$

While this example uses a linear equation, it is not intended to be a limitation for the invention. Other formulations can be used such as exponential, quadratic, etc.

The variable "X" represents the final random value. The variable "N" represents the slot position on wheel one (0-31). Variable "M" represents the slot position of wheel two (0-31). A true random number generator with a modulus of 32 is used to generate the values "M" and "N". The software application will render the video image to simulate wheel movement and have the wheels "stop" at a final location based on the random values of "N" and "M".

The "scoring" feature of the second embodiment of the secondary game feature permits further flexibility when providing for multitier winner upgrades. Number ranges such as "0-50" to upgrade a $1,000 win or "51-70" to upgrade a $5,000 win can be implemented with this method. Also, for tertiary competitions, such as no-category (range 500-1023 upgrade by example), can be used as a final playoff and prize upgrade option.

By policy, the secondary win upgrade feature may guarantee one or more players will have their monetary winnings value transformed into a grand prize. However, it is possible that the secondary game methods described herein may not produce an upgraded winner based on the probabilistic nature of the secondary game process. As such, a further system element and method may be added using a leaderboard to keep track of players that failed to receive an upgrade to their scratch off winnings. After all the potentially upgradable tickets have become sold and/or played, a determination is made to identify any upgrade winners. If none are found, then the players placed in the leaderboard may replay the secondary game on a FIFO (first in, first out) basis.

FIG. 16 is a block diagram of a subsystem identified as the secondary game kiosk 8. The kiosk 8 is a subsystem which communicates with the lottery office 2 computer system and database (not shown). The kiosk may include the following elements:

The computer system 170 contains a central processing unit, hard disk drive, and sufficient random-access memory (RAM). The software operating system may be a Microsoft version of Windows, Linux or Unix, or a suitable software system applicable to the kiosk 8. A custom application program 175 will interact with the various physical elements of the kiosk 8 (as seen below). The kiosk 8 may maintain a local database 173 to record transactions for secondary game play events.

Part of the kiosk 8 is a screen 171, such as an LCD screen, which serves multiple kiosk 8 functions such as player information entry or allowing a player to participate in the secondary game opportunity. In FIG. 16 the secondary game example is that of an electronic slot machine. The slot machine represents an example of a secondary game implemented as a Bernoulli trial outcome. Other games of chance can be incorporated and the use of a slot game of chance is not to be considered limiting.

The optical scanner 172 is used to read critical information found printed on the player's scratch off ticket. The ticket information may be stored in the kiosk 8 local database 173 as well as confirmed and stored in the lottery office 2. The ticket information is verified from the ticket information used in the initial printing process at the ticket printing facility 3.

A printer 174 is used to provide a receipt for the game player indicating that they had played the secondary game. The receipt will include the time and date the secondary game was played, as well as key ticket information and the outcome of the secondary game once played.

The mouse 176 and keyboard 178 are standard input devices for the kiosk 8 that permit player information to be logged into the kiosk 8 prior to the player playing the secondary game. The mouse 176 and the keyboard 178 are also required when an authorized technician is performing maintenance on the kiosk 8. It should be noted that the mouse/keyboard functionality can also be incorporated into the screen 171 as a touchscreen.

The momentary push button 180 is connected to the kiosk 8 using a standard interface such as USB. The player will press the button to activate the play sequence of the secondary game. This can also be implemented in the screen 171 as a touchscreen.

The internet connection 179 is used to communicate with the lottery office computers (not shown).

The secondary game enhancement uses an entropy source (such as random number generator 177) to determine if a player's winning amount will be upgraded to a higher value.

The application program 175 is the custom software to implement the secondary game, as well as manage local database 173 information and communicate with the lottery office 2 using the internet portal 179.

It should be understood that the kiosk 8 in the example system is located in the lottery office 2. However, this is by example only, in that multiple kiosks 8 can be supported. By example, every authorized lottery outlet 4, 5, 6 may have a secondary game kiosk 8 at their physical location, or a secondary game kiosk 8 could be at any other alternative location. In the event that multiple kiosks 8 are deployed throughout the system, each kiosk 8 will have a unique electronic identifier.

FIG. 28 depicts an example of a server farm associated with the lottery office 2. The server farm is illustrated simply for exemplary purposes and is not intended to be limiting. The server farm includes any number of web devices 1 through N, illustrated here as web device 350A and web device 350B. The web devices are connected via the Internet 358 to a hardware load-balancing server 354 through a router 353, firewall 352, and TCP/IP 351. The hardware load-balancing server 354 and a raid disk subsystem 355 is connected to any number of webserver computers, illustrated here as computers 357A-D, via a LAN switch 356.

FIG. 29 depicts an example of a specification computer system associated with the game file specification 1. The specification computer system is illustrated simply for exemplary purposes and is not intended to be limiting. A computing system 362 is connected to the Internet 358 through a firewall 359 and a printer 361. The computing system 362 includes a hardware based true random number generator 360, as well as an instant win ticket specification file 363, a specification image print file 364, and custom application software 365.

FIG. 30 depicts an example of a printing computer subsystem associated with the printing facility 3. The printing computer subsystem is illustrated simply for exemplary purposes and is not intended to be limiting. A computing system 368 is connected to the Internet 358 through a firewall 366 and a printer 369. The computing system 368 includes a print file utility 370 for receipt of a specification image print file for instant win ticket print off 367.

FIG. 17 is a flow chart of a function to determine an outcome for the secondary game feature. While the function is a preferred embodiment to be incorporated in the secondary game, it is not intended to be a limiting element. Other sources of random number generation can be substituted, whether electrical or mechanical, so long as the probability can be controlled by a modulus function.

The function is entered at step 230. Step 231 determines the probability coefficient for a win based on a stored table as shown by example in FIG. 18. By example, if the player's ticket indicating an initial win value of $1,000, the probability coefficient is 0.0016. In step 232, the modulus is computed by inverting the probability coefficient, once again with a coefficient of 0.0016; the modulus is 625. Step 233 ensures that the modulus is in a fixed unsigned 32-bit integer format. It should be noted that rather than storing the probability coefficient, the 32-bit modulus can be stored in the secondary game control table as seen in FIG. 18. At step 234 a 32-bit unsigned random integer number is "drawn" from the random number generator 177. This number has the modulus applied to it and is defined as the "target number". In the current example, the random number will be between the values of 0 and 624. In step 235, a second random number is selected with modulus applied. The resulting 32-bit unsigned integer will also be a number between 0 and 624 and defined as the "match value". At step 236, a comparison is made between "target value" and "match value". If they are equal, step 238 occurs and a secondary game win is declared. If "target value" and "match value" are not equal, then step 237 sets the winner status to "no winner". Step 239 returns the win status to the calling routine.

FIG. 18 is an example of a secondary game control table. In this example there are nine prize levels for the secondary game feature for the scratch off ticket game. Level 1 is the grand prize and level 9 is the minimum non-zero prize. The prize amounts are identified for reference purposes with each prize level. The probability of enhancing a non-grand prize is identified as a probability coefficient with each prize level. Although not shown in the example, it may be desired to have a "next level" probability coefficient. By example, going from level 5 to level 4. The reciprocal of the probability coefficients become a modulus value required to compute random number value in the secondary game win determination function. The modulus value for each prize level can optimally be stored in the control table.

FIG. 19 is an example of the secondary game implemented as a slot machine, where the player has just pressed the spin button 180 and a "no winner" outcome was determined. The secondary game includes a video slot machine first reel 250, video slot machine second reel 251, a video slot machine third reel 252, a reel stop pointer 253, and a no winner game result 254. FIG. 20 is the secondary game implemented as a slot machine, where the player has just been upgraded to a $1,000,000 winner. Instead of a no winner game result, the secondary game instead shows a one million dollar winner game result 256.

FIG. 21 is the secondary game implemented as a dice roll (another example of an Bernoulli trial type secondary game). In this example the outcome was a "no winner" due to the fact the dice do not match. The secondary game includes a second chance feature 260, a first die 261, and a second die 262. FIG. 22 is the secondary game where a win has occurred (dice match).

FIG. 23 shows the secondary game implemented as a card draw game. As seen in this example, the cards do not match and a "no winner" outcome has occurred. The secondary game includes a card draw game example (card match by example) 270, a first card 271, and a second card 272. FIG. 24 shows the card draw where the cards match and a "win" has occurred.

FIGS. 19, 20, 21, 22, 23, and 24 illustrate some of the various electronic secondary game variations. The gaming examples are not to be considered a limitation to the overall invention disclosed herein and other gaming variations may be implemented.

In another embodiment, the game player has the opportunity to upgrade their base prize to one of several prizes of a higher value. While a video solution for this embodiment is shown, it should not be considered a limiting factor. The kiosk system utilized in this embodiment includes all components previously described with the exception that the app 175 would be a custom implementation. The app 175 would contain a control table (described below with respect to FIG. 26), which would provide the a priori probabilities for each prize tier above the predetermined prize level or tier required to gain an attempt on the secondary game.

FIG. 25 depicts an implementation of a preferred embodiment utilizing a "Double Wheel Summation" variation. The wheels 301, 303 are divided equally into 32 areas which allows for 1024 possible outcomes (32×32). The 32 areas on the right wheel 303 are numbered between 0 and 31 incremented by 1. The areas on the left wheel 301 are numbered between 0 and 992 incremented by 32.

FIG. 26 shows an example of the control table which could be utilized in this embodiment. Based on this control table, a Tier 5 prize would need to be revealed on the scratch off instant win lottery ticket 150 for the game player to enter the secondary game. The player will have the opportunity to upgrade their winnings to either $10000, $25000, $100000 or $1 Million. The a priori probabilities of upgrading to the respective prize tiers are 66.67%, 16.67%, 10% and 10%.

Referring back to FIG. 16, when the player presses the spin button 180, the app 175 will interface with Secure RNG 177 to select a number between 1 and 1024. This determines which prize tier will be awarded to the player based on the odds from the control table in FIG. 26. For example, based on the 10% probability of upgrading to Tier 2, if the random number is between 102 and 203 (range equals 1024*0.1), the player's prize will be upgraded to $100,000.

Referring again to FIG. 25, while the table 304 is shown to assist the player in determining their prize, it also reflects the probability ranges used by the app 175. Once the app 175 randomly selects the ending value, it will determine the stop positions of each wheel 301 303 so that the values on each wheel indicated by the pointers 302 will add up to the random value selected. In this example, the app 175 selected via the RNG 177 the value of 270. The app 175 then determined the left wheel 301 would stop on slot 9 with the pointer 302 indicating the value of 256 and the right wheel 303 would stop on slot 15 with the pointer 302 indicating the value of 14. Adding the two values (256 and 14) together, the app 175 would display 0270 in the display area 300. The kiosk 8 computer would use the table 304 to determine 270 is between 204 and 373 indicating they upgraded their winnings to the tier 3 prize, which in this embodiment is $25,000.

FIG. 27 shows a sample of a possible leaderboard feature for the secondary game. A further enhancement that may be offered and would be predefined in the game rules would be the allocation of a minimum number of grand prizes to be awarded by the secondary game. To guarantee a minimum number of wins but not skew the odds, a leaderboard feature could be implemented. The leaderboard 316 is shown implemented as a screen on the secondary game kiosk but it could be implemented as a website style page for remote public viewing. The game status 310 shows that sales of the scratch off instant win tickets is still active. "Sales Ended" and "Game Ended" may be additional statuses of the game. Prizes still available 311 shows there are still two guaranteed tier 1 prizes to win from the secondary game. This also indirectly indicates the leaderboard is still active. If the minimum or guaranteed prizes are all awarded, the leaderboard, depending on the game rules, may be null and void. Last date to claim prize 312 is shown as TBD (To Be Determined).

This is due to the fact that ticket sales are still active. Typically, players have up to one year after the end of ticket sales to claim any prizes won on the scratch ticket and thus claim the chance to play the secondary game. The sample leaderboard shows the top five "non-winning" scores achieved on the secondary game. To provide privacy to the player but to still allow them to follow their standings in the leaderboard, the players first name and last initial and their resident city is shown 313. A unique identifier would be the ticket control number 314 of the scratch off ticket which was read by the optical scanner of the secondary game kiosk. Finally, displayed for each player would be their score achieved in the secondary game 315. If the minimum number of prizes haven't been awarded when the last date to claim prizes has passed, the lottery will issue the grand prize amount to the top player. If there are more than one player with the top score, the lottery may opt for a spin off event until only one player has a top score. The lottery may also issue each player the top prize or divide the top prize equally between the players.

As such, generally disclosed herein is a system and method to increase the operational lifetime of a scratch off ticket instant win lottery game by incorporating a conditional secondary game function. The secondary game function permits lower tier monetary prizes to be converted to upper tier prizes (Grand Prize) using an "A Priori" probabilistic method. Effectively, this adds more grand prizes to the game which can increase the temporal "lifetime" of the instant win game. Increasing the game lifetime will effectively increase the number of tickets sold prior to the game's termination (all grand prizes have been claimed thus concluding the game) and therefore improves the gross income of the game. If eligible for a prize upgrade, the game participant can play a secondary game at an officially sponsored lottery kiosk. In the event there is a "No Win" outcome on the secondary game play, the game participant keeps the original monetary prize awarded by the scratch off ticket and the player enters an extended playoff round supported by a leaderboard tracking system (if available).

Further generally disclosed herein are alternative embodiments of systems and methods to increase the operational lifetime of a scratch off ticket instant win lottery game by incorporating a conditionally secondary game function. In these alternative embodiments, the secondary game may have one or more of the following attributes.

First, a secondary game rules enhancement, referred to as prize amplification, makes it possible to win a prize amount larger than the game grand prize. The larger prize may be defined as a "mega prize". The game rules may restrict prize amplification to only occur once all of the allotted grand prize tickets have been accounted for.

Second, the random number generator used may be based from a publicly verifiable entropy source. Publicly viewed games such as a Pick-3, Pick-4, Pick-5, Pick-6, or keno games represent examples of publicly verifiable entropy sources. Entropy is defined as a measure of the disorder of a random variable. Each of these games uses a random number generator to generate a winning number or combination of numbers. The game "drawing" is in public view (for instance, televised). An example of using a publicly verifiable entropy source is the Pick-3 game. When used as a secondary game, a player wins a lower tier prize on their scratch off ticket, they may enter into a secondary game by selecting 3 numbers or have a 3-digit number issued by using a computer-generated number for a Pick-3 game.

Third, the secondary game may provide for a "parlay" secondary game play. Parlay is defined as a combination of multiple individual wagers so that the original monetary stake plus winnings are risked on a successive wager. The player must win the entire combination of wagers to win the final wager. Once one or more parlay wagers are made, there are no refunds. Non-parlay is defined as a single game play where the original monetary stake is not risked (lost) on a non-winning outcome. Prize enhancement is typically lower for non-parlay game play as compared to parlay.

FIG. 31 is a block diagram representing a lottery system capable of supporting a scratch off instant win lottery game with a conditional secondary game using a publicly verifiable entropy source. FIG. 31 exemplifies the system elements required to implement the secondary game using a publicly verifiable entropy source.

The system and method for creating the scratch off game begins with the creation of the game specifications 501. The specification can be developed at a secure site external to the main lottery office 502. Communication of the game specification may occur using a secure data network 507.

FIG. 31 additionally shows a game participant 520 interacting with the lottery system supporting the scratch off ticket instant win game with the new secondary game featuring a publicly verifiable entropy source. Player 520 has just purchased an instant win scratch off ticket (not shown) with the secondary game feature from an authorized lottery retailer (here, from retailer 505, though retailers 504 and 506 are included as additional places to purchase tickets). After exposing the indicia on the purchased scratch off ticket, player 520 identifies that they are a $10,000 winner. According to the rules of the game (as depicted in FIGS. 32(*a*)-(*e*), as a nonlimiting example), the $10,000 prize is above the threshold allowing player 520 to take advantage of a secondary game prize amplification feature.

Player 520 returns to a lottery retailer 504, 505, or 506 and submits a completed Pick-3 selection ticket 584. The retailer will enter the player's 520 selection ticket 584 information and will provide the player 520 with a Pick-3 (example)

Lottery ticket 588 for a future drawing. Using a web application 523 or a secondary game kiosk 522, the player will submit their personal information along with the registration number from the scratch off ticket 584 and the registration number from the pick-3 lottery ticket 588. The player 520 will also be able to select parlay or non-parlay. The player 520 must submit the information prior to the occurrence of the pick-3 drawing identified on the pick-3 lottery ticket 588. Upon successful submission of the information, a confirmation receipt number is generated by the system and displayed on the web application 523 or kiosk screen 522.

At a future date, the lottery office 502 will perform a Pick-3 Drawing using the pick-3 random number generator 521. If the 3 digit number shown on the player's pick-3 lottery ticket 588 match the result from the pick-3 drawing in either straight (exact sequence of the numbers) or box (numbers may appear in any order), the player's 520 winnings are multiplied based on the rules and player's 520 selection of parlay or non-parlay. The Pick-3 number may be mechanically or electronically generated. The number selector is viewable by the public and is therefore a publicly verifiable entropy source.

FIG. 32 represents an example of the rules associated with an instant win scratch off game with a conditional secondary game using a publicly verifiable entropy source. By non-limiting example, a Pick-3 lottery game can serve as the publicly verifiable entropy source. Other game types such as but not limited to Pick-4, Pick-5, Pick-6, and keno games may also provide a publicly verifiable entropy source.

FIGS. 33(*a*)-(*b*) depict a flow diagram of the steps that will occur if a player's scratch off card has met the criteria for participating in a secondary game and the player chooses to register their entry into the secondary game using the web portal 523.

Step 524 starts the process of player participation where the player purchases a scratch off lottery ticket. In step 525, the player reveals the indicia hidden under the ticket's scratch off material.

In step 526, the player determines if they have a winning ticket. If no winners are revealed after the "scratch off", the game is done with respect to that specific scratch off ticket 530. However, if an intermediate prize value is disclosed, step 528 occurs where the player determines if the intermediate prize is equal to or greater than $1,000 (the threshold of $1,000 is set by example rules and should not be interpreted as a limitation for the invention). If the intermediate prize amount is less than $1,000, the player can collect their winning amount 529 and the game is over 530 with respect to the player's current scratch off ticket (a player may buy a new scratch off ticket and try again).

If the intermediate prize is greater than or equal to $1,000, at step 531 the player must now obtain a Pick-3 ticket to enter into the secondary game contest to potentially boost their winnings to a value higher than the maximum identified by the scratch off ticket. At step 532, the player must enter key information using the web application. At step 533 the player enters personal information and key information, which will bind the reference number of the scratch off ticket to the reference number of the pick-3 lottery ticket.

At step 534, the player must decide if their secondary game entry is to be interpreted as parlay. If the player selects non-parlay and selects the submit box, at step 535, the system will provide a receipt number (displayed on the player's electronic device). The player will have to provide this receipt number to the lottery office 502 in the event they wish to collect their winning prize after the Pick-3 drawing occurs at step 537.

A winning outcome is calculated at step 539 when the Pick-3 number selected by the player matches the Pick-3 drawing result. Further, a winning multiplier is calculated at step 541 whether the Pick-3 number is "box" or "straight". If the match is "box", the multiplier is set to 1.5× at step 545. For a "straight" match, the multiplier is set to 5× at step 547. It is to be noted these multiplier numbers are by example only and not intended to be limiting. If the player has neither a box or straight match to the Pick-3 drawing, they will be entitled to a prize value equal to the scratch off ticket intermediate prize at step 542. Both primary and secondary game play are now complete for the player (game over at step 530).

In the event the player selected parlay at step 534, the system will generate a confirmation number and display it on the player's electronic device at step 536. At step 538, a pick-3 drawing occurs with the player checking the outcome of the pick-3 drawing at step 540. If there was neither a box or straight match to the player's Pick-3 selection 531, the player loses all winnings at step 544 and the game is over at step 530.

However, if a match occurs at step 543, the player's current winnings are increased depending on whether the match is "box" or "straight". The player's current winnings are increased 7.5-fold at step 546 if the match is "box". Alternatively, if a "straight" match occurs, the player's current winnings are increased by a factor of 10 at step 548. These multipliers are by example only and not intended to be limiting.

A player who has selected to participate in the parlay variation of the secondary game is subject to a finite limit of parlay increases up to a mega prize amount based on the game rules. Therefore, there is a limit on how many times they may potentially boost their winnings from the intermediate prize awarded on the instant win scratch card. If the mega prize limit is reached at step 550, the player will be entitled to collect their enhanced winnings at the lottery office at step 552. Then, the game is over at step 530. If the mega prize limit is not reached at step 550, the player then chooses if they wish to continue future parlay attempts at step 553.

If they choose to forego future parlay attempts, they may collect their enhanced winnings at step 552 and the game is considered over at step 530. If the player chooses another parlay attempt, the player must obtain a new Pick-3 ticket at step 554, access the webpage at step 551, and enter the latest Pick-3 reference information at step 549. The process will then repeat from step 538 and the system will keep track of the player's parlay attempts for when step 550 is reached again. As parlay involves a significant risk for the player, it is preferable that the mega prize is only winnable through a parlay.

FIGS. 34(*a*)-(*b*) depict a flow diagram of the steps that will occur if a player's scratch off card has met the criteria for participating in a secondary game and chooses to register their entry into the secondary game using the secondary game kiosk 522.

Step 555 starts the process of player participation where the player purchases a scratch off lottery ticket. In step 556, the player reveals the indicia hidden under the ticket's scratch off material. In step 527, the player determines if they have a winning ticket. If no winners are revealed after the "scratch off", the game is done with respect to that specific scratch off ticket at step 557.

However, if an intermediate prize value is disclosed, step 558 occurs where the player determines if intermediate prize is equal to or greater than $1,000 (the threshold of $1,000 is set by example rules and should not be interpreted as a limitation for the invention). If the intermediate prize amount is less than $1,000, the player can collect their winning amount at step 559 and the game is over at step 557 with respect to the current scratch off ticket (a player may buy a new scratch off ticket and try again).

If the intermediate prize is greater than or equal to $1,000, the player must now obtain a Pick-3 ticket at step 560 to and visits a local lottery office or retailer at step 561 to enter into the secondary game contest to potentially boost their winnings to a value higher than that identified by the scratch off ticket. The Player must now enter key information using the secondary game kiosk at step 562 which will bind the reference number of the scratch off ticket to the reference number of the pick-3 lottery ticket. The player will also provide personal information.

The player must decide if their secondary game entry is to be interpreted as parlay or non-parlay at step 564. If the player selects non-parlay and selects the submit box, the system will provide a receipt number at step 563. The player will have to provide this receipt number to the lottery office in the event they wish to collect their winning prize after the Pick-3 drawing occurs at step 566.

A winning outcome is calculated at step 568 when the Pick-3 number selected by the player matches the Pick-3 drawing result. Further, a winning multiplier is calculated at step 569 whether the Pick-3 number is "box" or "straight". If the match is "box", the multiplier is set to 1.5× at step 574. For a "straight" match, the multiplier is set to 5× at step 583. It is to be noted these multiplier numbers are by example only and not intended to be limiting. If the player has neither a box or straight match to the Pick-3 drawing, they will be entitled to a prize value equal to the scratch off ticket intermediate prize at step 570. Both primary and secondary game play are now complete for the player (game over at step 557).

In the event the player selected parlay at step 564, the system will generate and print a confirmation receipt 565. At step 567, a pick-3 drawing occurs with the player checking the outcome of the pick-3 drawing at step 571. If there was neither a box or straight match to the player's Pick-3 selection, the player loses all winnings at step 573 and the game is over at step 557.

However, if a match occurs at step 572, the player's current winnings are increased depending on whether the match is "box" or "straight". The player's current winnings are increased 7.5-fold at step 575 if the match is "box". Alternatively, if a "straight" match occurs, the player's current winnings are increased by a factor of 10 at step 576. These multipliers are by example only and not intended to be limiting.

A player who has selected to participate in the parlay variation of the secondary game is subject to a finite limit of parlay increases up to a mega prize amount. Therefore, there is a limit on how many times they may potentially boost their winnings from the intermediate prize awarded on the instant win scratch card. If the mega prize limit is reached at step 578, the player will be entitled to collect their enhanced winnings at the lottery office at step 580. If the mega prize limit is not reached at step 578, the player then chooses if they wish to continue future parlay attempts at step 581.

If they choose to forego future parlay attempts, they may collect their winnings at step 580 and the game is considered over at step 557. If the player chooses another parlay attempt, the player must obtain a new Pick-3 ticket at step 582, and utilize the secondary game kiosk at step 579 to enter the latest Pick-3 reference information 577. The process will then repeat from step 567 and the system will keep track of the player's parlay attempts for when step 578 is reached again.

FIG. 35 depicts a prototypical Pick-3 submission form 584 that a game player 520 would fill out to identify their Pick-3 selections. The first, second, and third columns 585 represent the participant's three numbers for a specific game. In order to be registered in a game, the form should be submitted to a lottery retailer. The checked off boxes "Straight" 586 and "Box" 587 identify how the participant wishes their Pick-3 selection to be interpreted. "Straight" indicates an exact number. "Box" indicates any combination of the three numbers. A player may select either or both ways to play their numbers. FIG. 36 is a specific example where the participant wishes to play the number 256 and has selected to play both Straight (literal) and Box (combination).

FIG. 37 depicts a sample of a typical Pick-3 ticket 588 produced at a retail lottery site 504, 505, 506. The Pick-3 ticket 588 displays the date and time of the player's Pick-3 number selection that was electronically entered into the lottery's network 589, the player's 3 digit number and straight/box selections 590, the amount paid for the ticket 591, a barcode encoded with the previous information 593, and the date and time for the drawing 592.

FIG. 38 depicts an illustrative example of the electronic submission form for the webpage and kiosk (the form is identical for both submission methods). Fields for entry on the submission form may include but are not limited to: the player's name 594, the player's address 595, the player's phone number 596, the scratch off ticket registration number 597, the Pick-3 registration number 598, and the player's selection to play the secondary game using the parlay 599 or non-parlay 600 methods. Once the fields in the electronic form are filled in, the player may select the "submit" button 601 to register the secondary game entry. The player will then receive a receipt number for the submission 602.

FIG. 39 depicts a pictorial drawing of an example Pick-3 mechanical random number generator. The random number generator (RNG) contains 3 separate air mixing chambers 604. Each mixing chamber contains a holding tube 608, which in turn holds a number of light, hollow balls materially the same diameter and weight, such as 10 ping-pong balls 605. When the holding tube 608 bottom is opened (by a human machine operator), the balls 605 are released into the mixing chamber. An air blower 607 mixes the balls 605, forcing them to bounce randomly in the mixing chamber 605. Each ball is permanently marked with a number (0-9). After sufficiently mixing the balls, a "selection tube" 606 with a top air pressure release is activated to select one ball. Air pressure differential forces a random ball to the top of the selection tube 606. Once each selection tube 606 is activated, the 3-digit random number is identified by their marking. The result is a number between 000 and 999.

FIG. 40 depicts a schematic of an electronic 3-digit (true) random number generator. The random number generator includes a noise generator 625 based on an "avalanche" diode that is reversed biased to produce electrical noise. The voltage fluctuations will vary around the DC voltage bias point. An amplifier 626 is coupled to the noise generator 625 to increase the peak to peak amplitude of the noise. Coupled to the output of the amplifier 626 is an active low pass filter 627 which limits the upper frequency components of the amplified noise signal. Coupled to the output of the low pass filter 627 is an analog to digital converter 628 which digitizes the analog noise signal and converts it to a digital signal. A microcontroller 629 samples 3 push button switches 630 to allow a human operator to capture 3 decimal numbers in three 7 segment light emitting diode displays 632. A "power on" circuit 631 initializes the microcontroller 629. The entire circuit is energized by a DC power supply (not shown). The hardware random number generator provided herein is for example only and is not intended to be limiting.

FIG. 41 depicts a flow diagram of the main routine for the firmware located in microcontroller 629. The power initializing function 635 resets the internal stack pointer and program address generator. The first_switch subroutine 636 waits for the first switch to be depressed by the operator. At step 637 the RNG subroutine is called to produce the first random number (0-9). Step 638 converts the first number to a 7-segment pattern representing the first number by calling the display_digit_1 subroutine. Step 639 waits for the second switch to be depressed by calling subroutine second_switch. Step 640 calls subroutine RNG to produce the second random number (0-9). Step 641 converts the second number to a 7-segment pattern representing the second number by calling subroutine display_digit_2. Step 642 waits for the third switch to be depressed by calling third_switch subroutine. Step 643 calls subroutine RNG to produce the third random number (0-9). Step 644 is a call to display_digit_3 which takes the third random digit and displays it in the third 7-segment display. The main program now HALTS at step 645. To restart, the power must be cycled off and then on.

FIG. 42 depicts a flow diagram describing the first_switch subroutine. At step 646, the subroutine is entered and the first switch hardware input is read out at step 647. If the switch 1 input is low at step 648, the program continues to step 649. Otherwise, a loop back to step 647 to reread the switch 1 input occurs. At steps 649, 650, and 651 a switch debounce function occurs to ensure the switch status is stable. The subroutine returns to the calling function at step 652 once the debounce process is complete.

FIG. 43 depicts a flow diagram describing the second_switch subroutine. At step 653 the subroutine is entered and the second switch hardware input is read out at step 654. If the switch 2 input is low at step 655, the program continues to step 656. Otherwise, a loop back to step 654 to reread the switch 2 input occurs. At steps 656, 657, and 658 a switch debounce function occurs to ensure the switch status is stable. The subroutine returns to the calling function at step 659 once the debounce process is complete.

FIG. 44 depicts a flow diagram describing the third_switch subroutine. At step 660 the subroutine is entered and the third switch hardware input is read out at step 661. If the switch 3 input is low at step 662, the program continues to step 663. Otherwise, a loop back to step 661 to reread the switch 3 input occurs. At steps 663, 664, and 665 a switch debounce function occurs to ensure the switch status is stable. The subroutine returns to the calling function at step 666 once the debounce process is complete.

Figure 45:
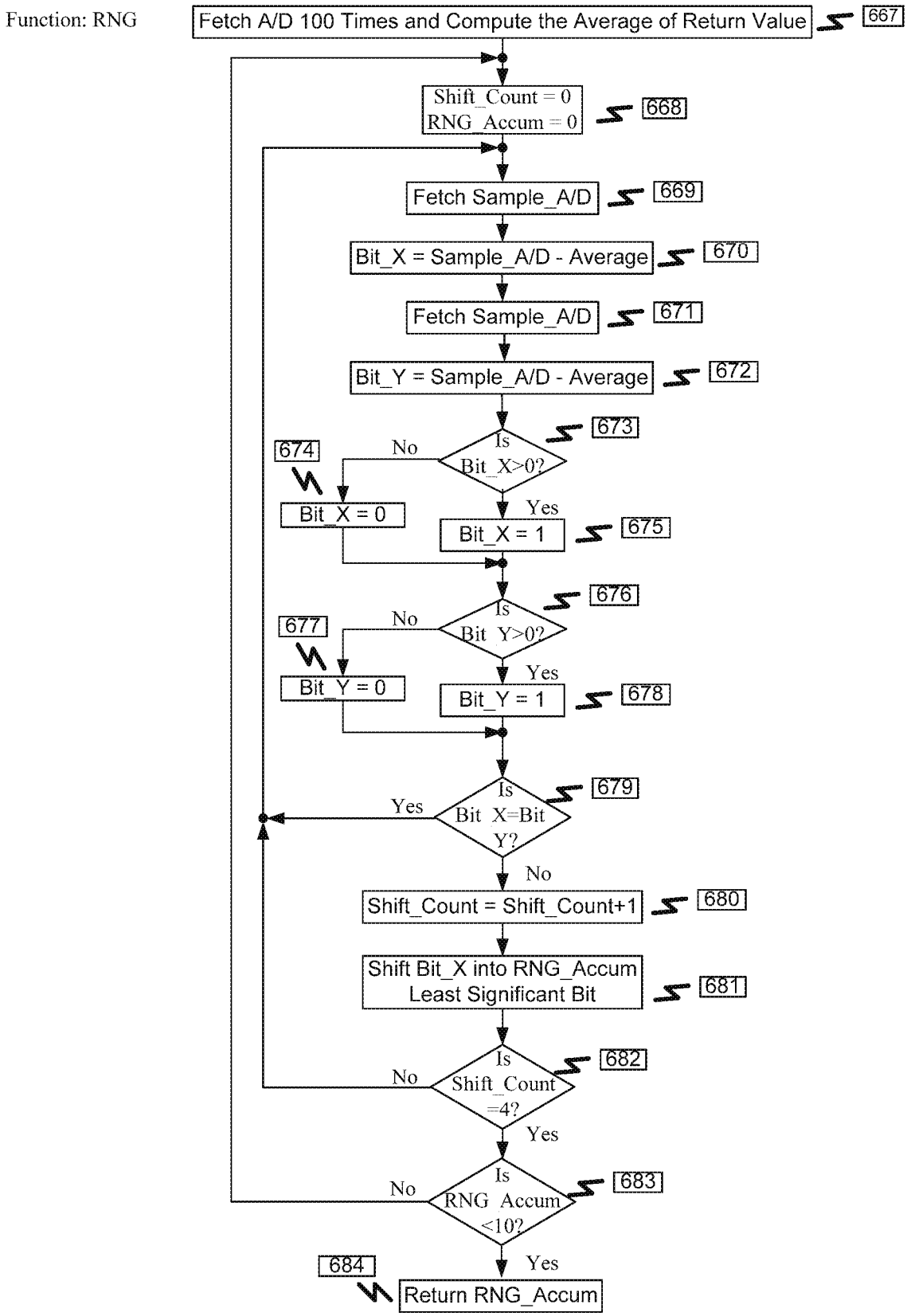
FIG. 45 depicts an exemplary embodiment of a method to electronically select a digit in a publicly verifiable entropy source according to an embodiment of the present invention.

FIG. 45 depicts a flowchart for the RNG (random number generator) subroutine. This subroutine will sample the hardware noise generator 625 via the A/D converter 628. At step 667 the A/D is averaged 100 times to determine the DC bias. The DC bias (average) is used as a threshold for converting the digitized noise signal into a series of bits (0, 1).

A whitening process is applied to the serial bit stream whereby a 1-0 pair is converted into a 1 bit. Conversely, a 0-1 pair is converted into a 0 bit. The pairs 1-1 and 0-0 are ignored. After the whitening process, 4 bits are selected to create a BCD or binary code decimal number. If the 4 bits represent a number higher than decimal 9, a new 4-bit sequence is reselected at step 682. This filtering process represents a modulo truncation bias function.

At step 668 variables shift_count and RNG_accum are set to zero. Both variables are used to construct a binary coded decimal (BCD) value. Step 669 samples the noise value using the hardware A/D converter 628. Step 670 converts the sample to a positive or negative value. Step 671 samples the noise value using the hardware A/D converter 628. Step 672 converts the sample to a positive or negative value.

At step 673, a determination occurs to define the bit as positive or negative. Step 674 forces Bit_X to a 0 if negative, while step 675 forces Bit_X to a 1 if positive. A similar process is performed on Bit_Y at steps 676, 677, and 678. Step 679 determines if the 2 bits Bit_X and Bit_Y are the same. If Bit_X and Bit_Y are the same, they are discarded and the program loops back to Step 669 to obtain 2 new samples. Otherwise, the shift count is incremented by 1 at step 680 and the value of Bit_X is left shifted into RNG_accum at step 681. At step 682 a determination occurs if 4 random bits have been accumulated. If less than 4 bits, the program loops back to step 669 to resample. If the shift count is 4, the program proceeds to step 683 to determine if the number representing in RNG_accum is 9 or less (0-9). If the number is greater than 9, the program loops back to step 668 to produce 4 new random bits. Step 683 represents the truncation bias check. If at step 683 the number is 9 or less, the program exits to the calling routine at step 684. When exiting, the value of RNG_accum is passed back to the calling routine.

Figure 46:
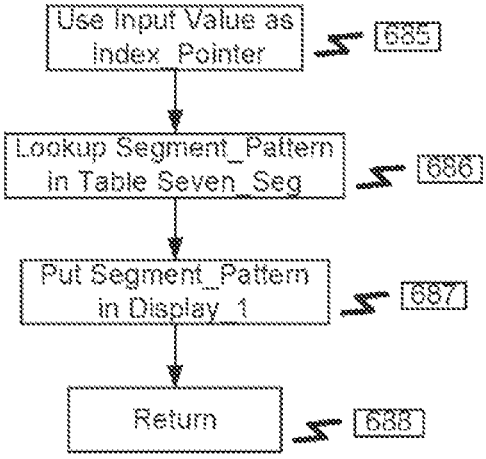
FIG. 46 depicts an example of a method for displaying a digit in an electronic publicly verifiable entropy source according to an embodiment of the present invention.

FIG. 46 depicts a flow diagram for the first digit display subroutine. Steps 685 and 686 use the input value to the subroutine (0-9) to select a display pattern from the table 698 found in FIG. 49. The 7-segment LED pattern is loaded into a 7-bit register in the microcontroller 629 (step 687) to control the segments of the display. Step 688 returns to the calling routine.

Figure 47:
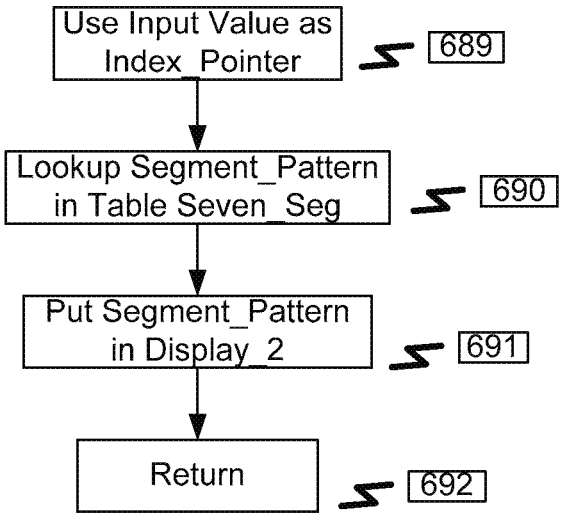
FIG. 47 depicts an example of a method for displaying a digit in an electronic publicly verifiable entropy source according to an embodiment of the present invention.

FIG. 47 depicts a flow diagram for the second digit display subroutine. Steps 689 and 690 use the input value to the subroutine (0-9) to select a display pattern from the table 698 found in FIG. 49. The 7-segment LED pattern is loaded into a 7-bit register in the microcontroller 629 (step 691) to control the segments of the display. Step 692 returns to the calling routine.

Figure 48:
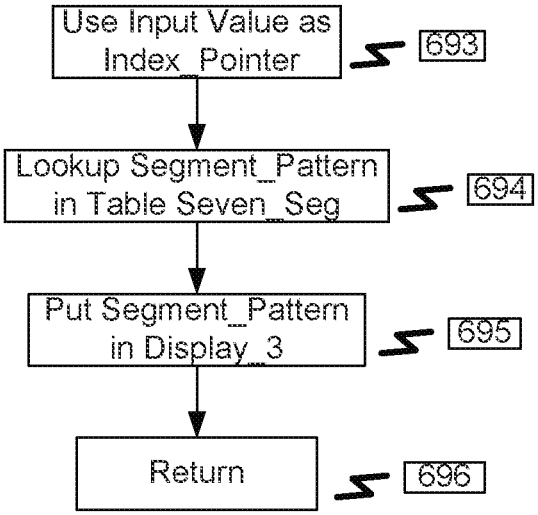
FIG. 48 depicts an example of a method for displaying a digit in an electronic publicly verifiable entropy source according to an embodiment of the present invention.

FIG. 48 is a flow diagram for the third digit display subroutine. Steps 693 and 694 use the input value to the subroutine (0-9) to select a display pattern from the table 698 found in FIG. 49. The 7-segment LED pattern is loaded into a 7-bit register in the microcontroller 629 (step 695) to control the segments of the display. Step 696 returns to the calling routine.

Figure 49:
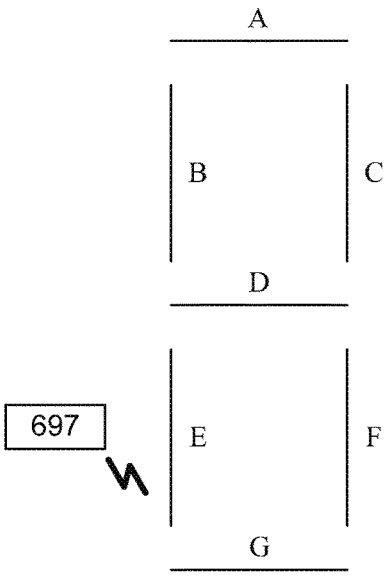
FIG. 49 depicts an example of the table mapping for displaying the digits in a publicly verifiable entropy source according to an embodiment of the present invention.

FIG. 49 shows the segment pattern in the 7 segment LED 697. The binary patterns that match the symbols 0-9 are seen in the Table: Seven_Seg 698. Table: Seven_Seg 698 represents the 7-bit patterns.

Further generally disclosed herein are additional alternative embodiments, which may incorporate the gaming elements previously described, such as using a publicly verifiable entropy source to provide a secondary game to amplify potential winnings. However, for these embodiments, the player is permitted to interact with a lottery website to select the secondary game numbers. By example, a lottery pick-3 game will be used to exemplify this game feature. An internet enabled electronic device with a human interface device (HID) will interact with the lottery website using a secure internet connection to permit the player to select their secondary game pick-3 number. It is to be noted the example provided using pick-3 is not intended to be a limitation in that other publicly verifiable entropy sources such as pick-4, pick-5, pick-6, keno, etc. may also be considered for the basis of the secondary game.

Figure 50:
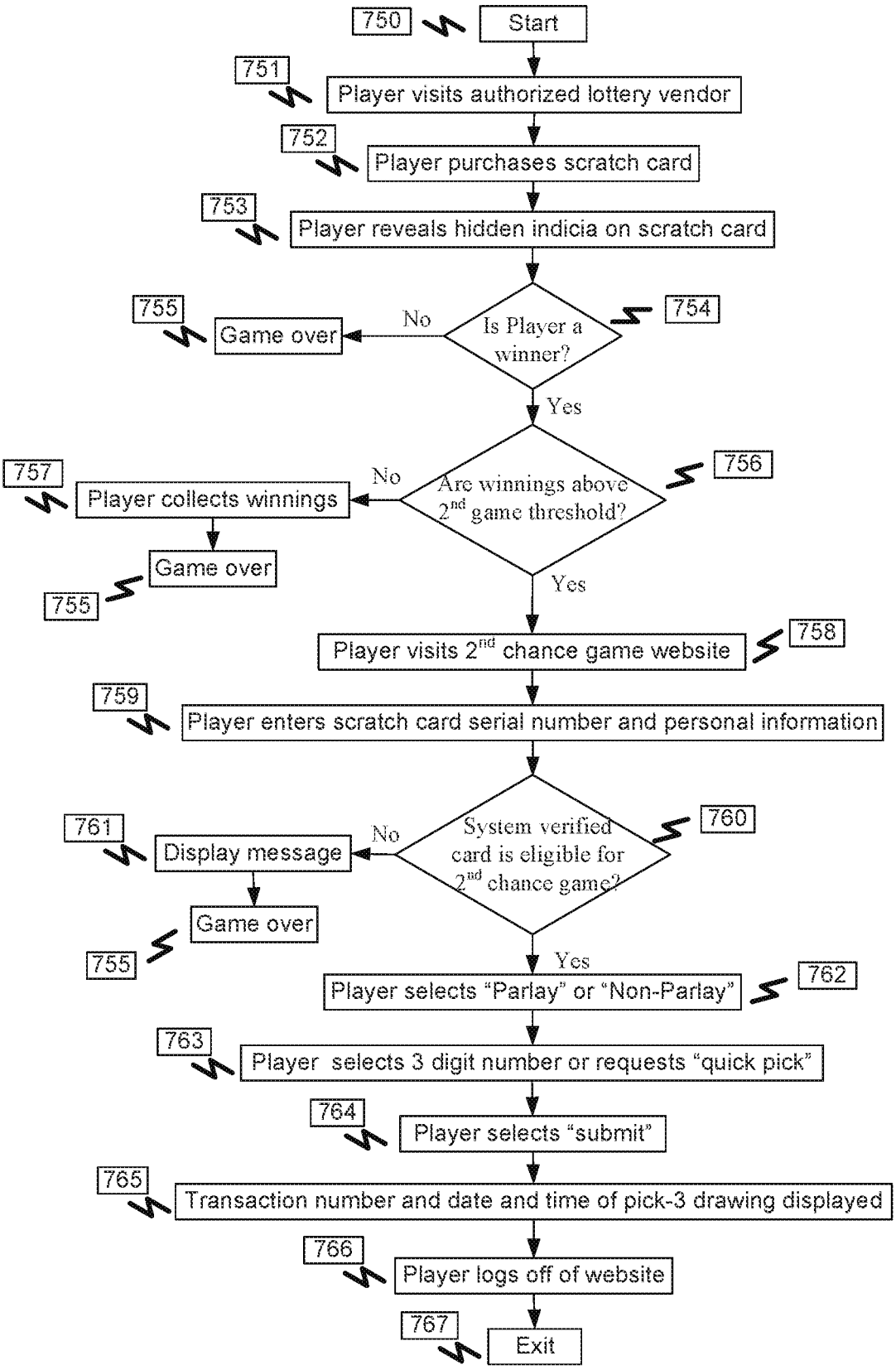
FIG. 50 depicts a flow diagram for a process allowing a player to buy a physical scratch off ticket at a lottery retail store and conditionally obtaining an electronic pick-3 number for entry into a secondary game according to an embodiment of the present invention.

FIG. 50 depicts a flow diagram for the process allowing a player to buy a physical scratch off ticket at a lottery retail store and conditionally obtaining an electronic pick-3 number for entry into a secondary game.

The process begins at step 750. A player visits an authorized lottery retailer at step 751 where they purchase an instant winner scratch off card at step 752. At step 753, the player reveals the hidden indicia on the scratch card. The revealed information determines a "win" or "no win" status at step 754. If the scratch off card reveals a "no win" then the game is over at step 755. If the scratch off card winnings are not above a designated threshold at step 756, the player collects displayed winnings at step 757 and the game is over at step 755.

If winnings are above the threshold at step 756, the player visits the lottery's secondary game website at step 758. The player enters the scratch card serial number and personal information at step 759. The lottery system verifies if the scratch off card is eligible for secondary chance game at step 760. If the verified card is not eligible for a secondary chance game, a message is displayed indicating non-eligibility at step 761 and the game is over at step 755. If eligible, the player selects parlay or non-parlay at step 762 and chooses a 3-digit number or optionally requests a "quick pick" at step 763. The player then selects "Submit" at step 764 and the website then provides a transaction number with date and time of the "pick 3" game displayed at step 765. The player logs off the lottery web site at step 766, and the process ends at step 767.

Figure 51:
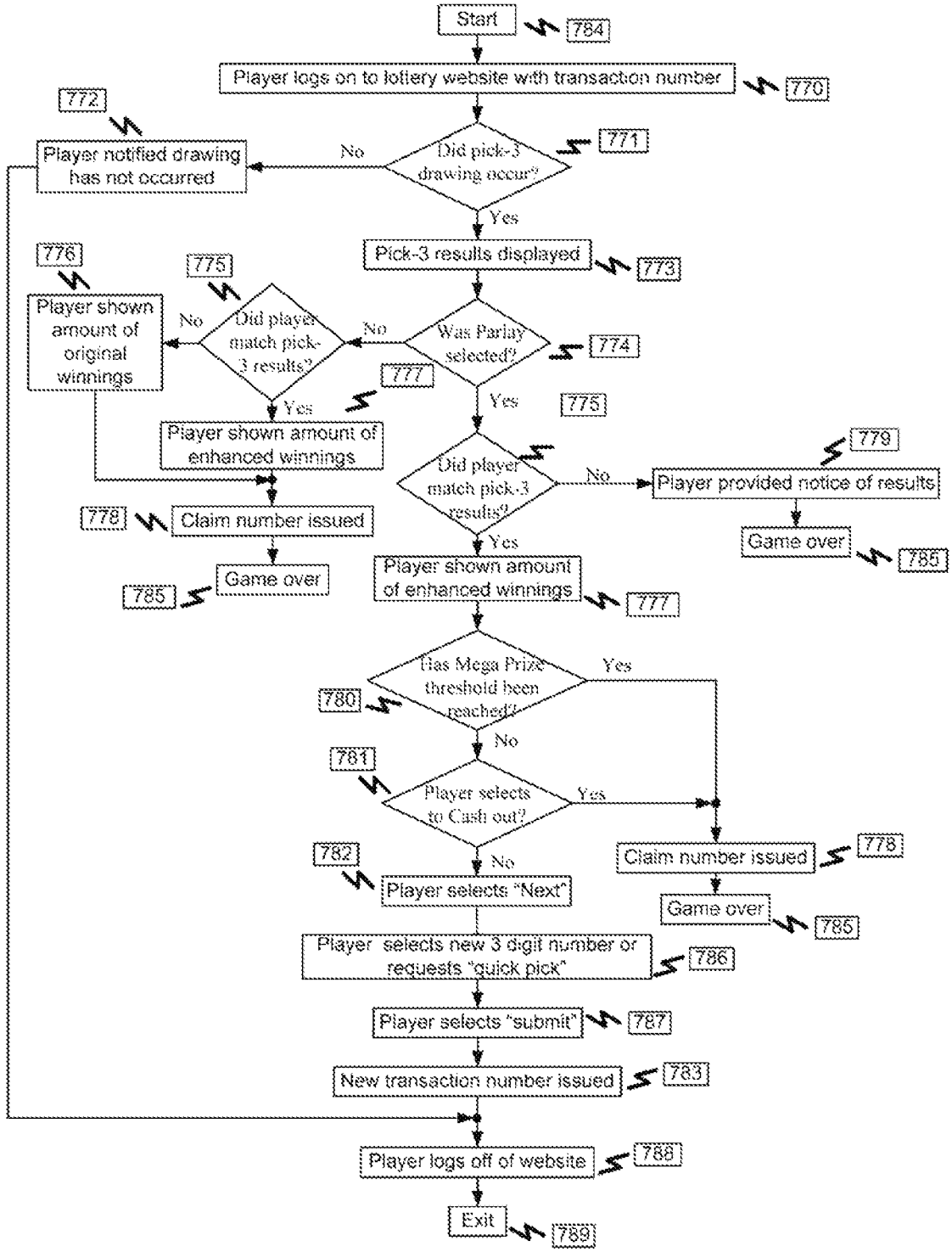
FIG. 51 depicts a flow diagram for a process allowing a player to check the results of the conditional secondary game and conditionally permit the player to continue to potentially enhance their winnings by obtaining a pick-3 number for entry into a new pick-3 contest according to an embodiment of the present invention.

FIG. 51 is a flow diagram for a process allowing a player to check the results of their conditional secondary game using an internet enabled electronic device with a HID and conditionally permit the player to continue to potentially enhance their winnings by obtaining a pick-3 number for entry into a new pick-3 contest. Several examples of a HID include but are not limited to a mouse, stylus, or touch screen. The process begins at step 784. In step 770, the player logs on to the lottery website with their previously issued transaction number to view the results of the pick-3 drawing. At step 771, the system will determine if the pick-3 drawing has occurred. If the drawing has not occurred yet, the player will be notified the drawing is still pending at step 772. The player will log off the website at step 788, and the process ends at step 789.

If the pick-3 drawing has occurred, step 773 will display the pick-3 results to the player. Step 774 determines if the player had previously selected to parlay their winnings. If the player did not select parlay, step 775 determines if the player's selected numbers matched the pick-3 numbers drawn. If the player did not match the pick-3 results, step 776 will display the amount of the original winnings from the scratch off ticket and step 778 issues a claim number for the player to collect their winnings. The game is over at step 785. If the player did match the pick-3 drawing, step 777 displays the amount of the player's enhanced winnings and step 778 issues a claim number for the player to collect their winnings. The game is over at step 785.

If the player did select to parlay their winnings, step 775 determines if the player's selected numbers matched the pick-3 numbers drawn. If the player did not match the pick-3 results, step 779 displays notification of the game results to the player and the game is over at step 785. If the player did match the pick-3 drawing, step 777 displays the amount of the player's enhanced winnings. At step 780 the system determines if the mega prize threshold (maximum amount of winnings) has been reached. If the mega prize threshold has been reached, step 778 issues a claim number to the player to collect their winnings and the game is over at step 785. If the mega prize threshold has not been reached, step 781 gives the player the choice to "cash out". If the player decides to cash out, step 778 issues a claim number for the player to collect their winnings and the game is over at step 785.

If the player does not decide to cash out, at step 782 the player will select "next" to continue playing the secondary game. In step 786 the player will select a new number for a new pick-3 drawing. The player can either select their own numbers or use a system generated "quick pick". At step 787 the player selects "submit" which will lock in their selections. At step 783 a new transaction number, the date, and the time of the next pick-3 drawing will be displayed to the player. The player logs off the website at step 788. The process is concluded at step 789.

FIG. 52 depicts an electronic screen layout for player's information submission to enter a secondary game. The Player Information Submission screen 808 is used by the player to enter the secondary game after purchasing a physical scratch off card that is eligible. The player will enter the scratch card serial number 809 into the field. The player will then hit "Verify" 810 to confirm the scratch off card they purchased was a winner and the winning amount is above the threshold that qualifies the player for the secondary game. After the player has confirmed they are eligible to participate in the secondary game, they will be asked to fill in their Name 811, Address 812, City 813, State 814, and Zip code 815. The player will need to select either Non-Parlay 816 or Parlay 817. The parlay option gives the player the opportunity to risk their initial winnings for a higher payout on the secondary game. The player can then either choose to manually enter their Pick-3 Selection 818 or have the system generate a random 3-digit number with Quick Pick 819. Last, the player will press "Submit" 820 which will lock in the players inputted information and game selections.

FIG. 53 depicts an electronic confirmation screen providing a player with a transaction number and a date and time for the publicly verifiable pick-3 drawing. The Submission Confirmation screen 821 will be presented to the player after they have submitted their personal information and game selections. They will receive a message thanking the player for their submission 822. The player will be issued a Transaction Number 823 which the player will use to log into the system to check their results. The player will also be given the Date and Time of the Pick-3 Drawing 824 being used as their publicly verifiable entropy source.

FIG. 54 depicts an electronic transaction number submission screen. The player will use the Electronic Transaction Number Submission screen 825 to check the results of their secondary game. The player will fill in the Second Chance Game Transaction Number 826 which the player was issued after their selections were submitted. The player will then Submit 827 their transaction number, logging the player in.

FIG. 55 depicts an electronic screen showing a player's secondary game results based on the player's transaction number. After the pick-3 drawing has occurred and the player has logged in with their transaction number, they will be presented with the Results Page 828. The page will display the player's Transaction Number 829 so the player can verify they are reviewing the correct entry. The page will also indicate the Date and Time when the Pick-3 Drawing 830 had occurred. The player will be shown the Pick-3 Selected 831 by them and the publicly verifiable Pick-3 Results 832. The screen will also display the Play Option Selected 833 in regards to their parlay option. The player will be shown the Game Results 834 of their secondary game entry. The player will be given the Enhanced Winnings Amount 835. A Claim Number 836 will be issued to the player which the player will use to collect their winnings. The player will need to decide if they would like to collect their winnings by Cashing Out 837 or they can continue playing by selecting Next 838.

FIG. 56 is a depiction of an electronic screen permitting the player to select and submit a pick-3 number for a new entry into a secondary game. If the player won a previous secondary game drawing and selects to continue playing, the player will be directed to the Pick-3 Number Selection screen 839. The player is asked to choose the numbers they would like to enter. The player manually enters their Pick-3 Selection 840 or have the system generate a random 3-digit number with Quick Pick 841. The player will press Submit 842 which will lock in the player's selection.

Further generally disclosed herein are additional alternative embodiments, which may incorporate the gaming elements previously described, such as using a publicly verifiable entropy source to provide a secondary game to amplify potential winnings. However, for these embodiments, the player is now permitted to purchase and play the scratch off card electronically using an internet enabled electronic device with HID and using a secure internet connection to a lottery website. As such, there is no further need to visit a lottery retailer for purchase of a scratch off card. The player will also play the secondary game using the internet enabled electronic device as described previously. For the secondary game example, a pick-3 drawing is used by example and provided herein but should not be considered limiting for the entropy source.

FIG. 57 depicts a flow diagram for the initial process of purchasing and playing an electronic version of a scratch off card. The process begins at step 797. In step 790 the player visits the lottery website using an internet enabled electronic device with a HID. Several examples of a HID include but are not limited to a mouse, stylus, or touch screen. At step 791 the player enters personal information (such as but not limited to name, address, phone number, and email). In step 792 the player pays for the purchase of a scratch off card using an electronic payment method. Some examples of an electronic payment could include but not limited to a credit card, debit card, ACH, Venmo, or Bitcoin through a secured transaction. After payment approval, at step 793, the lottery site randomly selects a scratch card from the available metadata cards in the lottery database. At step 794 the player is provided with their purchased virtual scratch card which is displayed on the internet enabled electronic device. At step 795 the player interacts with the virtual scratch card to reveal the hidden indicia using the HID.

At step 800 the system determines if the player is a winner. If the player is not a winner, the player is informed of "game over" and the game is finished at step 798. If the player is a winner, step 801 occurs where the system determines if the player's winnings are above the secondary game prize threshold. If the player's winnings are not above the secondary game prize threshold, at step 799 the system will issue the player a claim number for the amount of the initial win and the player will be informed that the game is over at step 798.

If the player's winnings are above the secondary game prize threshold, the player will select "next" at step 802. The player will then be directed to the secondary game's player information submission screen at step 796. In step 803 the player will decide if they want to Parlay (player risks the initial winnings from the first game) or Non-Parlay (player will not risk the initial winnings from the first game). At step 804 the player inputs their selected 3-digit number or optionally selects a "quick pick" (system generated 3-digit number). At step 805 the player selects "submit" which will lock in their selections with the system. At step 806 a transaction number, the date, and the time of the pick-3 drawing will be displayed to the player. The player logs off the web site at step 807 and the process is concluded at step 808.

The process for these embodiments for allowing a player to check the results of their conditional secondary game and conditionally permit the player to continue to potentially enhance their winnings is the same as previously described and depicted in FIGS. 51-56.

FIG. 58 depicts an electronic screen allowing a player to purchase an electronic scratch off card. The player will use the Ticket Purchase Screen 843 to purchase an electronic scratch off card. The player must choose from the available tickets in the Scratch Card Ticket Selection 844. The player will be asked to fill in their Name 845, Address 846, City 847, State 848, and Zip 849. The player will also be asked to provide a Credit Card Number 850, Expiration Date 851, and CVV2 852 security code to pay for the purchase of the electronic scratch off card. Once the player has filled in all the fields, they will hit Submit 853 to conclude their purchase.

FIG. 59 depicts an image of the purchased electronic scratch off card with all the hidden indicia exposed. After the player has purchased their electronic scratch off card, they will be taken to the Electronic Scratch Card Play screen 854. The screen will display an Electronic Scratch Card 855 to the player. The player will reveal the hidden indicia from the Electronic Scratch Card 855 using their internet enabled electronic device with HID. After the player has removed the hidden indicia, the player will hit Next 856 to be notified of the results of their Electronic Scratch Card 855 play.

As such, further generally disclosed herein are alternative embodiments of systems and methods to increase the operational lifetime of a scratch off ticket instant win lottery game by incorporating a condition secondary game function with at least one of prize amplification, a parlay option, and the use of a publicly verifiable entropy source.

It is understood that the above-described embodiments are only illustrative of the application of the principles of the present invention. The present invention may be embodied in other specific forms without departing from its spirit or essential characteristics. All changes that come within the meaning and range of equivalency of the claims are to be embraced within their scope. Thus, while the present invention has been fully described above with particularity and detail in connection with what is presently deemed to be the most practical and preferred embodiment of the invention, it will be apparent to those of ordinary skill in the art that numerous modifications may be made without departing from the principles and concepts of the invention as set forth in the claims.

What is claimed is:

1. A system for increasing the operational lifetime of a scratch-off ticket lottery game where all maximum award amount tickets have been identified by establishing a secondary game with qualified entry, the system comprising:

a computer system configured with a game specification file and at least one random number generator based on a publicly verifiable entropy source, the computer system programmed based on the game specification file and random number generator to:

randomly generate sequences of characters for the scratch-off lottery game, each sequence of characters corresponding to one of a winning combination and a losing combination, the winning combinations having different winning award amounts, the losing combinations having a zero winning award amount, at least one sequence of characters corresponding to a winning combination having a maximum award amount for the scratch-off lottery game;

establish a winning award amount threshold to qualify for entry into a secondary game, the winning award amount threshold being less than the maximum award amount for the scratch-off lottery game but greater than a lowest winning award amount; and randomly distribute the sequences of characters among a plurality of tickets for purchase;

wherein a holder of a purchased ticket with a sequence of characters corresponding to a winning combination having a winning award amount greater than or equal to the winning award amount threshold qualifies to play the secondary game.

2. The system of claim 1, further comprising a secondary game kiosk having a computer system configured with an application program to implement the secondary game.

3. The system of claim 1, further comprising a computer system configured with a web application program to implement the secondary game.

4. The system of claim 1, wherein the secondary game comprises one of a pick-3, pick-4, pick-5, pick-6, and keno game.

5. The system of claim 1, wherein the secondary game comprises a parlay option.

6. The system of claim 1, wherein a maximum winning award amount of the secondary game is greater than the maximum award amount for the scratch-off ticket lottery game.

7. The system of claim 1, wherein the random number generator comprises a digital random number generator.

8. A method for increasing the operational lifetime of a scratch-off ticket lottery game where all maximum award amount tickets have been identified by establishing a secondary game with qualified entry, the method comprising:

randomly generating sequences of characters via a random number generator of a computer system, the random number generator based on a publicly verifiable entropy source, each sequence of characters corresponding to one of a winning combination and a losing combination, the winning combinations having different winning award amounts, the losing combinations having a zero winning award amount, at least one sequence of characters corresponding to a winning combination having a maximum award amount for the scratch-off lottery game;

establishing a winning award amount threshold to qualify for entry into a secondary game via a game specification file of the computer system, the winning award amount threshold being less than the maximum award amount for the scratch-off lottery game but greater than a lowest winning award amount; and randomly distributing the sequences of characters via the random number generator of the computer system among a plurality of tickets for purchase;

wherein a holder of a purchased ticket with a sequence of characters corresponding to a winning combination having a winning award amount greater than or equal to the winning award amount threshold qualifies to play the secondary game.

9. The method of claim 8, further comprising implementing the secondary game on a secondary game kiosk having a computer system configured with an application program.

10. The method of claim 8, further comprising implementing the secondary game on a computer system with a web application program.

11. The method of claim 8, wherein the secondary game comprises one of a pick-3, pick-4, pick-5, pick-6, and keno game.

12. The method of claim 8, wherein the secondary game comprises a parlay option.

13. The method of claim 8, wherein a maximum winning award amount of the secondary game is greater than the maximum award amount for the scratch-off ticket lottery game.

14. The method of claim 8, wherein the random number generator comprises a digital random number generator.

15. A non-transitory computer-readable medium having stored thereon a computer program for execution by a processor configured to perform method for increasing the operational lifetime of a scratch-off ticket lottery game where all maximum award amount tickets have been identified by establishing a secondary game with qualified entry, the method comprising:

randomly generating sequences of characters via a random number generator based on a public verifiable entropy source, each sequence of characters corresponding to one of a winning combination and a losing combination, the winning combinations having different winning award amounts, the losing combinations having a zero winning award amount, at least one sequence of characters corresponding to a winning combination having a maximum award amount for the scratch-off lottery game;

establishing a winning award amount threshold to qualify for entry into a secondary game via a game specification file, the winning award amount threshold being less than the maximum award amount for the scratch-off lottery game but greater than a lowest winning award amount; and randomly distributing the sequences of characters via the random number generator among a plurality of tickets for purchase;

wherein a holder of a purchased ticket with a sequence of characters corresponding to a winning combination having a winning award amount greater than or equal to the winning award amount threshold qualifies to play the secondary game.

16. The computer-readable medium of claim 15, further comprising implementing the secondary game on a secondary game kiosk having a computer system configured with an application program.

17. The computer-readable medium of claim 15, further comprising implementing the secondary game on a computer system with a web application program.

18. The computer-readable medium of claim 15, wherein the secondary game comprises one of a pick-3, pick-4, pick-5, pick-6, and keno game.

19. The computer-readable medium of claim 15, wherein the secondary game comprises a parlay option.

20. The computer-readable medium of claim 15, wherein a maximum winning award amount of the secondary game is greater than the maximum award amount for the scratch-off ticket lottery game.

21. The computer-readable medium of claim 15, wherein the random number generator comprises a digital random number generator.

* * * * *